US007740186B2

(12) United States Patent
Macan et al.

(10) Patent No.: US 7,740,186 B2
(45) Date of Patent: Jun. 22, 2010

(54) DRENCHING SHOWER HEAD

(75) Inventors: Aaron Damian Macan, Loveland, CO (US); Michael J. Quinn, Windsor, CO (US)

(73) Assignee: Water Pik, Inc., Fort Collins, CO (US)

( * ) Notice: Subject to any disclaimer, the term of this patent is extended or adjusted under 35 U.S.C. 154(b) by 449 days.

(21) Appl. No.: 11/219,144

(22) Filed: Sep. 1, 2005

(65) Prior Publication Data

US 2006/0043214 A1 Mar. 2, 2006

Related U.S. Application Data

(60) Provisional application No. 60/606,579, filed on Sep. 1, 2004.

(51) Int. Cl.
*B05B 17/04* (2006.01)

(52) U.S. Cl. ..... 239/11; 239/463; 239/444; 239/446; 239/390; 239/381; 239/533.13; 239/602; 239/222.11; 239/240; 239/383

(58) Field of Classification Search ..... 239/99, 239/439, 443, 444, 446, 533.13, 546, 602, 239/11, 463, 390, 381, 383, 222.11, 240
See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 486,986 | A | 11/1892 | Schinke |
| 566,384 | A | 8/1896 | Englehart |
| 566,410 | A | 8/1896 | Schinke |
| 570,405 | A | 10/1896 | Jerguson et al. |
| 694,888 | A | 3/1902 | Pfluger |
| 800,802 | A | 10/1905 | Franquist |
| 832,523 | A | 10/1906 | Andersson |

(Continued)

FOREIGN PATENT DOCUMENTS

| | | |
|---|---|---|
| CA | 659510 | 3/1963 |

(Continued)

OTHER PUBLICATIONS

Color Copy, Labeled 1A, Gemlo, available at least as early as Dec. 2, 1998.

(Continued)

*Primary Examiner*—Dinh Q Nguyen
(74) *Attorney, Agent, or Firm*—Dorsey & Whitney LLP

(57) ABSTRACT

An improved shower head having multiple modes of operation. The shower head may include a first turbine and turbine, each disposed within a unique flow channel. The first and second turbines may interrupt water flow through their respective flow channels, thereby providing at least one pulsating water spray emanating from the shower head. The shower head may include a third flow channel having no turbine disposed therein, such that water flowing through the third flow channel is not interrupted and thus emitted from the shower head as a drenching spray.

22 Claims, 56 Drawing Sheets

U.S. PATENT DOCUMENTS

| | | | |
|---|---|---|---|
| 835,678 | A | 11/1906 | Hammond |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,046,573 | A | 12/1912 | Ellis |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,692,394 | A | 11/1928 | Sundh |
| 1,695,263 | A | 12/1928 | Jacques |
| 1,724,147 | A | 8/1929 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,849,517 | A | 3/1932 | Fraser |
| 1,890,156 | A | 12/1932 | Konig |
| 1,906,575 | A | 5/1933 | Goeriz |
| 1,934,553 | A | 11/1933 | Mueller et al. |
| 1,946,207 | A | 2/1934 | Haire |
| 2,011,446 | A | 8/1935 | Judell |
| 2,024,930 | A | 12/1935 | Judell |
| 2,033,467 | A | 3/1936 | Groeniger |
| 2,044,445 | A | 6/1936 | Price et al. |
| 2,085,854 | A | 7/1937 | Hathaway et al. |
| 2,096,912 | A | 10/1937 | Morris |
| 2,117,152 | A | 5/1938 | Crosti |
| D113,439 | S | 2/1939 | Reinecke |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,285,831 | A | 6/1942 | Pennypacker |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,546,348 | A | 3/1951 | Schuman |
| 2,567,642 | A | 9/1951 | Penshaw |
| 2,581,129 | A | 1/1952 | Muldoon |
| D166,073 | S | 3/1952 | Dunkleberger |
| 2,648,762 | A | 8/1953 | Dunkelberger |
| 2,664,271 | A | 12/1953 | Arutunoff |
| 2,671,693 | A | 3/1954 | Hyser et al. |
| 2,676,806 | A | 4/1954 | Bachman |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,792,847 | A | 5/1957 | Spencer |
| 2,873,999 | A | 2/1959 | Webb |
| 2,930,505 | A | 3/1960 | Meyer |
| 2,931,672 | A | 4/1960 | Merritt et al. |
| 2,935,265 | A | 5/1960 | Richter |
| 2,949,242 | A | 8/1960 | Blumberg et al. |
| 2,957,587 | A | 10/1960 | Tobin |
| 2,966,311 | A | 12/1960 | Davis |
| D190,295 | S | 5/1961 | Becker |
| 2,992,437 | A | 7/1961 | Nelson et al. |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,081,339 | A | 3/1963 | Green et al. |
| 3,092,333 | A | 6/1963 | Gaiotto |
| 3,098,508 | A | 7/1963 | Gerdes |
| 3,103,723 | A | 9/1963 | Becker |
| 3,104,815 | A | 9/1963 | Schultz |
| 3,104,827 | A | 9/1963 | Aghnides |
| 3,111,277 | A | 11/1963 | Grimsley |
| 3,112,073 | A | 11/1963 | Larson et al. |
| 3,143,857 | A | 8/1964 | Eaton |
| 3,196,463 | A | 7/1965 | Farneth |
| 3,231,200 | A | 1/1966 | Heald |
| 3,236,545 | A | 2/1966 | Parkes et al. |
| 3,239,152 | A | 3/1966 | Bachli et al. |
| 3,266,059 | A | 8/1966 | Stelle |
| 3,272,437 | A | 9/1966 | Coson |
| 3,273,359 | A | 9/1966 | Fregeolle |
| 3,306,634 | A | 2/1967 | Groves et al. |
| 3,323,148 | A | 6/1967 | Burnon |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,363,842 | A | 1/1968 | Burns |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |
| 3,492,029 | A | 1/1970 | French et al. |
| 3,516,611 | A | 6/1970 | Piggott |
| 3,546,961 | A | 12/1970 | Marton |
| 3,550,863 | A | 12/1970 | McDermott |
| 3,552,436 | A | 1/1971 | Stewart |
| 3,565,116 | A | 2/1971 | Gabin |
| 3,566,917 | A | 3/1971 | White |
| 3,580,513 | A | 5/1971 | Martin |
| 3,584,822 | A | 6/1971 | Oram |
| 3,596,835 | A | 8/1971 | Smith et al. |
| 3,612,577 | A | 10/1971 | Pope |
| 3,641,333 | A | 2/1972 | Gendron |
| 3,647,144 | A | 3/1972 | Parkison et al. |
| 3,663,044 | A | 5/1972 | Contreras et al. |
| 3,669,470 | A | 6/1972 | Deurloo |
| 3,672,648 | A | 6/1972 | Price |
| 3,682,392 | A | 8/1972 | Kint |
| 3,685,745 | A | 8/1972 | Peschcke-koedt |
| D224,834 | S | 9/1972 | Laudell |
| 3,711,029 | A | 1/1973 | Bartlett |
| 3,722,798 | A | 3/1973 | Bletcher et al. |
| 3,722,799 | A | 3/1973 | Rauh |
| 3,731,084 | A | 5/1973 | Trevorrow |
| 3,754,779 | A | 8/1973 | Peress |
| D228,622 | S | 10/1973 | Juhlin |
| 3,762,648 | A | 10/1973 | Deines et al. |
| 3,768,735 | A | 10/1973 | Ward |
| 3,786,995 | A | 1/1974 | Manoogian et al. |
| 3,801,019 | A | 4/1974 | Trenary et al. |
| 3,810,580 | A | 5/1974 | Rauh |
| 3,826,454 | A | 7/1974 | Zieger |
| 3,840,734 | A | 10/1974 | Oram |

3,845,291 A 10/1974 Portyrata
3,860,271 A 1/1975 Rodgers
3,861,719 A 1/1975 Hand
3,865,310 A 2/1975 Elkins et al.
3,869,151 A 3/1975 Fletcher et al.
3,896,845 A 7/1975 Parker
3,902,671 A 9/1975 Symmons
3,910,277 A 10/1975 Zimmer
D237,708 S 11/1975 Grohe
3,929,164 A 12/1975 Richter
3,958,756 A 5/1976 Trenary et al.
D240,322 S 6/1976 Staub
3,967,783 A 7/1976 Halsted et al.
3,979,096 A 9/1976 Zieger
3,997,116 A 12/1976 Moen
3,998,390 A 12/1976 Peterson et al.
3,999,714 A 12/1976 Lang
4,005,880 A 2/1977 Anderson et al.
4,006,920 A 2/1977 Sadler et al.
4,023,782 A 5/1977 Eifer
4,042,984 A 8/1977 Butler
4,045,054 A 8/1977 Arnold
D245,858 S 9/1977 Grube
D245,860 S 9/1977 Grube
4,068,801 A 1/1978 Leutheuser
4,081,135 A 3/1978 Tomaro
4,084,271 A 4/1978 Ginsberg
4,091,998 A 5/1978 Peterson
D249,356 S 9/1978 Nagy
4,117,979 A 10/1978 Lagarelli et al.
4,129,257 A 12/1978 Eggert
4,130,120 A 12/1978 Kohler, Jr.
4,131,233 A 12/1978 Koenig
4,133,486 A 1/1979 Fanella
4,135,549 A 1/1979 Baker
D251,045 S 2/1979 Grube
4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,167,196 A 9/1979 Morris
4,174,822 A 11/1979 Larsson
4,185,781 A 1/1980 O'Brien
4,190,207 A * 2/1980 Fienhold et al. ..... 239/381
4,191,332 A 3/1980 De Langis et al.
4,203,550 A 5/1980 On
4,209,132 A 6/1980 Kwan
D255,626 S 7/1980 Grube
4,219,160 A 8/1980 Allred, Jr.
4,221,338 A 9/1980 Shames et al.
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,282,612 A 8/1981 King
D261,300 S 10/1981 Klose
D261,417 S 10/1981 Klose
4,303,201 A 12/1981 Elkins et al.
4,319,608 A 3/1982 Raikov et al.
4,330,089 A 5/1982 Finkbeiner
D266,212 S 9/1982 Haug et al.
4,350,298 A 9/1982 Tada
4,353,508 A 10/1982 Butterfield et al.
4,358,056 A 11/1982 Greenhut et al.
D267,582 S 1/1983 Mackay et al.
D268,359 S 3/1983 Klose
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
4,432,392 A 2/1984 Paley
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Halling
D281,820 S 12/1985 Oba et al.
4,561,593 A 12/1985 Cammack et al.
4,564,889 A 1/1986 Bolson
4,571,003 A 2/1986 Roling et al.
4,572,232 A 2/1986 Gruber
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,616,298 A 10/1986 Bolson
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
RE32,386 E 3/1987 Hunter
4,650,120 A 3/1987 Kress
4,650,470 A 3/1987 Epstein
4,652,025 A 3/1987 Conroy, Sr.
4,654,900 A 4/1987 McGhee
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,719,654 A 1/1988 Blessing
4,733,337 A 3/1988 Bieberstein
D295,437 S 4/1988 Fabian
4,739,801 A 4/1988 Kimura et al.
4,749,126 A 6/1988 Kessener et al.
D296,582 S 7/1988 Haug et al.
4,754,928 A 7/1988 Rogers et al.
D297,160 S 8/1988 Robbins
4,764,047 A 8/1988 Johnston et al.
4,778,104 A 10/1988 Fisher
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,842,059 A 6/1989 Tomek
D302,325 S 7/1989 Charet et al.
4,850,616 A 7/1989 Pava
4,854,499 A 8/1989 Neuman
4,856,822 A 8/1989 Parker
4,865,362 A 9/1989 Holden
D303,830 S 10/1989 Ramsey et al.
4,871,196 A 10/1989 Kingsford
4,896,658 A 1/1990 Yonekubo et al.
D306,351 S 2/1990 Charet et al.
4,901,927 A 2/1990 Valdivia
4,903,178 A 2/1990 Englot et al.
4,903,897 A 2/1990 Hayes
4,903,922 A 2/1990 Harris, III
4,907,137 A 3/1990 Schladitz et al.
4,907,744 A 3/1990 Jousson
4,909,435 A 3/1990 Kidouchi et al.
4,914,759 A 4/1990 Goff 4,946,202 A 8/1990 Perricone
4,951,329 A 8/1990 Shaw
4,953,585 A 9/1990 Rollini et al.
4,964,573 A 10/1990 Lipski
4,972,048 A 11/1990 Martin
D313,267 S 12/1990 Lenci et al.
4,976,460 A 12/1990 Newcombe et al.
D314,246 S 1/1991 Bache
D315,191 S 3/1991 Mikol
4,998,673 A 3/1991 Pilolla
5,004,158 A 4/1991 Halem et al.
D317,348 S 6/1991 Geneve et al.
5,020,570 A 6/1991 Cotter
5,022,103 A 6/1991 Faist
5,032,015 A 7/1991 Christianson
5,033,528 A 7/1991 Volcani
5,033,897 A 7/1991 Chen
D319,294 S 8/1991 Kohler, Jr. et al.
D320,064 S 9/1991 Presman
5,046,764 A 9/1991 Kimura et al.
D321,062 S 10/1991 Bonbright
5,058,804 A 10/1991 Yonekubo et al.
D322,119 S 12/1991 Haug et al.
D322,681 S 12/1991 Yuen
5,070,552 A 12/1991 Gentry et al.
D323,545 S 1/1992 Ward
5,082,019 A 1/1992 Tetrault
5,086,878 A 2/1992 Swift
5,090,624 A 2/1992 Rogers
5,100,055 A 3/1992 Rokitenetz et al.
D325,769 S 4/1992 Haug et al.
D325,770 S 4/1992 Haug et al.
5,103,384 A 4/1992 Drohan
D326,311 S 5/1992 Lenci et al.
D327,115 S 6/1992 Rogers
5,121,511 A 6/1992 Sakamoto et al.
D327,729 S 7/1992 Rogers
5,127,580 A 7/1992 Fu-I
5,134,251 A 7/1992 Martin
D328,944 S 8/1992 Robbins
5,141,016 A 8/1992 Nowicki
D329,504 S 9/1992 Yuen
5,143,300 A 9/1992 Cutler
5,145,114 A 9/1992 Monch
5,148,556 A 9/1992 Bottoms et al.
D330,068 S 10/1992 Haug et al.
D330,408 S 10/1992 Thacker
D330,409 S 10/1992 Raffo
5,153,976 A 10/1992 Benchaar et al.
5,154,355 A 10/1992 Gonzalez
5,154,483 A 10/1992 Zeller
5,161,567 A 11/1992 Humpert
5,163,752 A 11/1992 Copeland et al.
5,171,429 A 12/1992 Yasuo
5,172,860 A 12/1992 Yuch
5,172,862 A 12/1992 Heimann et al.
5,172,866 A 12/1992 Ward
D332,303 S 1/1993 Klose
D332,994 S 2/1993 Huen
D333,339 S 2/1993 Klose
5,197,767 A 3/1993 Kimura et al.
D334,794 S 4/1993 Klose
D335,171 S 4/1993 Lenci et al.
5,201,468 A 4/1993 Freier et al.
5,206,963 A 5/1993 Wiens
5,207,499 A 5/1993 Vajda et al.
5,213,267 A 5/1993 Heimann et al.
5,220,697 A 6/1993 Birchfield
D337,839 S 7/1993 Zeller
5,228,625 A 7/1993 Grassberger
5,230,106 A 7/1993 Henkin et al.
D338,542 S 8/1993 Yuen
5,232,162 A 8/1993 Chih
D339,492 S 9/1993 Klose
D339,627 S 9/1993 Klose
D339,848 S 9/1993 Gottwald
5,246,169 A 9/1993 Heimann et al.
5,246,301 A 9/1993 Hirasawa
D340,376 S 10/1993 Klose
5,253,670 A 10/1993 Perrott
5,253,807 A 10/1993 Newbegin
5,254,809 A 10/1993 Martin
D341,007 S 11/1993 Haug et al.
D341,191 S 11/1993 Klose
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,277,391 A 1/1994 Haug et al.
5,286,071 A 2/1994 Storage
5,288,110 A 2/1994 Allread
5,294,054 A 3/1994 Benedict et al.
5,297,735 A 3/1994 Heimann et al.
5,297,739 A 3/1994 Allen
D345,811 S 4/1994 Van Deursen et al.
D346,426 S 4/1994 Warshawsky
D346,428 S 4/1994 Warshawsky
D346,430 S 4/1994 Warshawsky
D347,262 S 5/1994 Black et al.
D347,265 S 5/1994 Gottwald
5,316,216 A 5/1994 Cammack et al.
D348,720 S 7/1994 Haug et al.
5,329,650 A 7/1994 Zaccai et al.
D349,947 S 8/1994 Hing-Wah
5,333,787 A 8/1994 Smith et al.
5,333,789 A 8/1994 Garneys
5,340,064 A 8/1994 Heimann et al.
5,340,165 A 8/1994 Sheppard
D350,808 S 9/1994 Warshawsky
5,344,080 A 9/1994 Matsui
5,349,987 A 9/1994 Shieh
5,356,076 A 10/1994 Bishop
5,356,077 A 10/1994 Shames
D352,092 S 11/1994 Warshawsky
D352,347 S 11/1994 Dannenberg
D352,766 S 11/1994 Hill et al.
5,368,235 A 11/1994 Drozdoff et al.
5,369,556 A 11/1994 Zeller
5,370,427 A 12/1994 Hoelle et al.
5,385,500 A 1/1995 Schmidt
D355,242 S 2/1995 Warshawsky
D355,703 S 2/1995 Duell
D356,626 S 3/1995 Wang
5,397,064 A 3/1995 Heitzman
5,398,872 A 3/1995 Joubran
5,398,977 A 3/1995 Berger et al.
5,402,812 A 4/1995 Moineau et al.
5,405,089 A 4/1995 Heimann et al.
5,414,879 A 5/1995 Hiraishi et al.
5,423,348 A 6/1995 Jezek et al.
5,433,384 A 7/1995 Chan et al.
D361,399 S 8/1995 Carbone et al.
D361,623 S 8/1995 Huen
5,441,075 A 8/1995 Clare
5,449,206 A 9/1995 Lockwood
D363,360 S 10/1995 Santarsiero
5,454,809 A 10/1995 Janssen
5,468,057 A 11/1995 Megerle et al.
D364,935 S 12/1995 deBlois
D365,625 S 12/1995 Bova
D365,646 S 12/1995 deBlois
5,476,225 A * 12/1995 Chan ..... 239/449
D366,309 S 1/1996 Huang
D366,707 S 1/1996 Kaiser
D366,708 S 1/1996 Santarsiero D366,709 S 1/1996 Szmanski
D366,710 S 1/1996 Szymanski
5,481,765 A 1/1996 Wang
D366,948 S 2/1996 Carbone
D367,315 S 2/1996 Andrus
D367,333 S 2/1996 Swyst
D367,696 S 3/1996 Andrus
D367,934 S 3/1996 Carbone
D368,146 S 3/1996 Carbone
D368,317 S 3/1996 Swyst
5,499,767 A 3/1996 Morand
D368,539 S 4/1996 Carbone et al.
D368,540 S 4/1996 Santarsiero
D368,541 S 4/1996 Kaiser et al.
D368,542 S 4/1996 deBlois et al.
D369,204 S 4/1996 Andrus
D369,205 S 4/1996 Andrus
5,507,436 A 4/1996 Ruttenberg
D369,873 S 5/1996 deBlois et al.
D369,874 S 5/1996 Santarsiero
D369,875 S 5/1996 Carbone
D370,052 S 5/1996 Chan et al.
D370,250 S 5/1996 Fawcett et al.
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.
5,521,803 A 5/1996 Eckert et al.
D370,542 S 6/1996 Santarsiero
D370,735 S 6/1996 deBlois
D370,987 S 6/1996 Santarsiero
D370,988 S 6/1996 Santarsiero
D371,448 S 7/1996 Santarsiero
D371,618 S 7/1996 Nolan
D371,619 S 7/1996 Szymanski
D371,856 S 7/1996 Carbone
D372,318 S 7/1996 Szymanski
D372,319 S 7/1996 Carbone
5,531,625 A 7/1996 Zhong
5,539,624 A 7/1996 Dougherty
D372,548 S 8/1996 Carbone
D372,998 S 8/1996 Carbone
D373,210 S 8/1996 Santarsiero
D373,434 S 9/1996 Nolan
D373,435 S 9/1996 Nolan
D373,645 S 9/1996 Johnstone et al.
D373,646 S 9/1996 Szymanski et al.
D373,647 S 9/1996 Kaiser
D373,648 S 9/1996 Kaiser
D373,649 S 9/1996 Carbone
D373,651 S 9/1996 Szymanski
D373,652 S 9/1996 Kaiser
5,551,637 A 9/1996 Lo
5,552,973 A 9/1996 Hsu
5,558,278 A 9/1996 Gallorini
D374,271 S 10/1996 Fleischmann
D374,297 S 10/1996 Kaiser
D374,298 S 10/1996 Swyst
D374,299 S 10/1996 Carbone
D374,493 S 10/1996 Szymanski
D374,494 S 10/1996 Santarsiero
D374,732 S 10/1996 Kaiser
D374,733 S 10/1996 Santasiero
5,560,548 A 10/1996 Mueller et al.
5,567,115 A 10/1996 Carbone
D375,541 S 11/1996 Michaluk
5,577,664 A * 11/1996 Heitzman ..... 239/99
D376,217 S 12/1996 Kaiser
D376,860 S 12/1996 Santarsiero
D376,861 S 12/1996 Johnstone et al.
D376,862 S 12/1996 Carbone
5,605,173 A 2/1997 Arnaud
D378,401 S 3/1997 Neufeld et al.
5,613,638 A 3/1997 Blessing
5,613,639 A 3/1997 Storm et al.
5,615,837 A 4/1997 Roman
5,624,074 A 4/1997 Parisi
5,624,498 A 4/1997 Lee et al.
D379,212 S 5/1997 Chan
D379,404 S 5/1997 Spelts
5,632,049 A 5/1997 Chen
D381,405 S 7/1997 Waidele et al.
D381,737 S 7/1997 Chan
D382,936 S 8/1997 Shfaram
5,653,260 A 8/1997 Huber
5,667,146 A 9/1997 Pimentel et al.
D385,332 S 10/1997 Andrus
D385,333 S 10/1997 Caroen et al.
D385,334 S 10/1997 Caroen et al.
D385,616 S 10/1997 Dow et al.
D385,947 S 11/1997 Dow et al.
D387,230 S 12/1997 von Buelow et al.
5,699,964 A 12/1997 Bergmann et al.
5,702,057 A 12/1997 Huber
D389,558 S 1/1998 Andrus
5,704,080 A 1/1998 Kuhne
5,718,380 A 2/1998 Schorn et al.
D392,369 S 3/1998 Chan
5,730,361 A 3/1998 Thonnes
5,730,362 A 3/1998 Cordes
5,730,363 A 3/1998 Kress
5,742,961 A 4/1998 Casperson et al.
D394,490 S 5/1998 Andrus et al.
5,746,375 A 5/1998 Guo
5,749,552 A 5/1998 Fan
5,749,602 A 5/1998 Delaney et al.
D394,899 S 6/1998 Caroen et al.
D395,074 S 6/1998 Neibrook
D395,075 S 6/1998 Neibrook et al.
D395,142 S 6/1998 Neilhook
5,765,760 A 6/1998 Kuo
5,769,802 A 6/1998 Wang
5,772,120 A 6/1998 Huber
5,778,939 A 7/1998 Hok-Yin
5,788,157 A 8/1998 Kress
D398,370 S 9/1998 Purdy
5,806,771 A 9/1998 Loschelder et al.
5,819,791 A 10/1998 Chronister et al.
5,820,574 A 10/1998 Henkin et al.
5,823,431 A 10/1998 Pierce
5,823,442 A 10/1998 Guo
5,833,138 A 11/1998 Crane et al.
5,839,666 A 11/1998 Heimann et al.
D402,350 S 12/1998 Andrus
D403,754 S 1/1999 Gottwald
D404,116 S 1/1999 Bosio
5,855,348 A 1/1999 Fornara
5,860,599 A 1/1999 Lin
5,862,543 A 1/1999 Reynoso et al.
5,862,985 A 1/1999 Neibrook et al.
D405,502 S 2/1999 Tse
5,865,375 A 2/1999 Hsu
5,865,378 A 2/1999 Hollinshead et al.
5,873,647 A 2/1999 Kurtz et al.
D408,893 S 4/1999 Tse
D409,276 S 5/1999 Ratzlaff
D410,276 S 5/1999 Ben-Tsur
5,918,809 A 7/1999 Simmons
5,918,811 A 7/1999 Denham et al.
D413,157 S 8/1999 Ratzlaff
5,937,905 A 8/1999 Santos
5,938,123 A 8/1999 Heitzman
5,947,388 A 9/1999 Woodruff
D415,247 S 10/1999 Haverstraw et al.

5,961,046 A 10/1999 Joubran
5,979,776 A 11/1999 Williams
5,992,762 A 11/1999 Wang
D418,200 S 12/1999 Ben-Tsur
5,997,047 A 12/1999 Pimentel et al.
6,003,165 A 12/1999 Loyd
D418,902 S 1/2000 Haverstraw et al.
D418,903 S 1/2000 Haverstraw et al.
D418,904 S 1/2000 Milrud
D421,099 S 2/2000 Mullenmeister
6,021,960 A 2/2000 Kehat
D422,053 S 3/2000 Brenner et al.
6,042,027 A 3/2000 Sandvik
6,042,155 A 3/2000 Lockwood
D422,336 S 4/2000 Haverstraw et al.
D422,337 S 4/2000 Chan
D423,083 S 4/2000 Haug et al.
D423,110 S 4/2000 Cipkowski
D424,160 S 5/2000 Haug et al.
D424,161 S 5/2000 Haug et al.
D424,162 S 5/2000 Haug et al.
D424,163 S 5/2000 Haug et al.
D426,290 S 6/2000 Haug et al.
D427,661 S 7/2000 Haverstraw et al.
D428,110 S 7/2000 Haug et al.
D428,125 S 7/2000 Chan
6,085,780 A 7/2000 Morris
D430,267 S 8/2000 Milrud et al.
6,095,801 A 8/2000 Spiewak
D430,643 S 9/2000 Tse
6,113,002 A 9/2000 Finkbeiner
6,123,272 A 9/2000 Havican et al.
6,123,308 A 9/2000 Faisst
D432,624 S 10/2000 Chan
D432,625 S 10/2000 Chan
D433,096 S 10/2000 Tse
D433,097 S 10/2000 Tse
6,126,091 A 10/2000 Heitzman
6,126,290 A 10/2000 Veigel
D434,109 S 11/2000 Ko
6,164,569 A 12/2000 Hollinshead et al.
6,164,570 A 12/2000 Smeltzer
D435,889 S 1/2001 Ben-Tsur et al.
D439,305 S 3/2001 Slothower
6,199,580 B1 3/2001 Morris
6,202,679 B1 3/2001 Titus
D440,276 S 4/2001 Slothower
D440,277 S 4/2001 Slothower
D440,278 S 4/2001 Slothower
D441,059 S 4/2001 Fleischmann
6,209,799 B1 4/2001 Finkbeiner
D443,025 S 5/2001 Kollmann et al.
D443,026 S 5/2001 Kollmann et al.
D443,027 S 5/2001 Kollmann et al.
D443,029 S 5/2001 Kollmann et al.
6,223,998 B1 5/2001 Heitzman
6,230,984 B1 5/2001 Jager
6,230,988 B1 5/2001 Chao et al.
6,230,989 B1 5/2001 Haverstraw et al.
D443,335 S 6/2001 Andrus
D443,336 S 6/2001 Kollmann et al.
D443,347 S 6/2001 Gottwald
6,250,572 B1 6/2001 Chen
D444,865 S 7/2001 Gottwald
D445,871 S 7/2001 Fan
6,254,014 B1 7/2001 Clearman et al.
6,270,278 B1 8/2001 Mauro
6,276,004 B1 8/2001 Bertrand et al.
6,283,447 B1 9/2001 Fleet
6,286,764 B1 9/2001 Garvey et al.
D449,673 S 10/2001 Kollmann et al.
D450,370 S 11/2001 Wales et al.
D450,805 S 11/2001 Lindholm et al.
D450,806 S 11/2001 Lindholm et al.
D450,807 S 11/2001 Lindholm et al.
D451,169 S 11/2001 Lindholm et al.
D451,170 S 11/2001 Lindholm et al.
D451,171 S 11/2001 Lindholm et al.
D451,172 S 11/2001 Lindholm et al.
6,321,777 B1 11/2001 Wu
D451,583 S 12/2001 Lindholm et al.
D451,980 S 12/2001 Lindholm et al.
D452,553 S 12/2001 Lindholm et al.
D452,725 S 1/2002 Lindholm et al.
D452,897 S 1/2002 Gillette et al.
D453,369 S 2/2002 Lobermeier
D453,370 S 2/2002 Lindholm et al.
D453,551 S 2/2002 Lindholm et al.
6,349,735 B2 2/2002 Gul
D454,617 S 3/2002 Curbbun et al.
D454,938 S 3/2002 Lord
6,375,342 B1 4/2002 Koren et al.
D457,937 S 5/2002 Lindholm et al.
6,382,531 B1 5/2002 Tracy
D458,348 S 6/2002 Mullenmeister
6,412,711 B1 7/2002 Fan
D461,224 S 8/2002 Lobermeier
D461,878 S 8/2002 Green et al.
6,450,425 B1 9/2002 Chen
6,454,186 B2 * 9/2002 Haverstraw et al. ..... 239/443
6,464,265 B1 10/2002 Mikol
D465,552 S 11/2002 Tse
D465,553 S 11/2002 Singtoroj
6,484,952 B2 11/2002 Koren
D468,800 S 1/2003 Tse
D469,165 S 1/2003 Lim
6,502,796 B1 1/2003 Wales
D470,219 S 2/2003 Schweitzer
6,516,070 B2 2/2003 Macey
D471,253 S 3/2003 Tse
D471,953 S 3/2003 Colligan et al.
6,533,194 B2 3/2003 Marsh et al.
6,537,455 B2 3/2003 Farley
D472,958 S 4/2003 Ouyoung
6,550,697 B2 4/2003 Lai
6,607,148 B1 8/2003 Marsh et al.
6,611,971 B1 9/2003 Antoniello et al.
6,637,676 B2 10/2003 Zieger et al.
6,641,057 B2 11/2003 Thomas et al.
D483,837 S 12/2003 Fan
6,659,117 B2 12/2003 Gilmore
6,659,372 B2 12/2003 Marsh et al.
D485,887 S 1/2004 Luettgen et al.
D486,888 S 2/2004 Lobermeier
6,691,338 B2 2/2004 Zieger
D487,301 S 3/2004 Haug et al.
D487,498 S 3/2004 Blomstrom
6,701,953 B2 3/2004 Agosta
D489,798 S 5/2004 Hunt
D490,498 S 5/2004 Golichowski
6,736,336 B2 5/2004 Wong
6,739,523 B2 5/2004 Haverstraw et al.
6,739,527 B1 5/2004 Chung
D492,004 S 6/2004 Haug et al.
D492,007 S 6/2004 Kollmann et al.
6,742,725 B1 6/2004 Fan
D493,208 S 7/2004 Lin
D493,864 S 8/2004 Haug et al.
D494,655 S 8/2004 Lin
D494,661 S 8/2004 Zieger et al.
D495,027 S 8/2004 Mazzola
6,776,357 B1 8/2004 Naito
D496,987 S 10/2004 Glunk
D497,974 S 11/2004 Haug et al.
D498,514 S 11/2004 Haug et al.
D500,121 S 12/2004 Blomstrom

| | | | |
|---|---|---|---|
| D500,549 | S | 1/2005 | Blomstrom |
| D501,242 | S | 1/2005 | Blomstrom |
| D502,760 | S | 3/2005 | Ziegler et al. |
| D502,761 | S | 3/2005 | Ziegler et al. |
| D503,211 | S | 3/2005 | Lin |
| D503,774 | S | 4/2005 | Zieger |
| D503,775 | S | 4/2005 | Zieger |
| D503,966 | S | 4/2005 | Zieger |
| 6,899,292 | B2 | 5/2005 | Titinet |
| D506,243 | S | 6/2005 | Wu |
| D507,037 | S | 7/2005 | Wu |
| 6,935,581 | B2 | 8/2005 | Titinet |
| D509,280 | S | 9/2005 | Bailey et al. |
| D509,563 | S | 9/2005 | Bailey et al. |
| D510,123 | S | 9/2005 | Tsai |
| D512,119 | S | 11/2005 | Haug et al. |
| 6,981,661 | B1 | 1/2006 | Chen |
| 7,004,409 | B2 | 2/2006 | Okubo |
| D520,109 | S | 5/2006 | Wu |
| 7,048,210 | B2 | 5/2006 | Clark |
| 7,055,767 | B1 | 6/2006 | Ko |
| 7,070,125 | B2 | 7/2006 | Williams et al. |
| D527,440 | S | 8/2006 | Macan |
| D528,631 | S | 9/2006 | Gillette et al. |
| 7,100,845 | B1 | 9/2006 | Hsieh |
| D530,389 | S | 10/2006 | Genslak et al. |
| D533,253 | S | 12/2006 | Luettgen et al. |
| D534,239 | S | 12/2006 | Dingler et al. |
| D536,060 | S | 1/2007 | Sadler |
| 7,156,325 | B1 | 1/2007 | Chen |
| D538,391 | S | 3/2007 | Mazzola |
| D540,424 | S | 4/2007 | Kirar |
| D540,425 | S | 4/2007 | Endo et al. |
| D540,427 | S | 4/2007 | Bouroullec et al. |
| D542,391 | S | 5/2007 | Gilbert |
| D542,393 | S | 5/2007 | Haug et al. |
| 7,229,031 | B2 | 6/2007 | Schmidt |
| 7,243,863 | B2 | 7/2007 | Glunk |
| D552,713 | S | 10/2007 | Rexach |
| 7,278,591 | B2 | 10/2007 | Clearman et al. |
| D556,295 | S | 11/2007 | Genord et al. |
| D557,763 | S | 12/2007 | Schonherr et al. |
| D557,764 | S | 12/2007 | Schonherr et al. |
| D557,765 | S | 12/2007 | Schonherr et al. |
| D558,301 | S | 12/2007 | Hoernig |
| 7,303,151 | B2 | 12/2007 | Wu |
| D559,357 | S | 1/2008 | Wang et al. |
| D559,945 | S | 1/2008 | Patterson et al. |
| D562,937 | S | 2/2008 | Schonherr et al. |
| D562,938 | S | 2/2008 | Blessing |
| D562,941 | S | 2/2008 | Pan |
| 7,331,536 | B1 | 2/2008 | Zhen et al. |
| 7,347,388 | B2 | 3/2008 | Chung |
| D565,699 | S | 4/2008 | Berberet |
| D566,228 | S | 4/2008 | Neagoe |
| D566,229 | S | 4/2008 | Rexach |
| D567,328 | S | 4/2008 | Spangler et al. |
| 7,360,723 | B2 | 4/2008 | Lev |
| 7,364,097 | B2 | 4/2008 | Okuma |
| 7,374,112 | B1 | 5/2008 | Bulan et al. |
| 7,384,007 | B2 | 6/2008 | Ho |
| D577,099 | S | 9/2008 | Leber |
| D577,793 | S | 9/2008 | Leber |
| D580,012 | S | 11/2008 | Quinn et al. |
| D580,513 | S | 11/2008 | Quinn et al. |
| D581,014 | S | 11/2008 | Quinn et al. |
| 2003/0062426 | A1 | 4/2003 | Gregory et al. |
| 2004/0074993 | A1 | 4/2004 | Thomas et al. |
| 2004/0118949 | A1 | 6/2004 | Marks |
| 2004/0195381 | A1 | 10/2004 | Luettgen et al. |
| 2005/0001072 | A1 | 1/2005 | Bolus et al. |
| 2005/0061896 | A1 | 3/2005 | Luettgen et al. |
| 2005/0082824 | A1 | 4/2005 | Luettgen et al. |
| 2005/0284967 | A1 | 12/2005 | Korb |
| 2006/0016913 | A1 | 1/2006 | Williams et al. |
| 2006/0060678 | A1 | 3/2006 | Mazzola |
| 2006/0102747 | A1 | 5/2006 | Ho |
| 2006/0157590 | A1 | 7/2006 | Clearman et al. |
| 2006/0163391 | A1 | 7/2006 | Schorn |
| 2006/0219822 | A1 | 10/2006 | Miller et al. |
| 2006/0283986 | A1 | 12/2006 | Chung |
| 2007/0040054 | A1 | 2/2007 | Farzan |
| 2007/0200013 | A1 | 8/2007 | Hsiao |
| 2007/0246577 | A1 | 10/2007 | Leber |
| 2007/0272770 | A1 | 11/2007 | Leber et al. |
| 2008/0073449 | A1 | 3/2008 | Haynes et al. |
| 2008/0083844 | A1 | 4/2008 | Leber et al. |
| 2008/0111004 | A1 | 5/2008 | Huffman |
| 2008/0223957 | A1 | 9/2008 | Schorn |
| 2008/0272203 | A1 | 11/2008 | Leber |
| 2008/0272591 | A1 | 11/2008 | Leber |

FOREIGN PATENT DOCUMENTS

| | | |
|---|---|---|
| CH | 234284 | 3/1963 |
| DE | 352813 | 5/1922 |
| DE | 848627 | 9/1952 |
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 3706320 | 3/1988 |
| DE | 8804236 | 6/1988 |
| DE | 4034695 | 5/1991 |
| DE | 19608085 | 9/1996 |
| EP | 0167063 | 6/1985 |
| EP | 0478999 | 4/1992 |
| EP | 0514753 | 11/1992 |
| EP | 0617644 | 10/1994 |
| EP | 0683354 | 11/1995 |
| EP | 0687851 | 12/1995 |
| EP | 0695907 | 2/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| FR | 538538 | 6/1922 |
| FR | 873808 | 7/1942 |
| FR | 1039750 | 10/1953 |
| FR | 1098836 | 8/1955 |
| FR | 2596492 | 10/1987 |
| FR | 2695452 | 3/1994 |
| GB | 10086 | 4/1894 |
| GB | 3314 | 12/1914 |
| GB | 129812 | 7/1919 |
| GB | 204600 | 10/1923 |
| GB | 634483 | 3/1950 |
| GB | 971866 | 10/1964 |
| GB | 1111126 | 4/1968 |
| GB | 2066074 | 1/1980 |
| GB | 2066704 | 7/1981 |
| GB | 2068778 | 8/1981 |
| GB | 2121319 | 12/1983 |
| GB | 2155984 | 10/1985 |
| GB | 2156932 A | 10/1985 |
| GB | 2199771 | 7/1988 |
| GB | 2298595 | 11/1996 |
| IT | 327400 | 7/1935 |
| IT | 350359 | 7/1937 |
| IT | 563459 | 5/1957 |
| JP | S63-181459 | 11/1988 |
| JP | H2-78660 | 6/1990 |
| JP | 4062238 | 2/1992 |

| | | |
|---|---|---|
| JP | 4146708 | 5/1992 |
| NE | 8902957 | 6/1991 |
| WO | WO93/12894 | 7/1993 |
| WO | WO93/25839 | 12/1993 |
| WO | WO96/00617 | 1/1996 |
| WO | WO98/30336 | 7/1998 |
| WO | WO00/10720 | 3/2000 |

OTHER PUBLICATIONS

Color Copy, Labeled 1B, Gemlo, available at least as early as Dec. 2, 1998.
Restriction Requirement, U.S. Appl. No. 10/732,385, 5 pages, Jul. 20, 2004.
Amendment and Response to Restriction Requirement, U.S. Appl. No. 10/732,385, 12 pages, Oct. 20, 2004.
Non-Final Office Action, U.S. Appl. No. 10/732,385, 6 pages, Jan. 12, 2005.
Amendment and Response to Non-Final Office Action, U.S. Appl. No. 10/732,385, 12 pages, Jul. 12, 2005.
Non-Final Office Action, U.S. Appl. No. 10/732,385, 22 pages, Oct. 3, 2005.
Amendment and Response to Non-Final Office Action, U.S. Appl. No. 10/732,385, 13 pages, Mar. 3, 2006.
Notice of Allowance, U.S. Appl. No. 10/732,385, 7 pages, May 31, 2006.

* cited by examiner

DRENCHING SHOWER HEAD

CROSS REFERENCE TO RELATED APPLICATION

This non-provisional application claims benefit under 35 U.S.C. §119(e) to provisional application No. 60/606,579, filed Sep. 1, 2004, entitled "Drenching Shower Head," which is hereby incorporated by reference in its entirety.

BACKGROUND OF THE INVENTION

1. Technical Field

The present invention relates generally to showerheads, and more specifically to a showerhead having pulsating spray and drenching modes of operation.

2. Background Art

Generally, shower heads are used to direct water from the home water supply onto a user for personal hygiene purposes. Showers are an alternative to bathing in a bath tub.

In the past, bathing was the overwhelmingly popular choice for personal cleansing. However, in recent years showers have become increasingly popular for several reasons. First, showers generally take less time than baths. Second, showers generally use significantly less water than baths. Third, shower stalls and bath tubs with shower heads are typically easier to maintain. For example, over time, showers tend to cause less soap scum build-up.

With the increase in popularity of showers has come an increase in shower head designs and shower head manufacturers. Many shower heads, for example, may emit pulsating streams of water in a so-called "massage" mode. Yet others are referred to as "drenching" showerheads, since they have relatively large faceplates and emit water in a steady, soft spray pattern.

However, over time, several shortcomings with existing shower head designs have been identified. For example, many shower heads fail to provide a sufficiently powerful, directed, or pleasing massage. Yet other shower heads have a relatively small face, yielding a small spray pattern.

Accordingly, there is a need in the art for an improved shower head design.

SUMMARY OF THE INVENTION

Generally, one embodiment of the present invention takes the form of a showerhead having both pulsating spray and drenching operational modes. Water may flow through an inlet, into a pivot ball, through a pivot ball mount and into a housing, be directed into a side passage formed through the housing, into a flow hole defined in a backplate cap (channeling water from a rear to a front of the backplate cap), be received in one of multiple flow channels defined by the combination of backplate cap front and backplate rear, through a turbine nozzle or internal nozzle into further flow channels defined by the backplate front and frontplate rear, and ultimately through one or more nozzles formed on the front of the frontplate.

Several flow channels described herein may house a turbine. Water flowing into a flow channel housing a turbine typically impacts one or more blades of the turbine, causing the turbine to rotate or spin in the channel. Each turbine generally has a shield or flange extending radially inwardly from the turbine's sidewall. As the turbine spins, this shield temporarily blocks flow holes defined in the appropriate flow channel. such blockage momentarily interrupts water flow to the nozzles ultimate fed by the channel, creating a pulsating spray mode from those nozzles.

Some nozzles may be received in a nozzle web, while others are not. The nozzle web typically takes the forms of a series of soft nozzle sheaths interconnected by soft web members. The nozzle sheaths yield a soft external texture to those nozzles encased therein.

The nozzle configuration, channel configurations, and turbine rotation speeds generally create a relatively soft, intermittent water spray. This spray emulates the speed, impact, and appearance of natural rainfall.

Another embodiment of the present invention may take the form of an engine for directing a water flow, including an inlet, a first flow channel fluidly connected to the inlet, a second flow channel fluidly connected to the inlet, a first flow interruptor operatively connected to the first flow channel, and a second flow interruptor operatively connected to the second flow channel.

Yet another embodiment of the present invention may take the form of a shower head, including an inlet, a flow channel fluidly connected to the inlet, at least one aperture defined in the flow channel, a flow interruptor positioned within the flow channel, and a lifting device operatively connected to the flow interruptor and operative to assume at least a first and second operational mode, wherein the flow interruptor at least intermittently blocks a water flow from passing through the at least one aperture when the lifting device assumes the first operational mode, and the flow interrupter does not block the water flow from passing through the at least one aperture when the lifting device assumes the second operational mode.

These and other advantages and improvements of the present invention will become apparent to those of ordinary skill in the art upon reading this document in its entirety.

DETAILED DESCRIPTION

1. Overview

Figure 1:
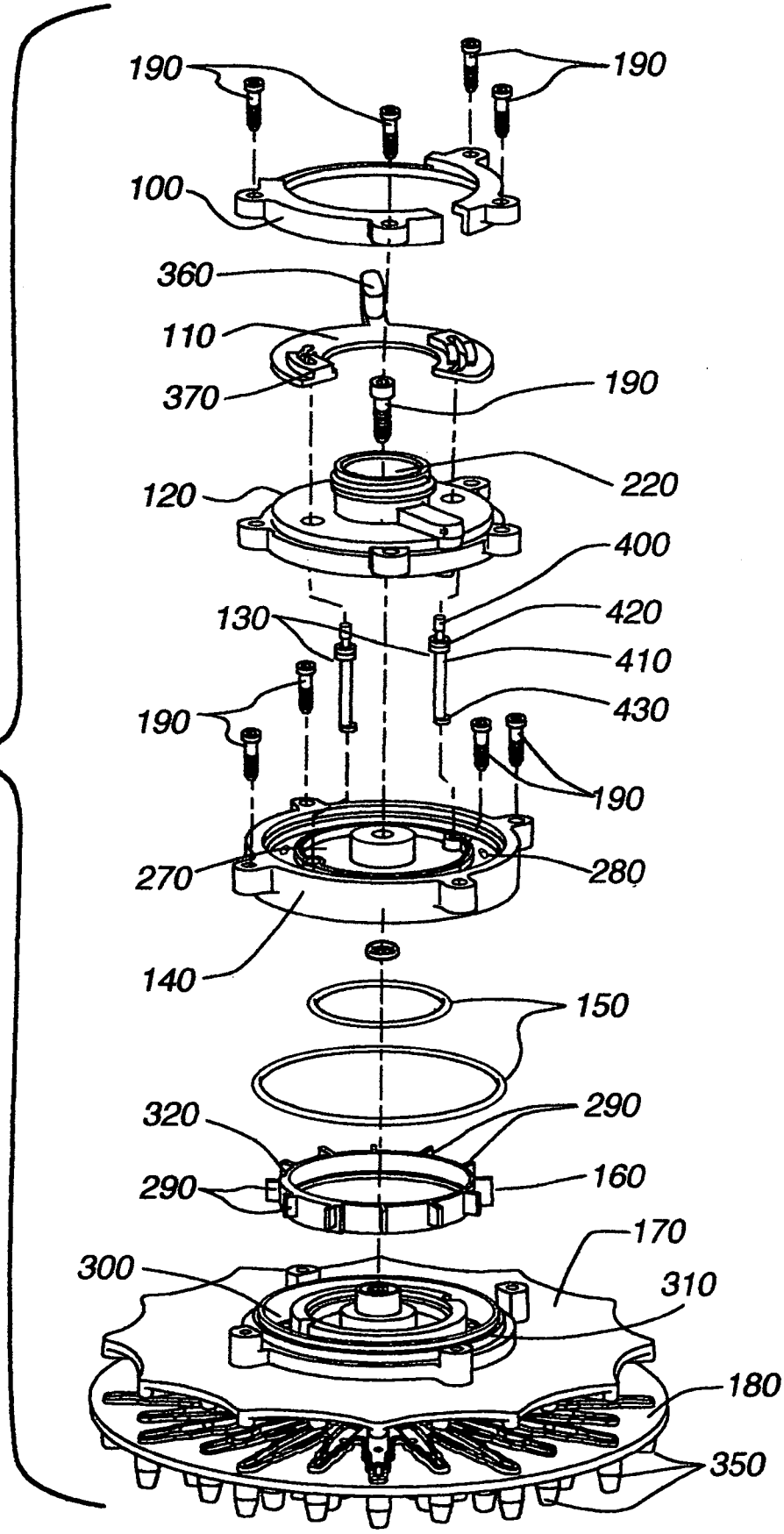
FIG. 1 depicts an exploded view of an engine assembly in accordance with a first embodiment of the invention.

Generally, one embodiment of the present invention takes the form of a showerhead having at least two modes of operation namely, a drenching mode, and a rainfall (or pulsating) mode. When operating in drenching mode, water emanates from all nozzles of the showerhead in a relatively continuous fashion (as a specific set of nozzles). It should be noted that "continuous," as used herein and in this context, may refer to both a regular streaming of water droplets from a nozzle and a steady discharge. By contrast and when operating in rainfall mode, water flow through the nozzles is temporarily interrupted, thus causing intermittent water discharge. This intermittent flow pulses water through the nozzles while backpressure within the showerhead increases the discharge force. Together, the increased pressure and intermittent flow may create a massaging effect when a user is impacted by the water.

Typically, a turbine is used to interrupt water flow and create the massaging effect just described. The blades of the turbine prevent water from flowing through nozzles by blocking the nozzle interior as the blades pass over the nozzles. Water pressure turns the turbine, ensuring each nozzle is blocked only momentarily. A turbine is one example of a flow interruptor; alternative flow interrupters, as known to those of ordinary skill in the art, may be used in alternative embodiments of the invention described herein.

In one embodiment of the present invention, a lever changes the showerhead's operational mode. Moving the lever (or, in alternate embodiments, pressing a button, turning a knob or screw, or so forth) raises or lowers a pair of pins, which in turn raises or lowers the turbine. When the turbine is raised, the blades do not block water flow through the nozzles and the showerhead operates in drenching mode. When the turbine is lowered, the blades may intermittently block the nozzles and the showerhead operates in pulsed mode.

In another embodiment of the present invention, the operational mode of the showerhead may be varied by turning, rotating, or otherwise manipulating a mode selector, such as a mode ring or knob. The mode ring may encircle the showerhead. Rotating the mode ring may divert water from a first flow channel to a second flow channel, or alternatively may divert water to flow into both the first and second flow channels. It should be noted that that more than two flow channels may exist, and that a variety of combinations of water flow through multiple flow channels is embraced by the embodiment.

In this embodiment, a first turbine may be placed in the first flow channel and a second turbine in the second flow channel. The turbines may be of different diameters and/or sizes, and thus may rotate at different speeds. The first and second turbines may generally act to intermittently block water flow through one or more sets of nozzles. Each set of nozzles is generally associated with either the first or second flow channels; certain nozzle sets may be associated with both flow channels (or with other flow channels mentioned above). Further, one or both turbines may optionally be raised or lowered as described above to eliminate or permit this intermittent blockage of nozzles.

2. Water Flow

FIG. 1 depicts an exploded view of a showerhead interior assembly. The assembly of the present embodiment generally consists of at least a retainer plate 100, actuator plate 110, inlet plate 120, one or more control rods 130, turbine ring 140, seal 150, turbine 160, channel plate 170, and nozzle plate 180. Multiple screws, bolts, or fasteners 190 may be used to attach the various elements to one another.

Figure 2A:
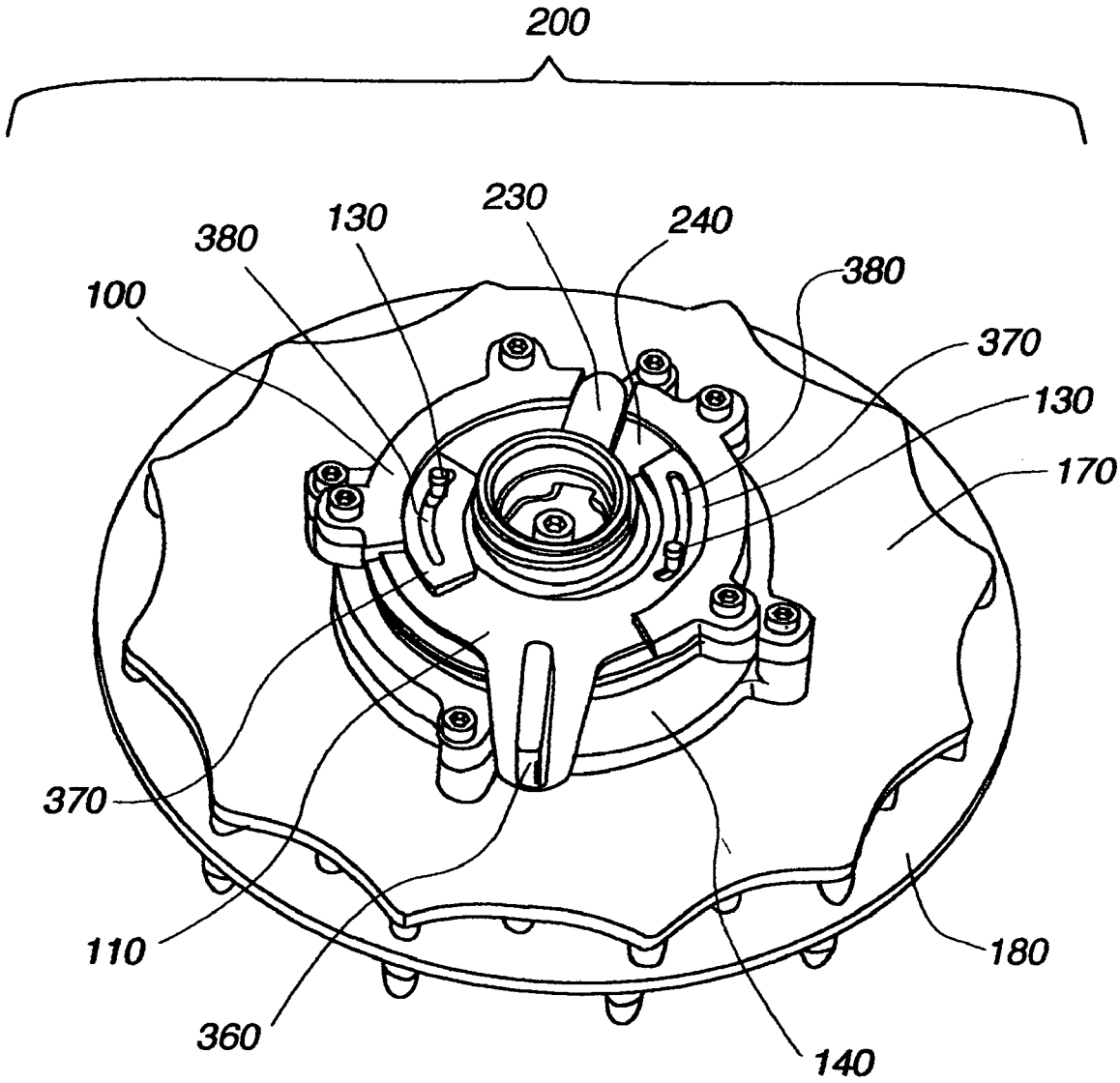
FIG. 2A depicts an isometric view of the engine assembly of FIG. 1.
Figure 2B:
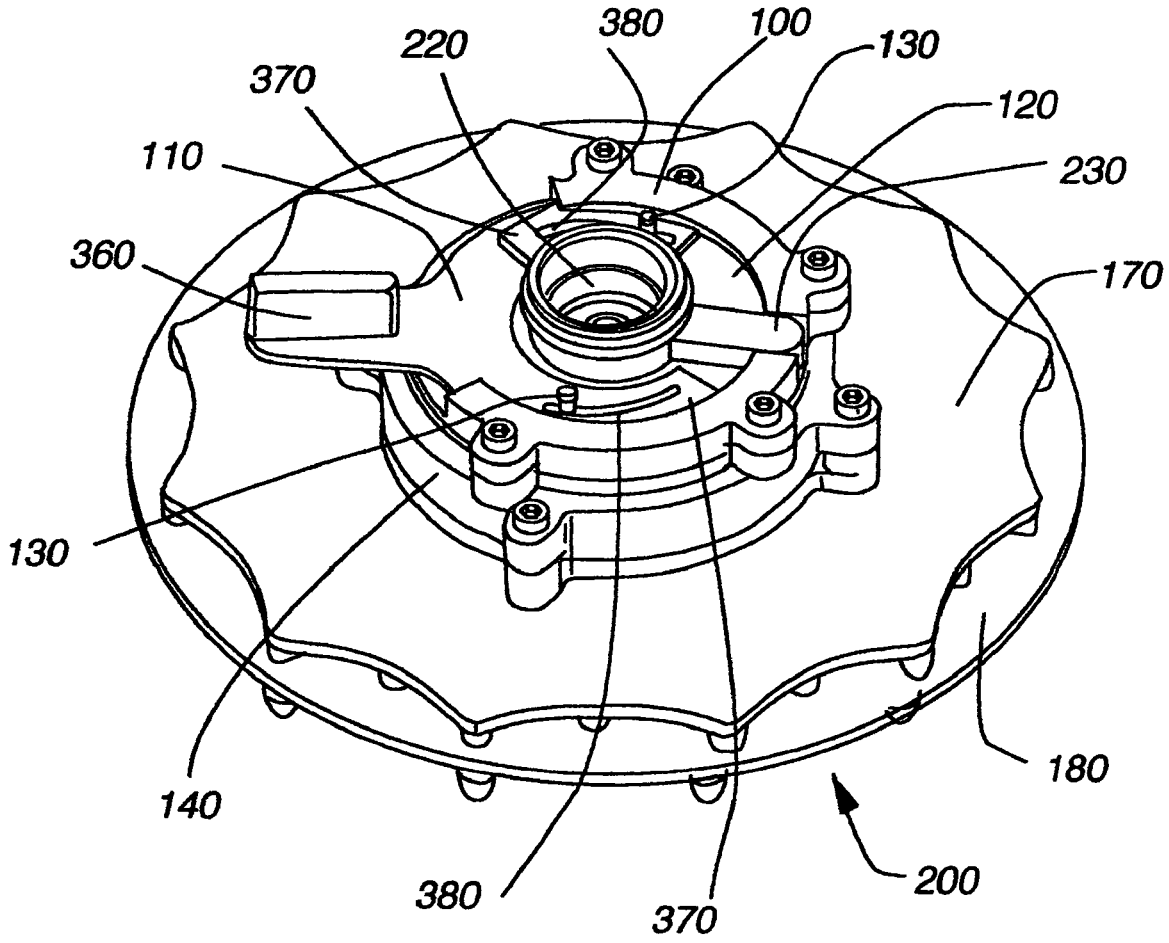
FIG. 2B depicts a second isometric view of engine assembly of FIG. 1.

Turning to FIGS. 2A and 2B, the showerhead interior assembly ("engine") 200 is shown in an assembled state. The engine 200 is typically placed within a housing 210 (one exemplary housing is shown to best effect in FIGS. 33-36). The housing shape may vary in alternative embodiments.

The inlet 220 generally extends beyond the housing 210 and is threaded to be received onto (or into) a shower pipe, flexible arm, hose connector, arm assembly, or other device for conveying water to the showerhead. Water flows into and through the inlet 220 from the water source, along the inlet passage 230 connected to the inlet, and through a hole defined in the base of the inlet passage. This hole conveys water from a top side of the inlet plate 240 (on which the inlet passage is at least partially defined) to the base side of the inlet plate 240 and, consequently, the top side of the turbine ring 140.

Referring to FIG. 1, the turbine ring 140 includes an annular channel 270 formed inside ring's circumference, on the top side. Disposed within the annular channel are one or more jets 280. In the present embodiment, five jets are used. Each jet extends through the surface of the turbine ring 140, creating a path for water to flow from the turbine ring top side to the turbine ring base side. Further, the jets 280 are angled in such a manner to impart a counterclockwise flow to water passing through them. (It should be noted alternate embodiments may impart a clockwise flow to water passing through the jets.) The jets may also be shrouded to increase flow speed. Alternative embodiments may vary the number of jets 280 employed.

Figure 3:
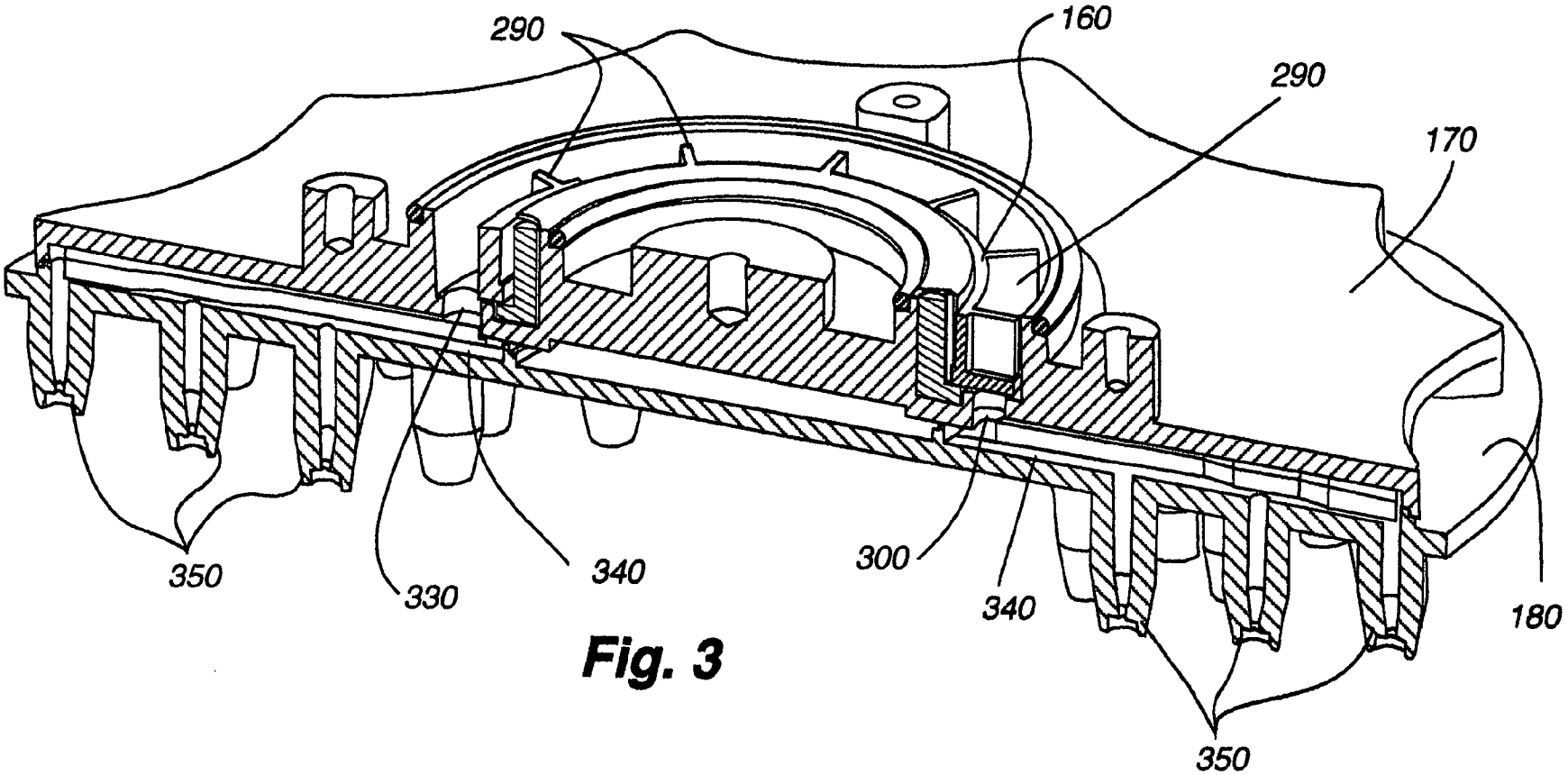
FIG. 3 depicts a cross-sectional view of a nozzle plate, channel plate, and turbine for use with the engine assembly of FIG. 1.

As water passes through the jets 280, it impacts one or more blades 290 of the turbine 160 situated in a turbine cavity 300 (as shown in FIG. 3) formed by the base side of the turbine ring 140 and a turbine receptacle 310 formed on the top side of the channel plate 170. The turbine is mounted within this cavity and may rotate freely therein. One or more seals 150 may be also disposed within the cavity. In the present embodiment, a first seal surrounds the exterior of the turbine 160 and a second is disposed within the turbine. It should be noted neither seal restricts the turbine's rotational capability in any way. In other embodiments, the turbine ring 140 and channel plate 170 may be welded, heat sealed, adhesively bonded, or otherwise affixed to one another with a watertight connection and the seals 150 may be omitted.

Figure 17A:
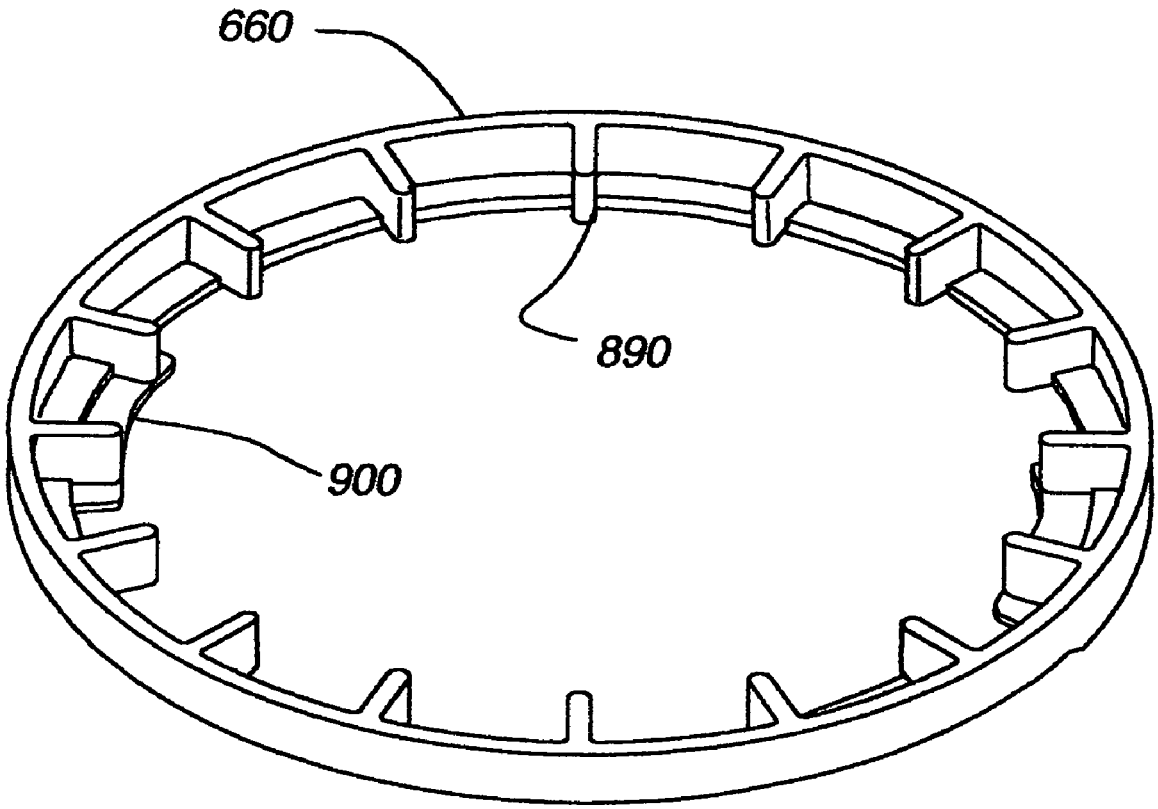
FIG. 17A depicts a perspective view of the rear of a first turbine for use in the showerhead of FIG. 6.
Figure 17B:
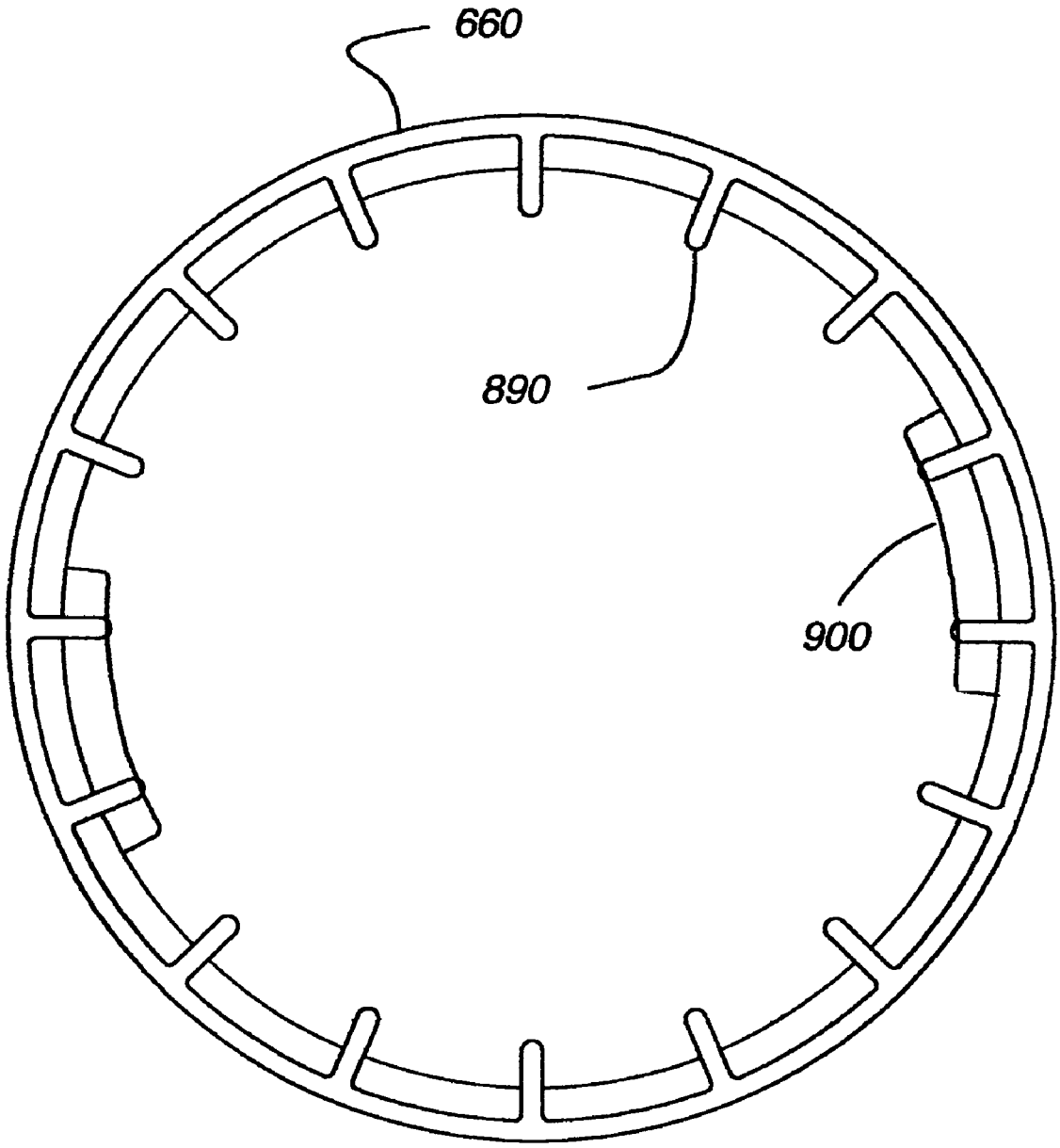
FIG. 17B depicts a plan view of the top of the turbine of FIG. 17B.
Figure 17C:
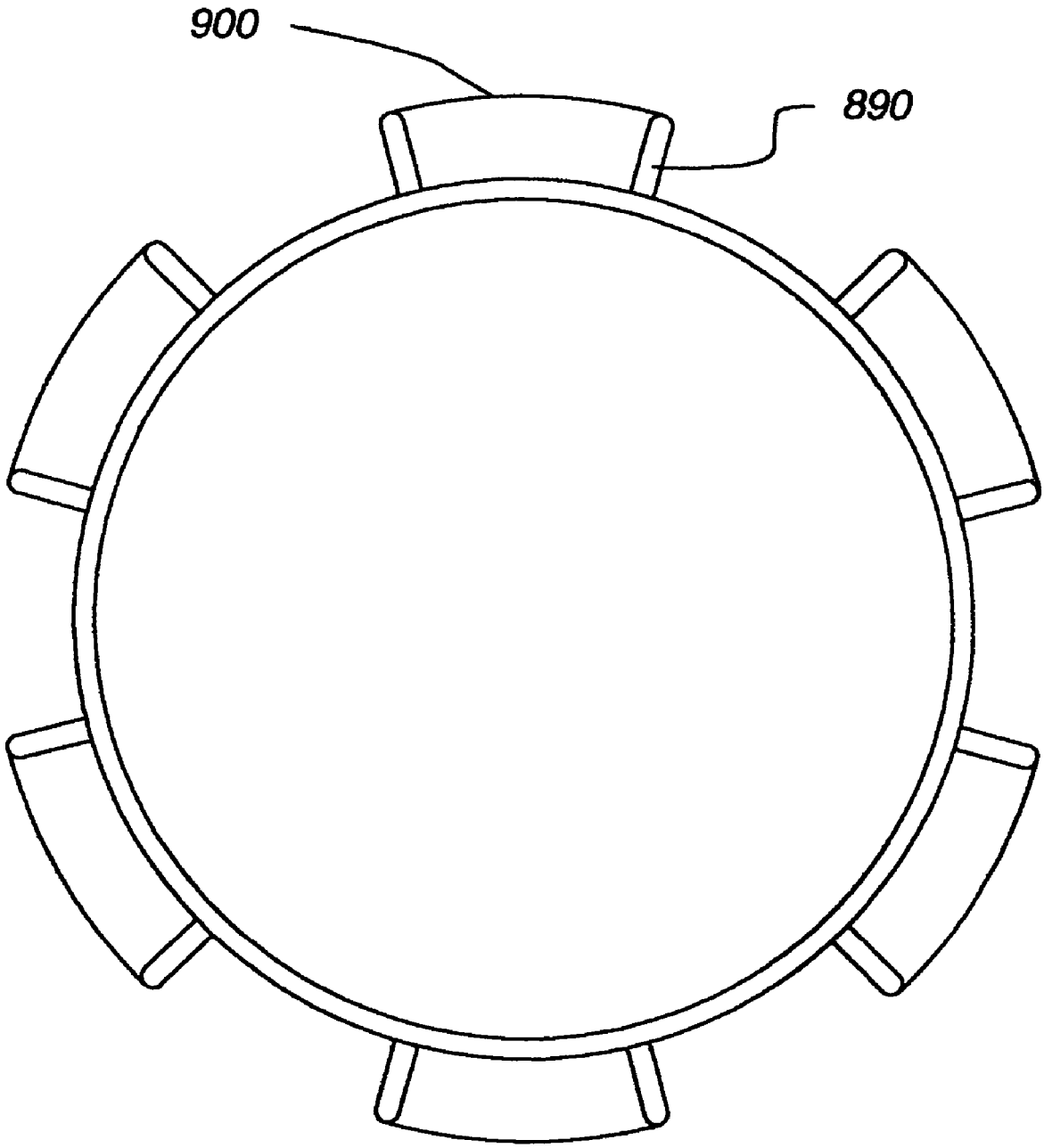
FIG. 17C depicts an exemplary turbine that may be used in various embodiments of the present invention.

Water impacting the turbine blades 290 imparts rotational motion to the turbine 160. In the present embodiment, the turbine rotates in a counterclockwise fashion. As shown in FIG. 1, the turbine generally takes the form of a hollow, open-ended cylinder with vanes 290 projecting outwardly from its sidewall. Some of these vanes are formed on one or more relatively thin blocking segments, or shield 320, extending perpendicularly to the vane body and from the turbine base. (One exemplary embodiment of a turbine having a shield 320 is shown in FIG. 17C; alternative embodiments may use differently-shaped shields.) The shield 320 may extend along a segment of the turbine encompassing multiple vanes, as shown in FIG. 17B. As the turbine spins, the one or more blocking segments 320 pass sequentially over nozzle flow apertures 330 formed in the channel plate 170 (as shown in FIG. 3). Each nozzle flow aperture passes through the channel plate 170, permitting water to flow from the top of the channel plate to the bottom.

When a shield 320 covers or obstructs a nozzle flow aperture 330, water is blocked from entering the flow path. Accordingly, water cannot enter the nozzle channels 340 (discussed below) and pass through the nozzles 350. Thus, for the period of time a nozzle channel is covered by a blocking segment 310, water does not emanate from the nozzles fluidly connected to the nozzle channel. Since the turbine 160 generally spins, each nozzle channel is only momentarily blocked. This creates the pulsating effect discussed above.

Alternately and as discussed in more detail below, the turbine 60 may be raised into the cavity, such that a void space exists between the blocking segments and flow channels. When this occurs, the turbine continues to spin, but water may flow around the side of the turbine and into the nozzle flow apertures 330 via the void space. Thus, the momentary blocking effect of the turbine 100 may be negated. Thus, while the turbine is raised, turbine motion does not impair water flow through the nozzles and the drenching mode is active. In some embodiments, turbine motion may cease (i.e., the turbine may stall) when raised.

Referring to FIG. 3 and continuing the description of the water flow path through the showerhead, water moves from the nozzle flow apertures 330 into one or more nozzle channels 340. In the present embodiment, and as shown in FIG. 3, multiple nozzles 350 may be associated with a single nozzle channel. Similarly, one or more nozzle channels may be associated with a single nozzle flow aperture. Each nozzle channel 340 is formed by a mating pair of raised surfaces. A first raised surface is formed on the base side of the channel plate 170, and a matching raised surface is formed on the top side of the nozzle plate 180 (see, e.g., FIG. 1).

As also shown in FIG. 3, the blocking segment 320 of each turbine 160 occasionally restricts water flow through the nozzle flow aperture 330 and thus into the nozzle flow channels 340. Typically, when one nozzle flow aperture is shut off in this fashion, the nozzle flow aperture diametrically opposed is open. Thus, when the showerhead operates in rainfall mode, water flow may seem to alternate between nozzles 350 or move in a rotating pattern. It should be noted that the blocking segments 320 may be configured such that diametrically opposed nozzle flow apertures 330 are each blocked or each open in alternative embodiments. Alternate embodiments may employ a turbine 160 having a varying number of blocking segments or shields 320, ranging from a single shield to two, three, four, or more.

3. Operational Modes

As previously mentioned, the present embodiment generally operates in either a rainfall mode or drenching mode. In rainfall mode, water flow through the nozzles 350 is intermittent, creating a pulsating effect similar to rain. In drenching mode, water flow through the nozzles is substantially constant (although such flow may break into individual droplets when exiting the nozzles).

In the present embodiment, the operational mode may be changed from drenching to rainfall, or vice versa, by rotating a knob 360 projecting outwardly from the showerhead. The knob is affixed to or formed integrally with the actuator plate 110, as shown in the exploded view of FIG. 1.

The actuator plate 110 is held between the retainer plate 100 and the inlet plate 120 by screws, bolts, or other fasteners 190. Generally speaking, the actuator plate is firmly secured, but may still rotate about the inlet 220. The center of the actuator plate is hollow to accommodate the inlet.

As shown in FIGS. 2A and 2B, a pair of control ramps 370 are formed on the top side of the actuator plate. One control rod 130 passes at least partially through an arcuate slot 380 formed in the middle of each control ramp. Each control rod is formed with a head portion 390, a neck 400, and a body 410 (as shown in FIG. 1). The body may include a stop ring 420, such as a gasket or other seal, at the portion abutting the neck. Typically, the neck is smaller in diameter than any of the head, body, or stop ring. When the engine 200 is fully assembled, the head 390 of each control rod 130 projects at least slightly above the surface of the respective control ramp 370. The control rods 130 extend through the inlet plate 120 and turbine ring 140 to the base of the turbine (not shown). Projections or flanges 430 (shown in FIG. 1) extending outwardly from the base of the control rods 130 seat beneath the lower surface of the turbine. This assembly, along with the knob, may be referred to as a "lifting device."

As the knob 360 rotates, the actuator plate 110 also rotates. The plate's rotational motion forces the control rods 130 along the control ramps 370 in either an up or down fashion, depending on the direction of rotation. In other words, the actuator plate's rotational motion is converted into a linear motion of the control rods by means of the control ramps. As the control rods rise, the flanges 430 engage the turbine base, raising the turbine 160. Similarly, as the control rods 130 lower, the turbine is lowered.

Figure 4:
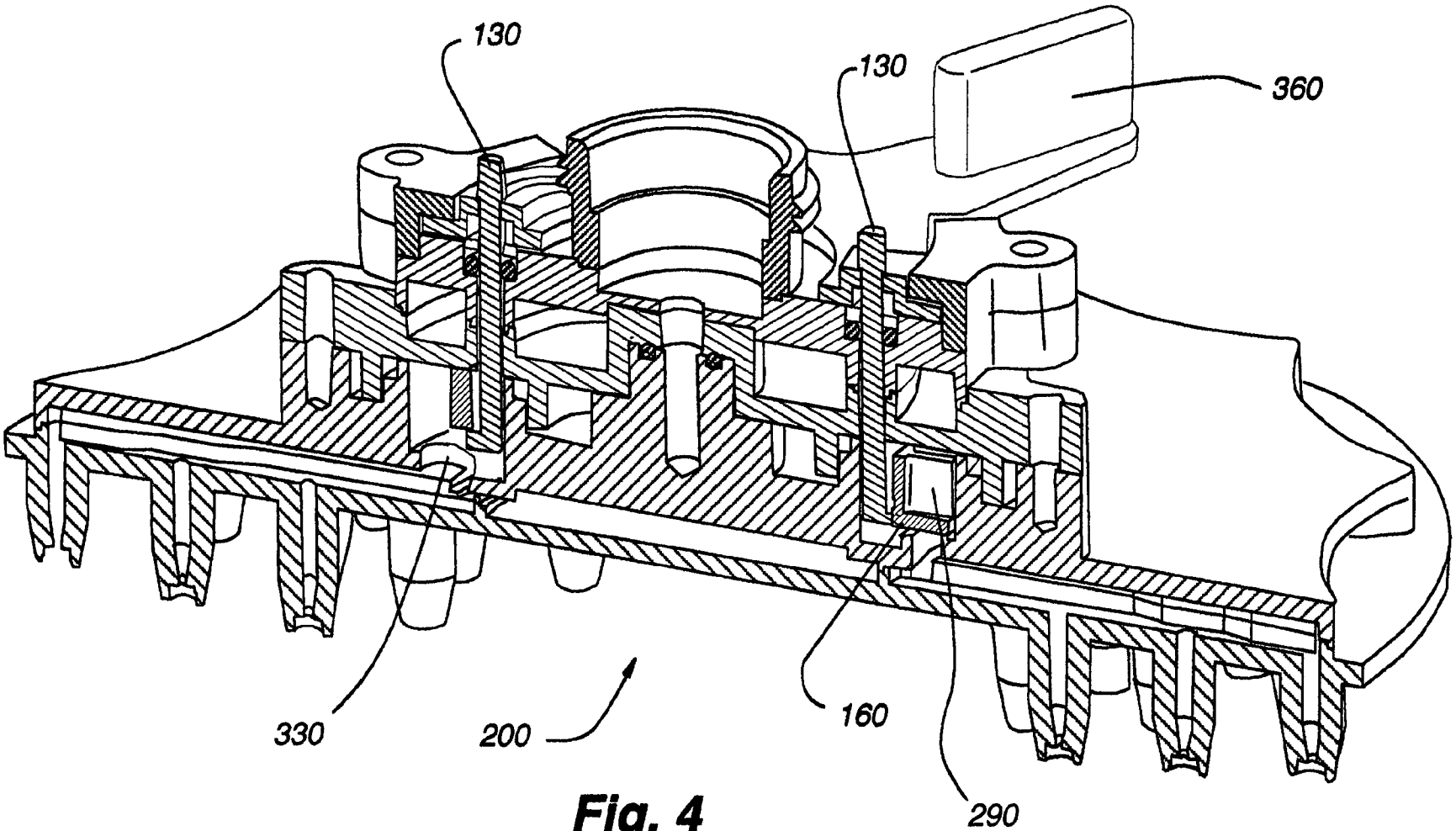
FIG. 4 depicts a cross-sectional view of the engine assembly of FIG. 3 in a non-pulsating configuration.
Figure 5A:
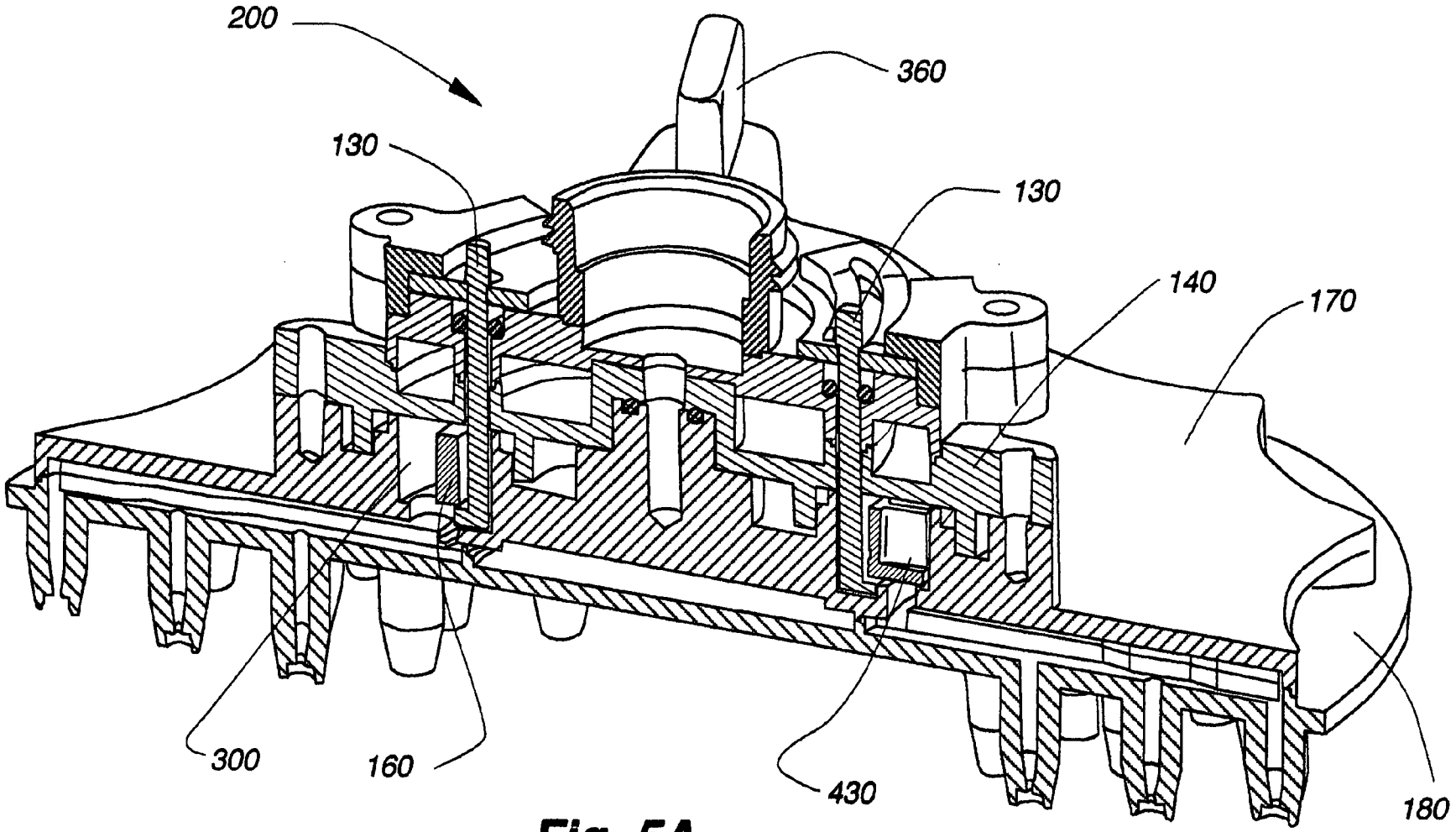
FIG. 5A depicts a cross-sectional view of the engine assembly of FIG. 3 in a pulsating configuration.

When the knob 360 is turned clockwise in the present invention, the control rods 130 and turbine 160 are raised and the engine 200 is in drenching mode. By contrast, when the knob is turned counterclockwise, the control rods and turbine lower, placing the engine in pulsating or rainfall mode. FIG. 4 depicts a cross-sectional view of the engine 200 with the knob 360 rotated clockwise, the control rods 130 and turbine 160 raised, and the engine in drenching mode. Similarly, FIG. 5A depicts a cross-sectional view of the engine 200 with the knob 360 rotated counterclockwise, the control rods 130 lowered and turbine 160 engaging the cavity 300 base, and the engine in pulsating mode. As shown in FIG. 5A, the base of the control rods and the flanges 430, when lowered, generally seat in a depression formed in the channel plate 170 so as not to interfere with the turbine's rotation. Alternative embodiments may vary the direction in which the knob is moved to raise or seat the turbine (clockwise vs. counterclockwise, in or out, up or down, etc.).

Referring to FIG. 4, when the embodiment operates in drenching mode, the turbine 160 is raised from the turbine cavity base. Water may flow about the turbine sides and freely into nozzle channels 330 defined in the turbine cavity base. Since the turbine is raised, water typically does not impact the blades 290 and the turbine stalls. (In some embodiments, although the turbine 160 is raised, water flowing into the turbine ring 140 through the jets 280 may nonetheless impact the turbine blades and cause the turbine to spin.) Further, since the turbine shield 320 is raised from the base of the cavity 300, the shield 320 does not prevent water from entering the nozzle channels defined in the base.

When the embodiment operates in pulsating mode, the turbine 160 is lowered until at least the shield 320 contacts (or nearly contacts) the base of the turbine ring. In this mode, as previously mentioned, the rotational motion of the turbine causes the turbine blocking element or shield to momentarily preclude water flow from the turbine cavity 300 through the nozzle channels 340, and ultimately to the nozzles 350. This interruption occurs sequentially between groups of nozzles as the shield(s) rotate(s) over nozzle channels. Thus, a user of the present embodiment perceives the flow interruption as a pulsating spray exiting the showerhead.

Generally, the inlet 220 and inlet passage 230 are formed contiguously with the inlet plate 120. In some embodiments, the inlet and/or inlet passage may be separately formed and affixed to the inlet plate. Since the inlet 220 is part of the inlet plate 120, the inlet plate is the first element through which water passes. In the present embodiment, four screw holes project outwardly from the circumference of the inlet plate. Screws 190 are received in these holes to affix the retainer 100 and inlet plates 120 to one another, securing the actuator plate 110 therebetween. Additionally, two control rod apertures are formed in the body of the inlet plate. The aforementioned control rods 130 pass through these apertures to ultimately contact the turbine 160.

Figure 5C:
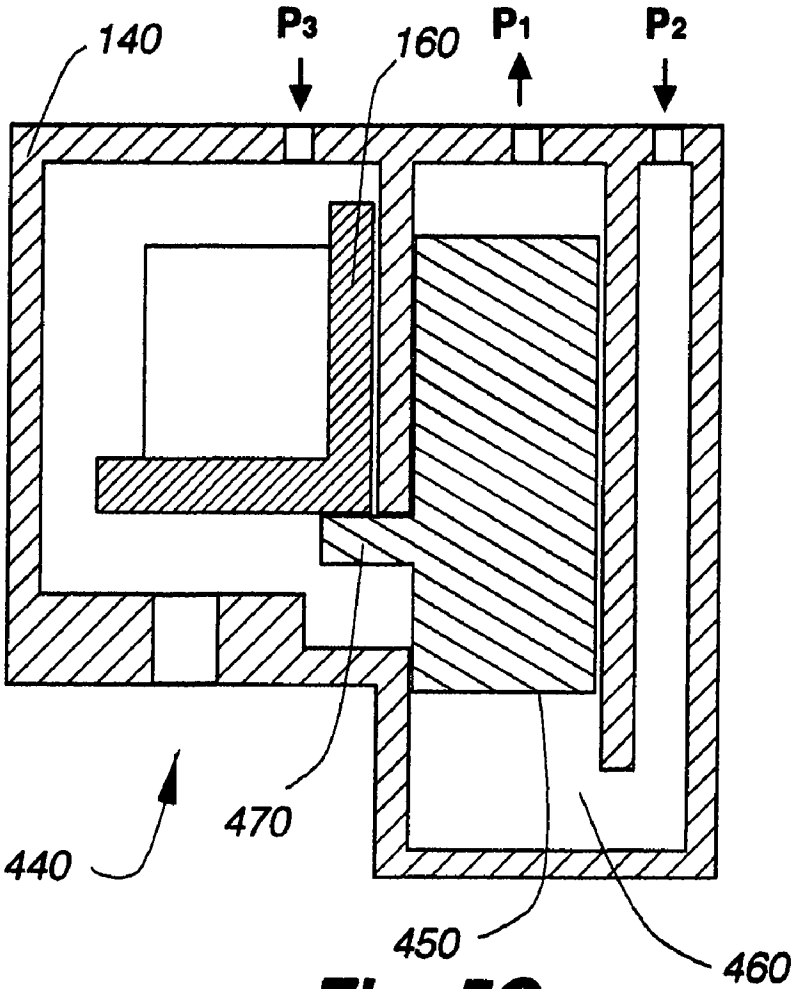
FIG. 5C depicts a cross-sectional view of the turbine and piston arrangement of FIG. 5B with the turbine in a raised position.
Figure 5B:
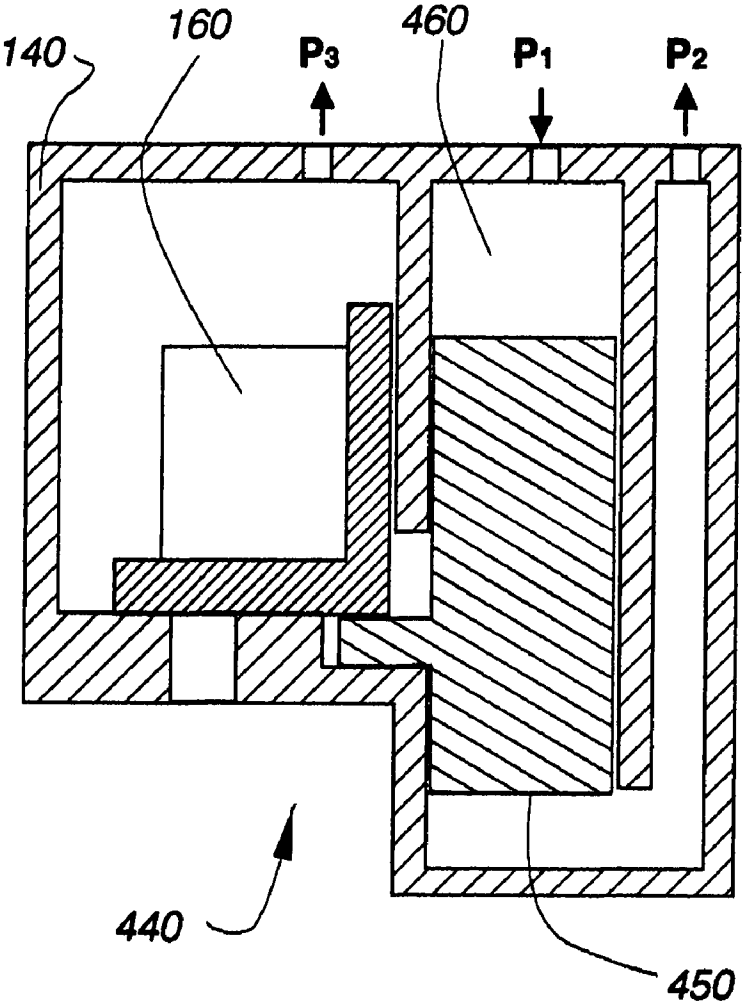
FIG. 5B depicts a cross-sectional view of a turbine and piston arrangement with the turbine in a lowered position.

Alternate embodiments of the present invention may employ a hydraulic system 440 to raise or lower the turbine 160, as shown in FIGS. 5B and 5C. In such an embodiment, the ramp and control rod structure may be omitted.

FIG. 5B depicts a partial cross-section of the turbine ring 140 and an associated piston 450 seated within a piston chamber 460. As the knob 360 and actuator plate 110 turn, water may be channeled through an associated passage (not shown) to enter the piston chamber through the passage marked "P1" on FIG. 5B (in some embodiments, the knob and/or actuator plate may be replaced with a mode ring, as discussed below). The passage marked "P2" generally communicates with a lower-pressure segment of the showerhead (or with the atmosphere), permitting the water pressure to drive the piston 450 downward. Water flow thus drives the piston downward, permitting the turbine 160 to spin in the turbine chamber. Water driving the turbine flows into the turbine channel through passage P3 and outward through the base of the turbine channel, as generally described above. Thus, the turbine pulses water flow to the nozzles as previously described.

By contrast, FIG. 5C depicts the turbine 160 in a stalled or raised mode. Here, the knob (not shown) is turned to channel water through passage P2 while passage P1 communicates with the lower-pressure portion of the showerhead (or atmosphere). (Turning the knob 360 and/or actuator plate 110 may change which passage P1, P2 communicates with atmosphere or a non-pressure portion, and which passage communicates with water.) Thus, the piston 450 is driven upward, resulting in a piston flange 470 engaging the turbine base. The piston flange 470 raises the turbine 160 as the piston 450 rises, permitting water to flow about the turbine sides and outwardly through the nozzle. This corresponds to the drenching mode previously mentioned.

4. Second Embodiment

Figure 6:
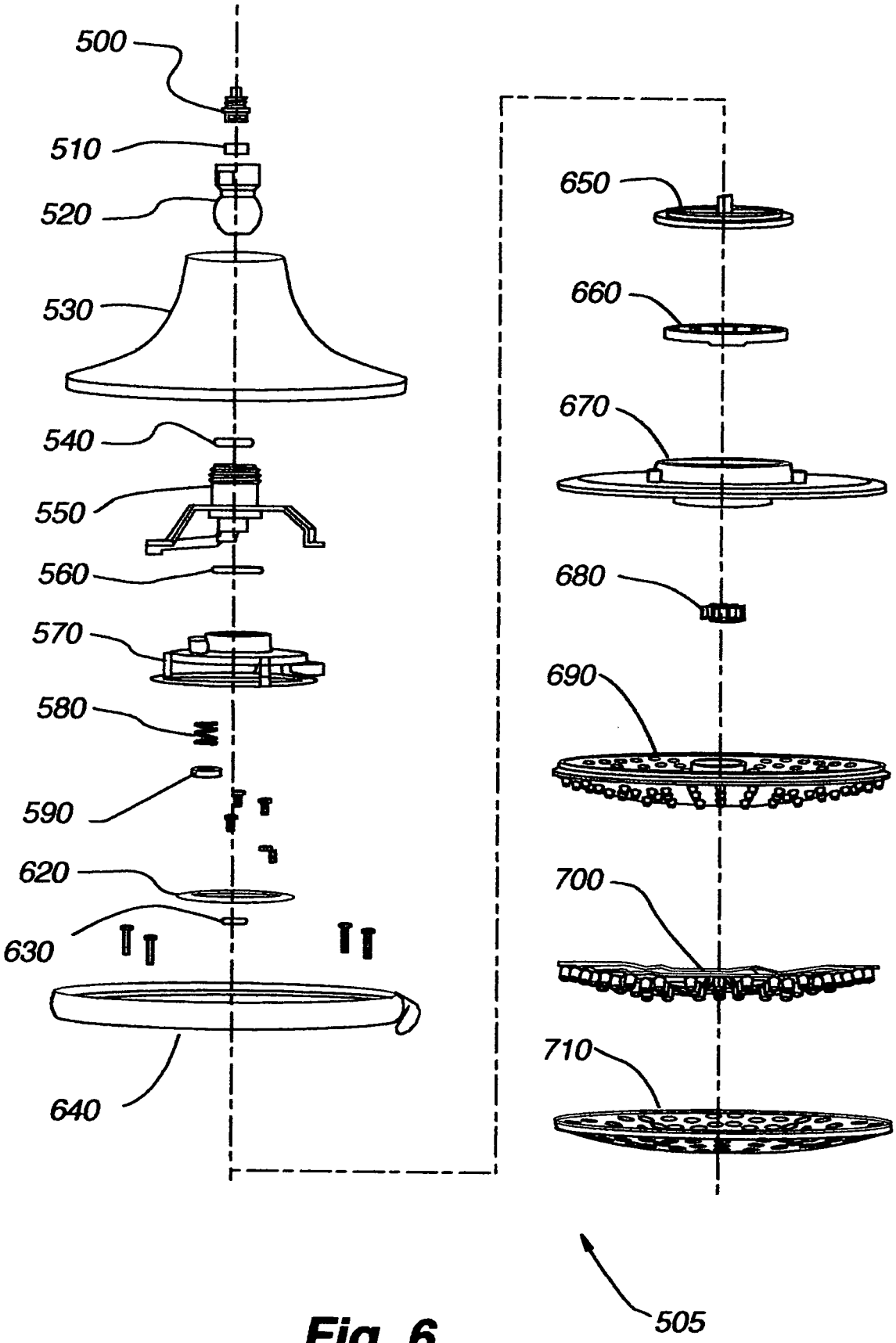
FIG. 6 depicts an exploded view of a showerhead forming a second embodiment of the present invention.

FIGS. 6-37 depict a second embodiment of a drenching shower head 505. FIG. 6 depicts the shower head in an exploded view, such that various internal elements of the shower head may be seen from rear to front. This embodiment of a drenching shower head 505 includes a filter screen 500, a flow regulator 510, pivot ball 520, base cone 530, o-ring 540, pivot ball mount 550, second o-ring 560, pivot ball housing 570, spring 580, cup seal 590, assorted screws 600, plunger 610, seal 620, third o-ring 630, mode ring 640, backplate cap 650, turbine 660, backplate 670, second turbine 680, frontplate 690, nozzle web 700 and face plate 710.

FIGS. 7-10 depict various cross-sectional views of the present shower head 505. Each cross-sectional view is taken along a different plane intersecting the shower head. FIGS. 7-10 generally depict the inner connections and relative positioning of the various portions of the shower head listed with respect to FIG. 6.

Figure 7:
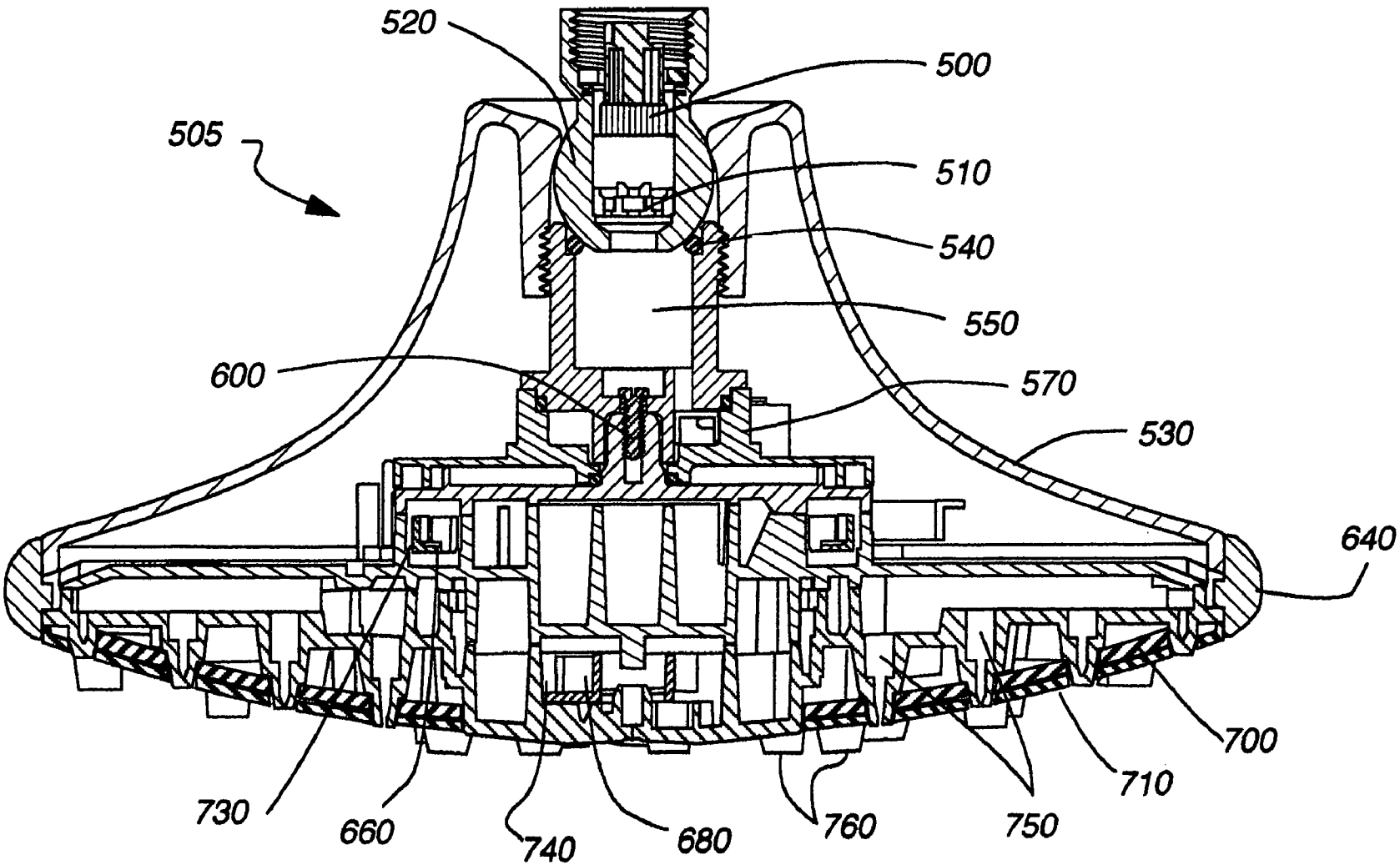
FIG. 7 depicts a first cross-sectional view of the showerhead of FIG. 6.
Figure 8:
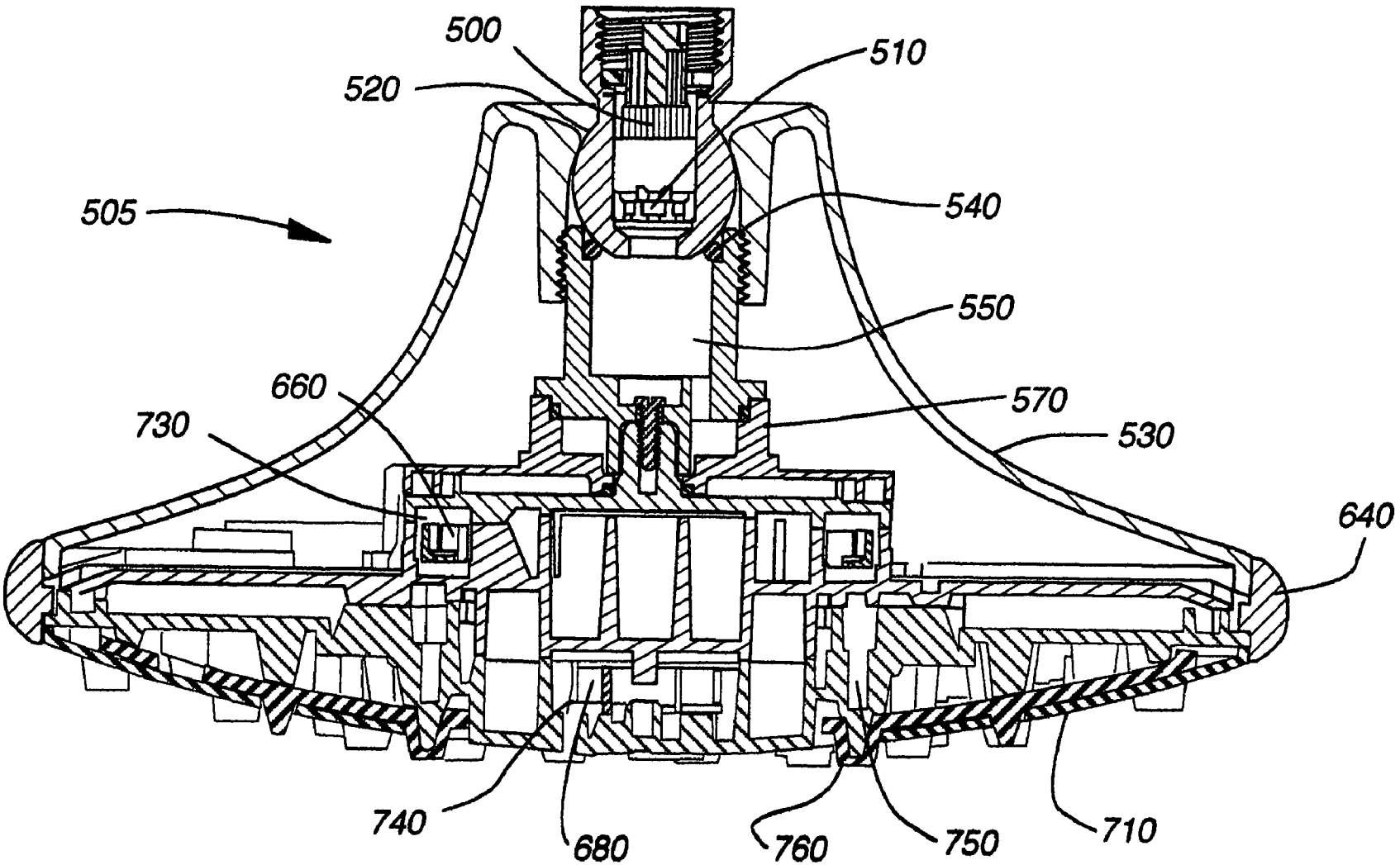
FIG. 8 depicts a second cross-sectional view of the showerhead of FIG. 6.
Figure 9:
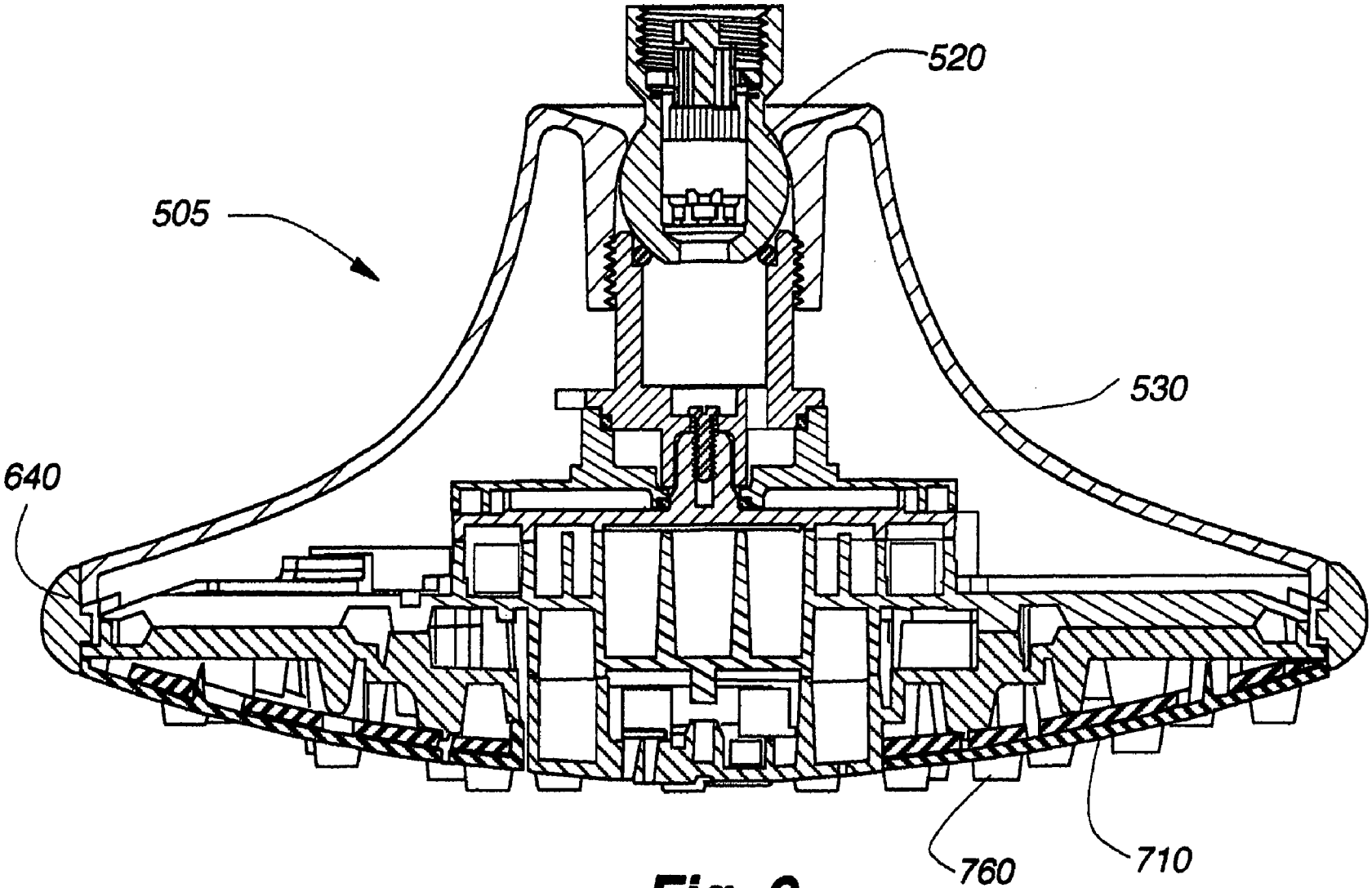
FIG. 9 depicts a third cross-sectional view of the showerhead of FIG. 6.

For example, and with particular respect to FIG. 7, it may be seen that the filter screen 500 nests within the pivot ball 520. The pivot ball is internally threaded at one end (the "rear" end) to mate with a shower pipe or other water source. The opposing ("front") end of the pivot ball 520 is received in the rear end of the pivot ball mount 550. An o-ring seal 540 facilitates a snug connection between pivot ball and pivot ball mount. The pivot ball mount 540 is attached to the housing 570 and the backplate cap 650 by a threaded screw. The threaded screw passes through a threaded hole in the pivot ball mount 550 and into a similarly sized threaded hole in the backplate cap 650. The pivot ball mount 550 further includes three protruding legs 720 (shown in better detail in FIGS. 11A, 11B, 12A and 12B). Each of these legs has a screw hole defined at the base thereof. A screw passes through each screw hole, securing the pivot ball mount to the rear of the backplate 670. As shown to best effect in FIG. 19, the backplate includes a plurality of threaded holes formed therein to receive the screws passing through the legs 720 of the pivot ball mount 550.

Still with respect to FIG. 7, the backplate cap 650 is in turn affixed to the backplate 670. More specifically, the front of the backplate cap adjoins the rear of the backplate. A hollow, annular ring 730 is formed by recesses on the front side of the backplate cap 650 and the rear side of the backplate 670. A first turbine 660 sits in this annular turbine recess 730. The function of the turbine will be discussed in further detail below.

The front side of the backplate 670 defines a second annular, or backplate, channel. The front side of the backplate mates with or is otherwise affixed to the rear side of the frontplate 690. A frontplate annular ring 740 (or simply a frontplate ring) is defined on the rear surface of the frontplate. A second turbine 680 is received within this frontplate ring 740. The second turbine may be, but is not necessarily, concentric with the first turbine about a longitudinal axis of the shower head.

Relatively hard, plastic nozzles 750 are formed on the front side of the frontplate. These nozzles are received within a nozzle web 700 made of a soft or rubber-like material. Generally, the nozzle web takes the form of a series of flexible nozzle sheaths 760 interconnected by a series of flexible members 770 (as shown to best effect in FIGS. 26A, 26B, 27A and 27B). Unlike the frontplate 690, for example, the nozzle web is flexible and includes spaces between the flexible members. In other words, the nozzle web typically consists entirely of the flexible nozzle sheaths and members. This rubber-like material is generally softer and more flexible than the plastic nozzles. In some embodiments, the nozzles 750 may extend into the cavities 760 formed in the nozzle web 700 such that the ends of the nozzle are flush with the ends of the outer rubber nozzle sheaths formed in the nozzle web. In alternate embodiments, a space or gap may exist between the end of the nozzles formed on the front of the face plate and the end of the corresponding nozzle sheath formed on the nozzle web.

The nozzles 750 are received in the various nozzle sheaths 760. Typically, each nozzle is fitted into a single nozzle sheath. The nozzles protrude through holes extending through the face plate 710. The face plate is shown to best effect in FIGS. 28A, 28B, 29A and 29B.

The face plate 710 is affixed to a base cone 530. The base cone provides an outer housing for the various elements described herein, with the exception of the inlet 500, mode ring 640, and the face plate. All other elements are typically covered by the base cone 530. In the present embodiment, the base cone is generally a frustoconical in shape, with an outward angle from the inlet 500 to the face plate 710. Alternate embodiments may employ different shapes for the base cone. For example, the side walls of the base cone 530 may be angled outwardly instead of inwardly, maybe straight, or may take a more rounded than frustoconical shape.

Figure 10:
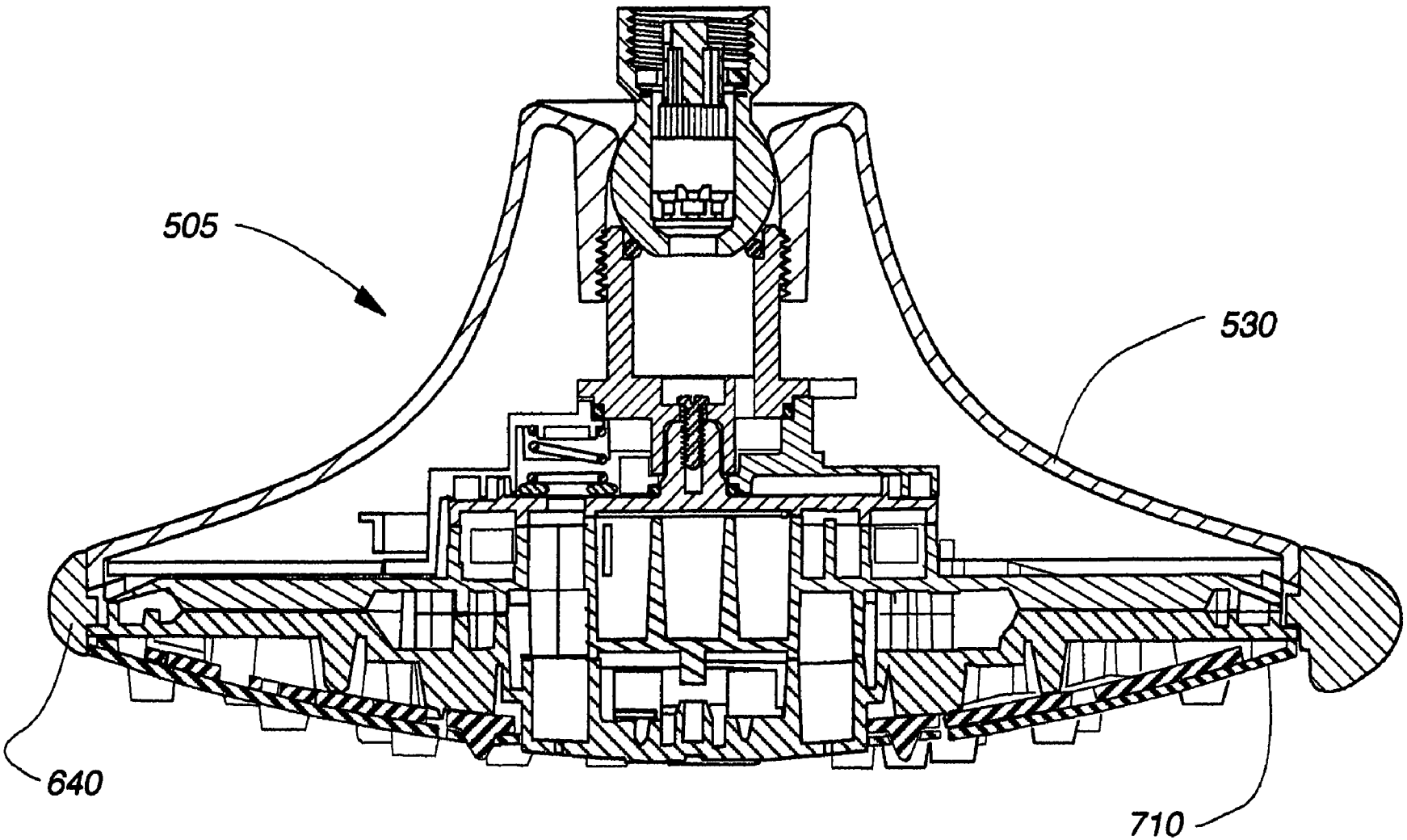
FIG. 10 depicts a fourth cross-sectional view of the showerhead of FIG. 6.
Figure 11A:
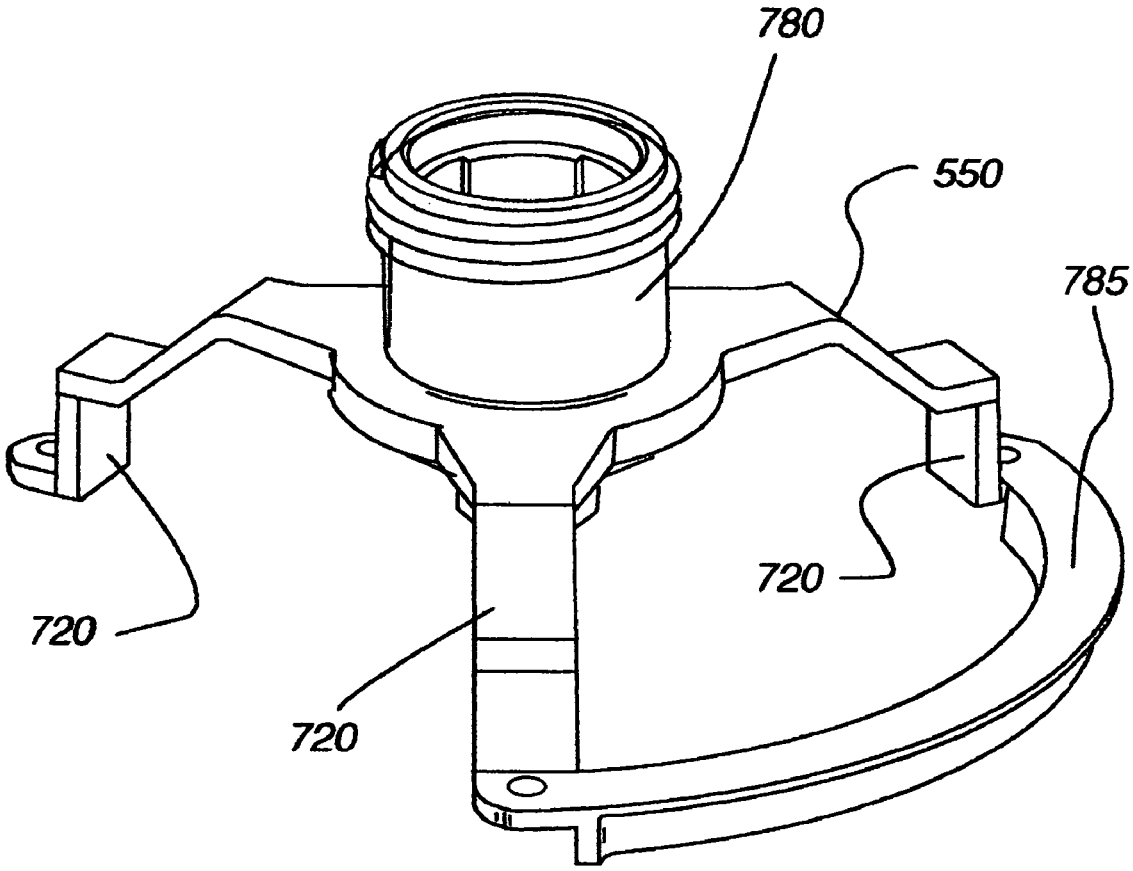
FIG. 11A depicts a perspective view of the rear of a pivot ball mount for use in the showerhead of FIG. 6.
Figure 11B:
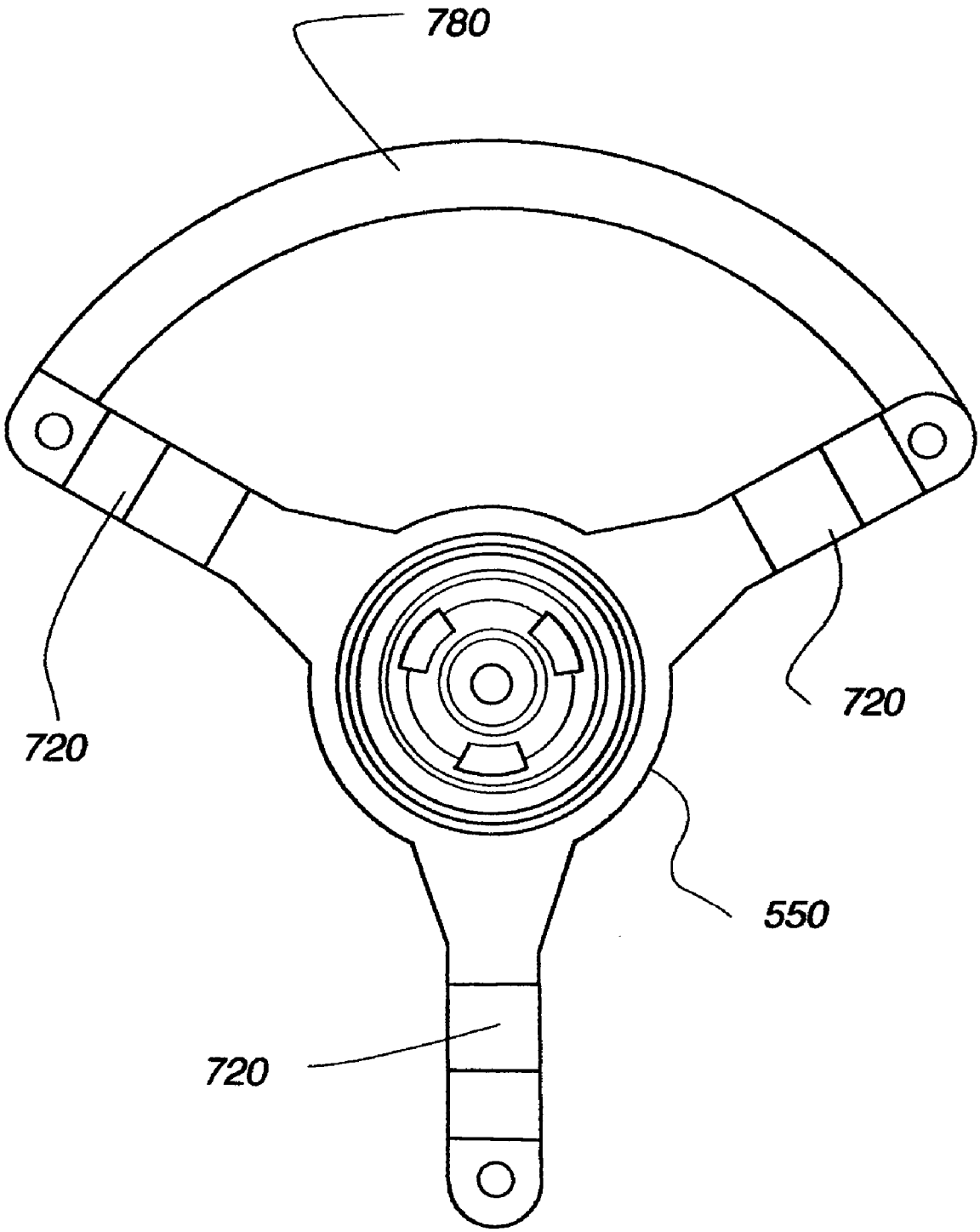
FIG. 11B depicts a plan view of the rear of a pivot ball mount for use in the showerhead of FIG. 6.
Figure 12A:
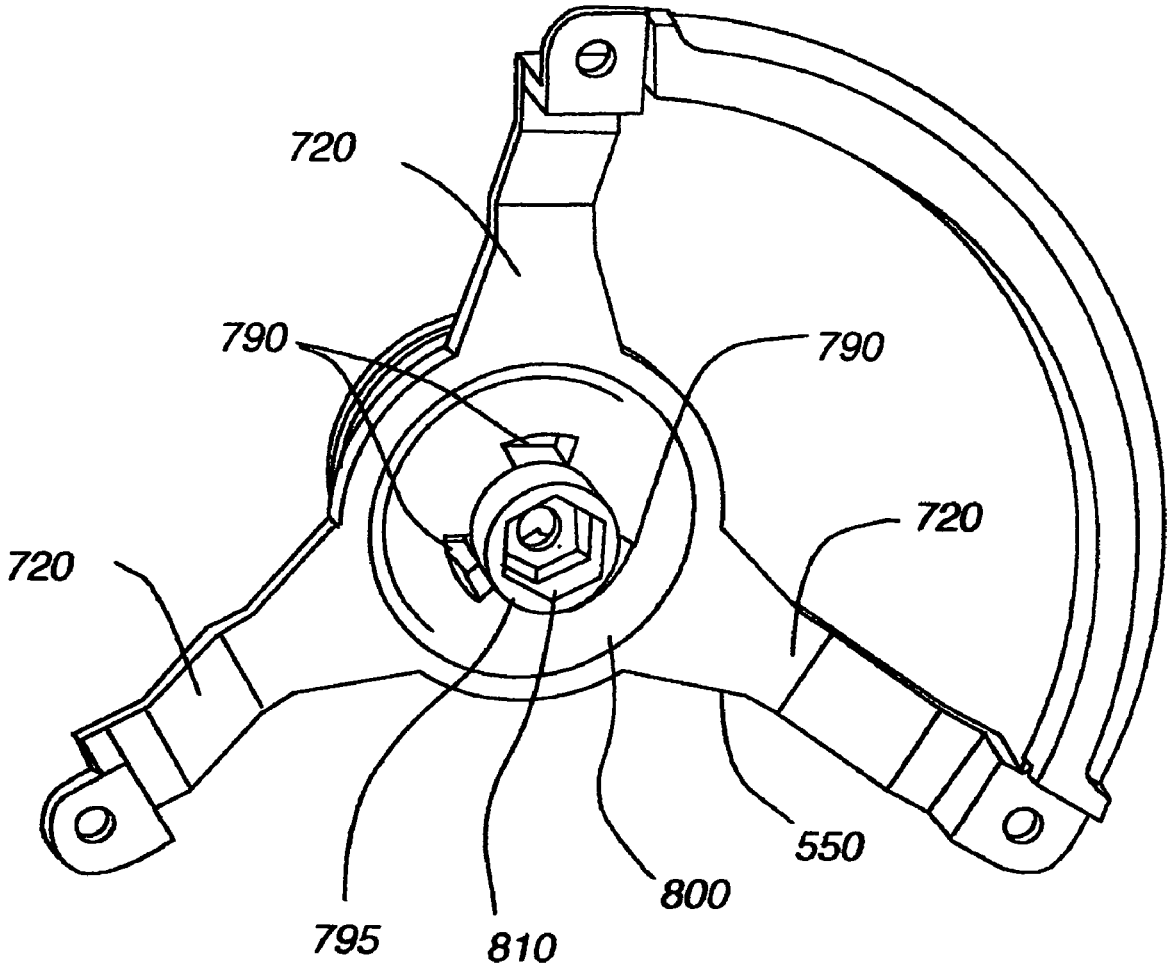
FIG. 12A depicts a perspective view of the front of the pivot ball mount of FIG. 11A.
Figure 12B:
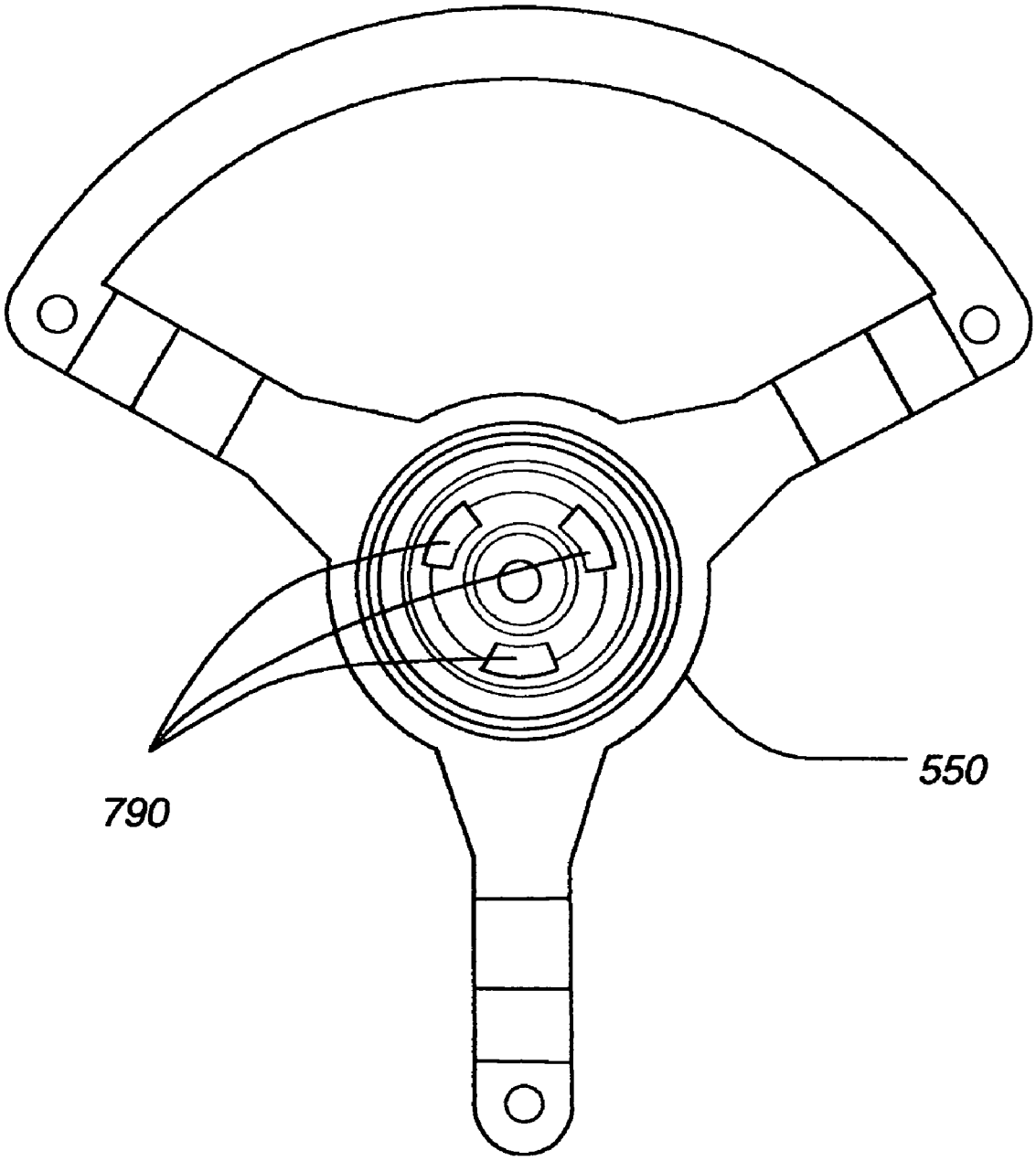
FIG. 12B depicts a plan view of the front of the pivot ball mount of FIG. 11A.

The flow of water through the shower head and the function of each element within the shower head will now be described in more detail with reference to FIGS. 11A-29B. FIGS. 11A and 12A depict rear and front views, respectively, of the pivot ball mount 550. A neck 780 extends rearwardly from the body of the pivot ball mount, while all three legs 720 extend forwardly therefrom. An arcuate portion 785 connects two of the three legs. At least a portion of the neck exterior is threaded in the present embodiment in order to engage a similar thread or portion of the base cone 530. This threaded connection between pivot body and base cone is shown to best effect in FIGS. 7-10. As previously mentioned, the pivot body neck 780 receives a front end of the pivot ball 520. The pivot ball connects to a shower inlet pipe or other water source and transmits water from the water source to the neck interior. Water passes from the neck interior to the front of the pivot ball mount by means of radial channels 790 extending through the pivot ball body from the neck interior to the pivot ball front. These radial channels are shown in FIGS. 12A and 12B. As also previously mentioned, each of the legs 720 includes a foot having a hole defined therein for receiving a screw. The screw connects the pivot ball mount 550 to the backplate cap 650.

As shown in FIGS. 12A and 12B, a circular raised segment, or dais 800, is formed on the front of the pivot ball mount 550. Formed on the dais is a circular projection having a hexagonally-shaped cross-sectional interior 810. The hexagonally-shaped interior accepts the hexagonal protrusion 820 projecting from the backplate cap rear, shown in FIGS. 15A and 15B. A screw hole is formed in the pivot ball mount body and another is formed in the backplate cap's hexagonal projection to allow these two pieces to be mated by a single screw.

Figure 13A:
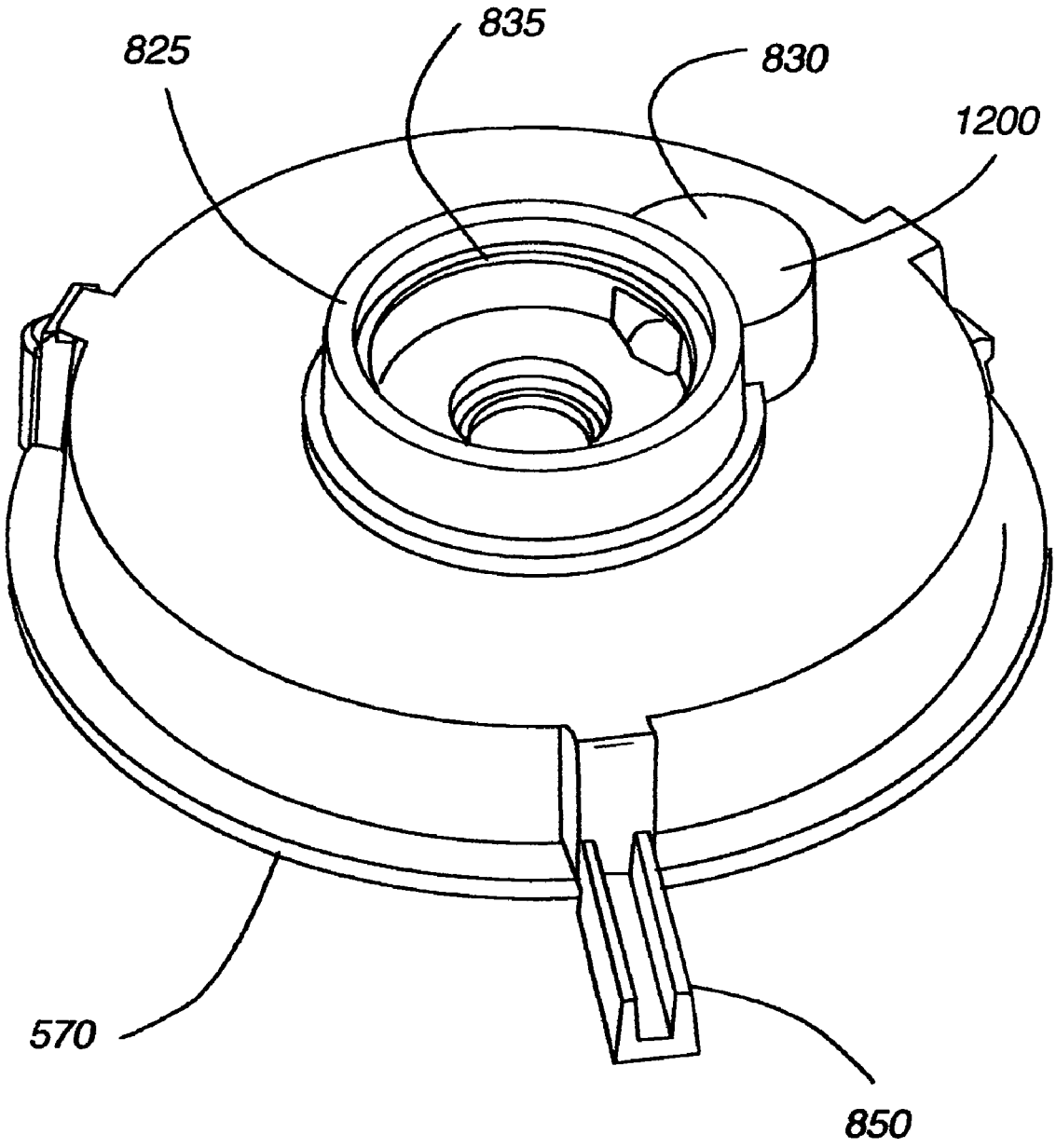
FIG. 13A depicts a perspective view of the rear of a housing for use in the showerhead of FIG. 6.
Figure 13B:
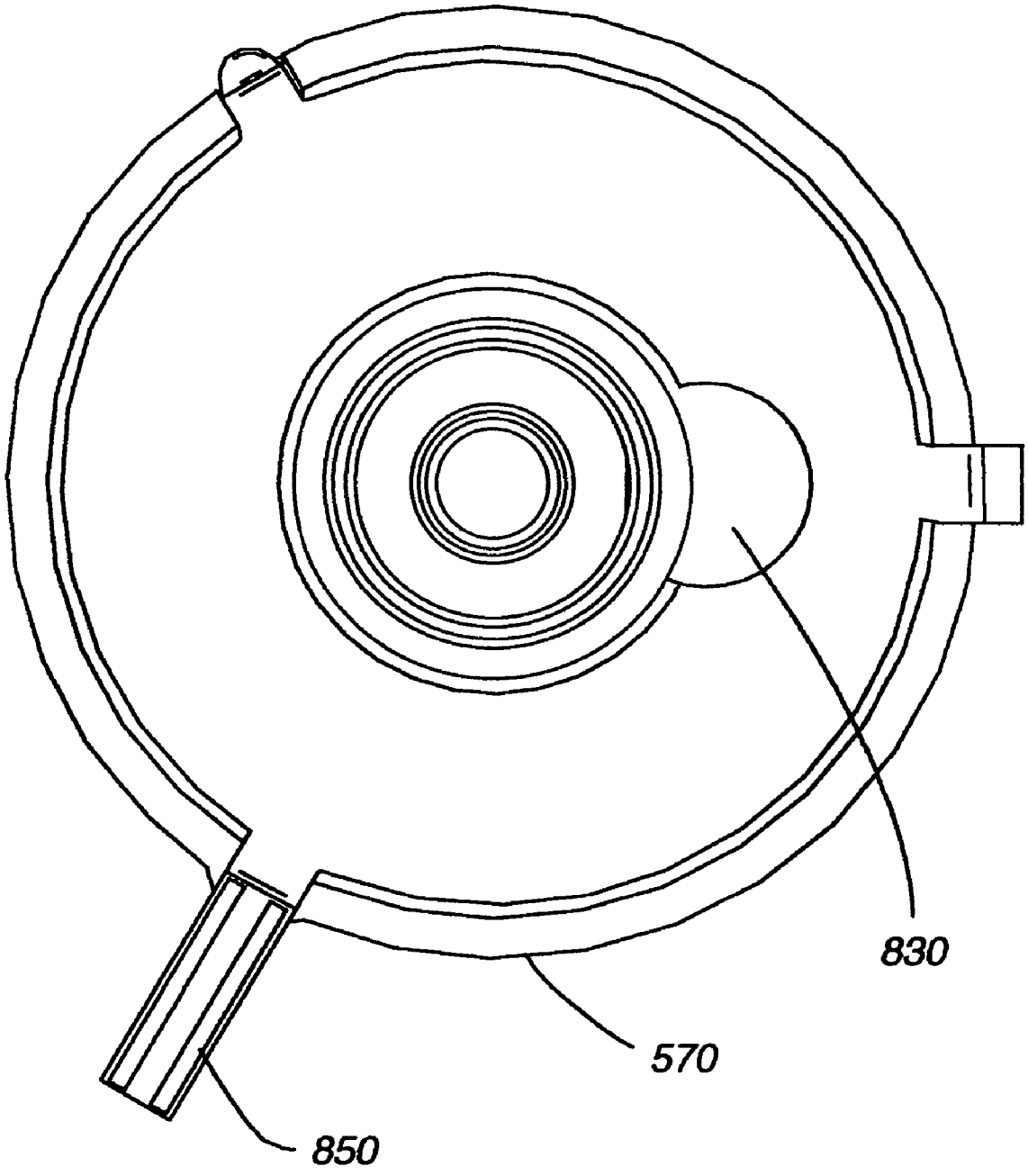
FIG. 13B depicts a plan view of the rear of a housing for use in the showerhead of FIG. 6.

With reference to FIGS. 13A and 13B, the pivot ball mount dais 800 is received in an annular ring 825 defined on the rear of the housing 570. The housing rear is shown in FIGS. 13A and 13B. As shown to best effect in FIG. 13A, the housing annular ring 825 includes a shoulder 835 formed therein against which the dais rests when the shower head is assembled. Further, the depth of the housing annular ring is such that the circular projection extending from the pivot ball mount body 550 is fully accepted within the housing annular ring.

Continuing with the description of water flow through the shower head, water exiting the radial channels 790 of the pivot ball mount 800 flows into the housing annular ring 825. The hole in the center of the housing annular ring 825 typically is completely blocked by the circular projection 795 of the pivot ball mount. However, a side channel 830 is formed in the rear housing. Thus, water flows from the housing annular ring 825, into the side channel 830, and to the housing 570 front. The side channel includes a hole or tunnel 840 passing through the housing 570 to permit such flow. This tunnel 840 is shown to best effect in FIGS. 14A and 14B.

It should be noted the housing 570 further includes a radially-extending protrusion 850 emanating from the housing body. This protrusion 850 interacts with the mode ring (described later) to change the pulsating operational mode of the shower head. Such changes to the shower head operation are described in more detail below.

Figure 15A:
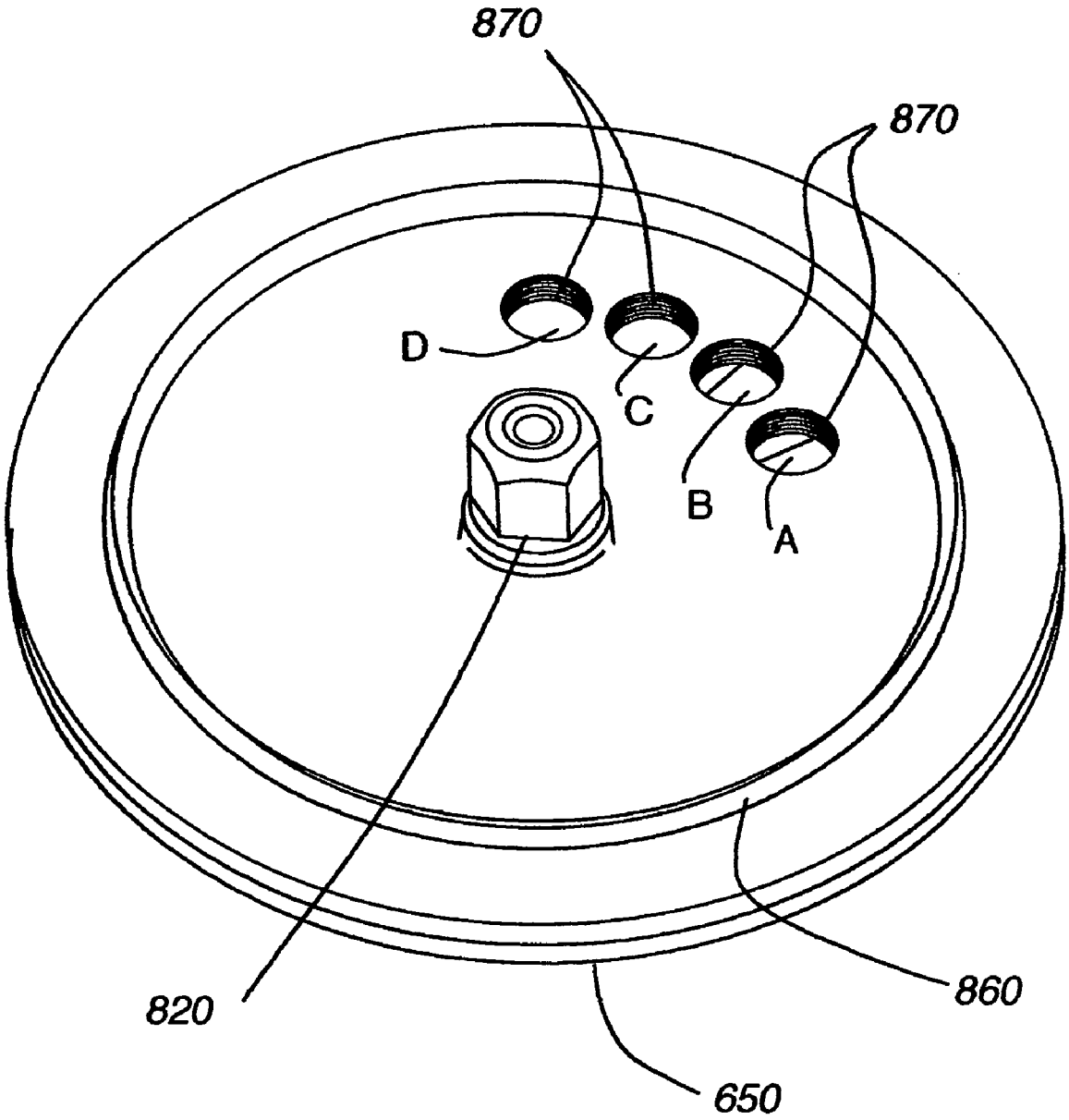
FIG. 15A depicts a perspective view of the rear of a backplate cap for use in the showerhead of FIG. 6.
Figure 15B:
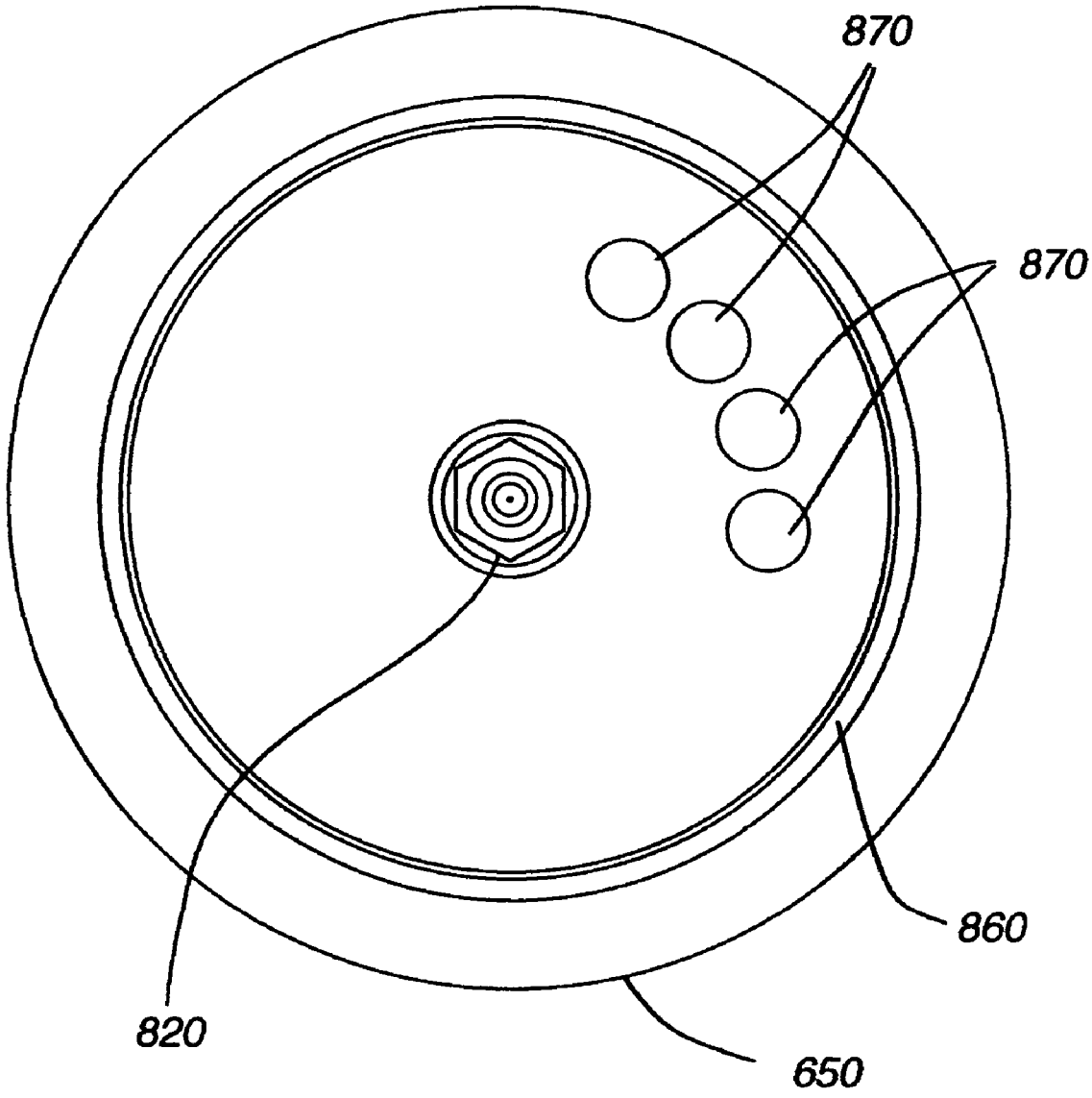
FIG. 15B depicts a plan view of the rear of a backplate cap for use in the showerhead of FIG. 6.
Figure 16A:
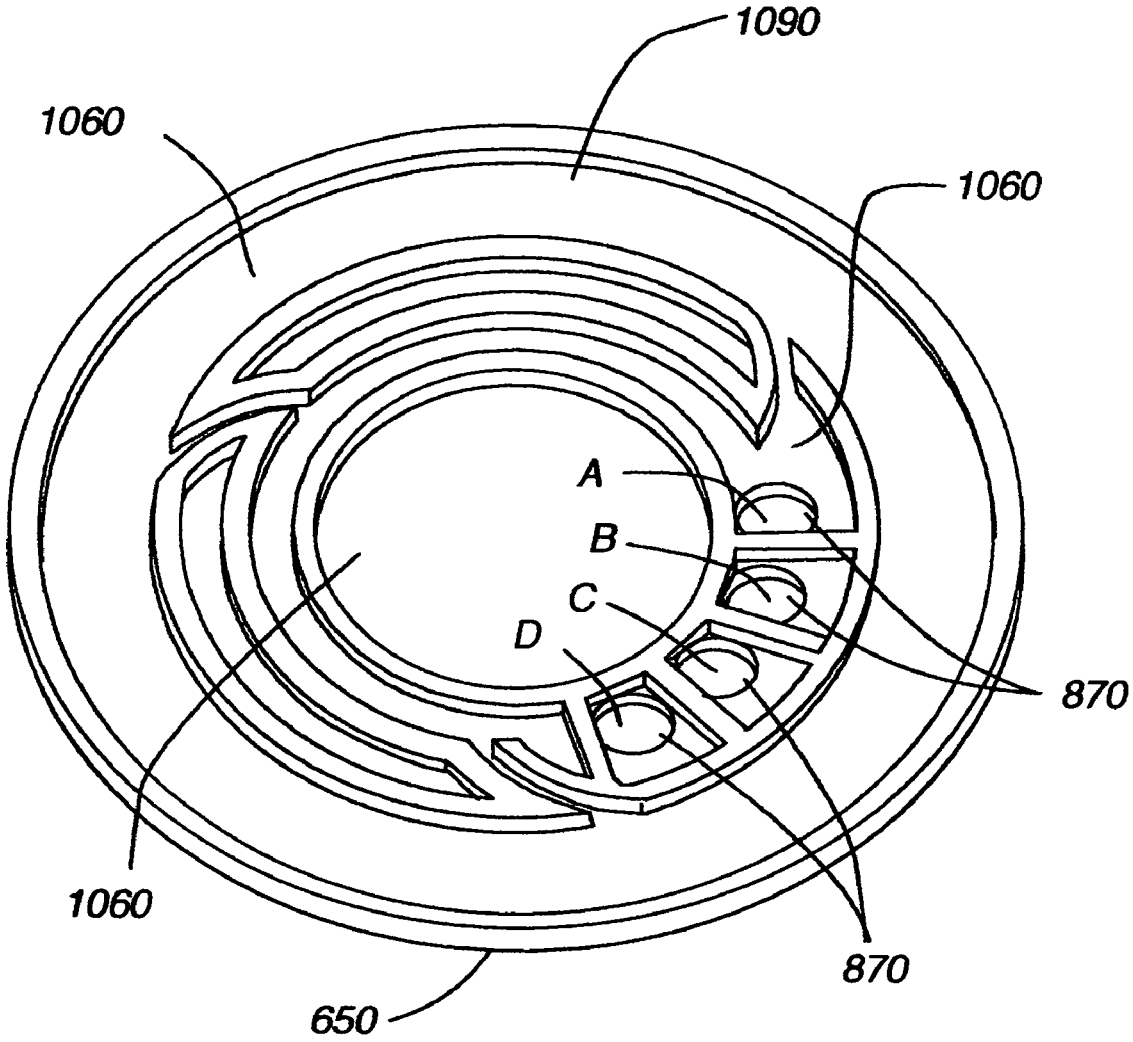
FIG. 16A depicts a perspective view of the front of the backplate cap of FIG. 15A.

FIGS. 15A and 16A depict a backplate cap rear and front, respectively. The backplate cap 650 is sized such that it fits within the cup shape of the housing 570 front. In addition to the hexagonal protrusion 820, a circular wall 860 is formed on the backplate rear. This circular wall is generally formed slightly inwardly from the backplate cap's outer edge. The circular wall 860 surrounds not only the hexagonal protrusion 820, but also four flow holes 870 passing through the backplate cap 650. These flow holes are marked A, B, C, and D for reference. The circular backplate wall abuts a similar wall formed on the front of the housing 570 (called the front housing wall 845) when the shower head is fully assembled. The combination of backplate and front housing walls 860, 845 forms a watertight seal between the housing front and backplate cap rear, ensuring that any water passing through the side passage 830 of the housing is forced through at least one of the four holes A-D defined in the backplate cap rear.

Figure 16B:
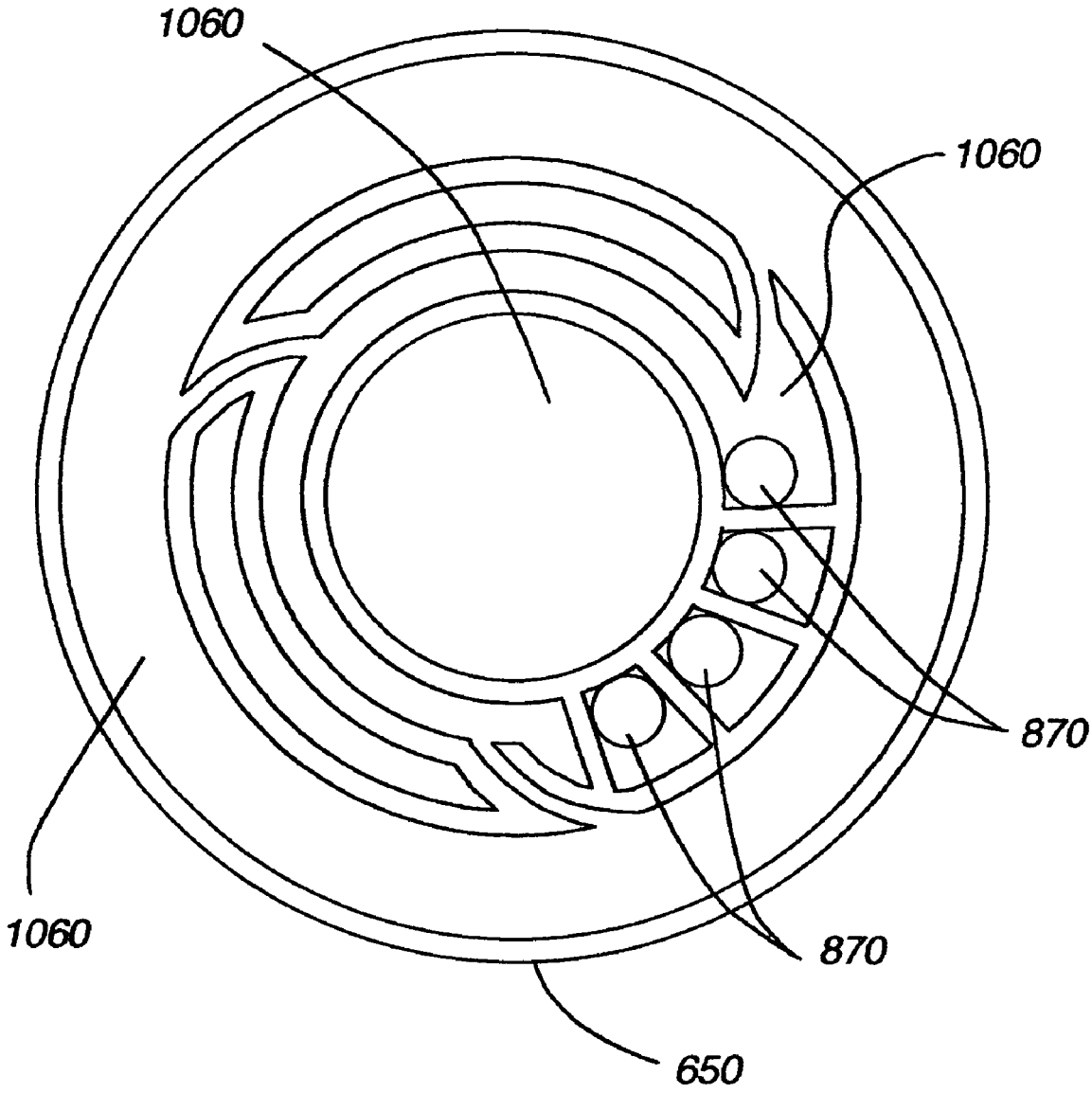
FIG. 16B depicts a plan view of the front of the backplate cap of FIG. 15A.

FIGS. 16A and 16B depict the backplate cap front. As shown, the backplate cap front is generally divided into three concentric areas 1060. The second, or middle, concentric area is further divided into four segments. Each segment corresponds to one of the previously mentioned holes A-D. The various segments channel water flowing through one of the holes A, B, C, D to different portions of the backplate rear. Water flowing through one of the flow holes A, B, C, D passes through the backplate cap 650 and into one of four channels 880 defined by the backplate cap front and backplate rear. These channels 880 are shown on FIGS. 19A and 19B, and marked A', B', C', D'. Each lettered channel corresponds to the similarly lettered flow hole 870. That is, water passing through flow hole A enters channel A', water flowing through flow hole B enters channel B', and so forth. Thus, water flowing through holes C and D pass directly into flow channels C' and D'. Water flowing through flow channel B' generally passes into a circular flow channel defined about the center of the backplate rear. Flow channel A' is a circular channel generally surrounding flow channel B'. Three curved passages 1070 radiate outwardly from flow channel A' to an outer circular turbine channel. This turbine channel has multiple holes 910 defined within its base.

A first turbine 660 sits within the turbine channel 920 formed on the backplate rear. This first turbine 660 is shown generally in FIGS. 17A and 18A, which depict the rear and front of the turbine respectively. Multiple blades 890 extend radially inwardly from the circular turbine wall. Two flanges 900 are formed on the turbine at diametrically opposite positions. Alternate embodiments may employ a varying number of flanges or shields 900, or may employ a single flange. Similarly, alternate embodiments may position the shields at varying positions around the turbine circumference, including with uneven spacing therebetween.

Figure 18A:
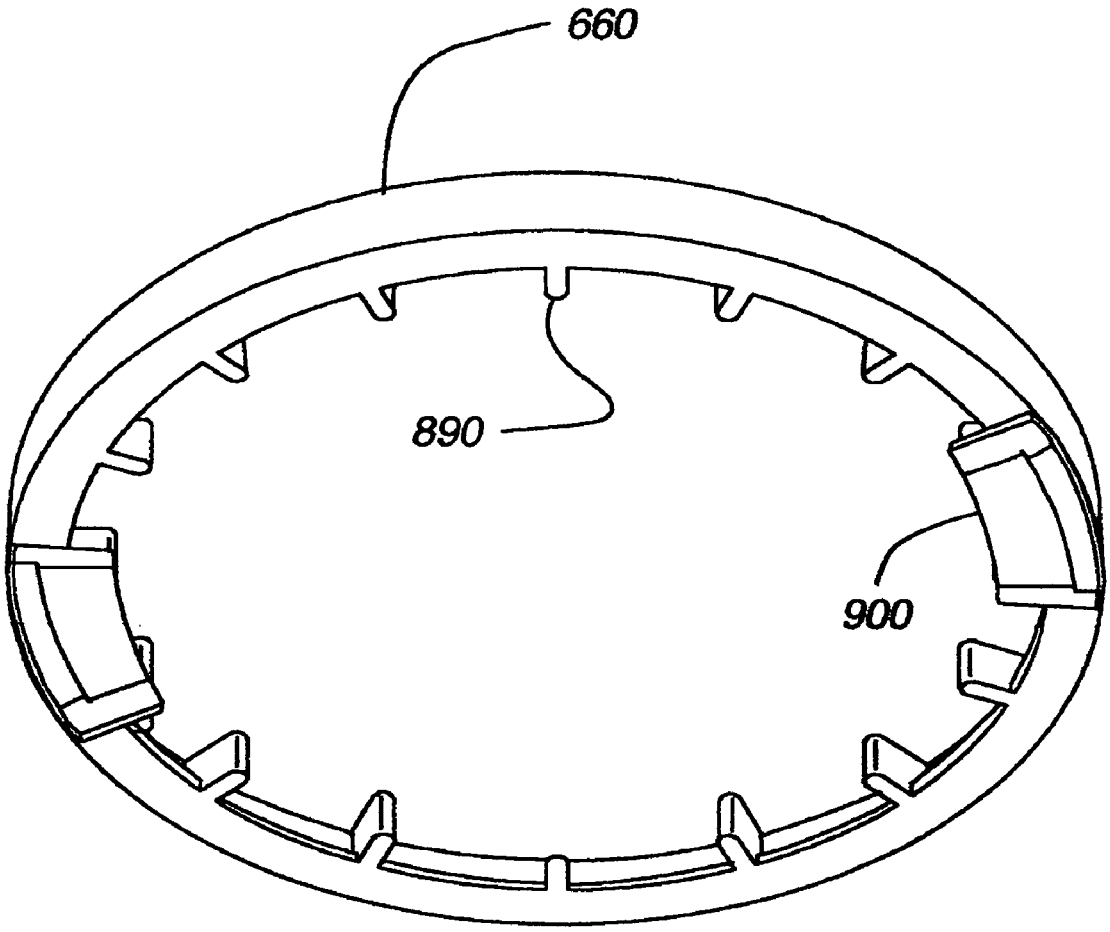
FIG. 18A depicts a perspective view of the front of the first turbine of FIG. 17.
Figure 18B:
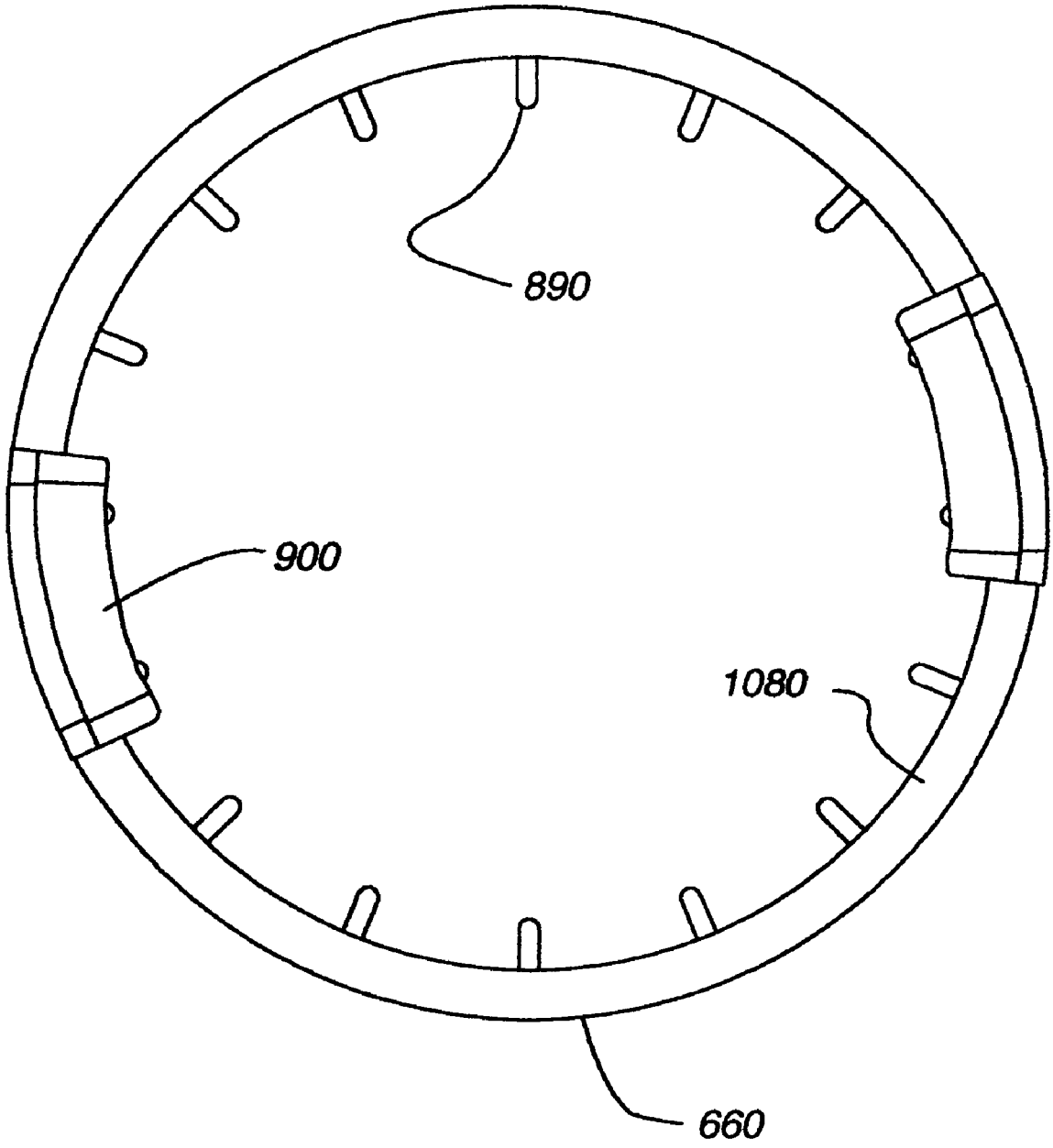
FIG. 18B depicts a plan view of the front of the first turbine of FIG. 17.

The flanges 900 extend inwardly and slightly downwardly from the turbine ring 1080, as shown to best effect in FIGS. 18A and 18B. The flanges and front of the turbine sit within the turbine channel 920 atop the backplate rear. In such an orientation, the rear of the turbine 660 faces the front of the backplate cap 650. The front of the backplate cap defines a turbine channel top 1090 (as shown in FIGS. 16A and 16B). The turbine channel top is also the aforementioned outermost concentric channel 1060 of the backplate cap 650 front. The outermost wall of the backplate cap 650 front abuts the wall of the turbine channel defined on the backplate rear, creating a watertight seal and ensuring water entering the turbine channel 920 does not spill over onto to the rest of the backplate rear.

As water exits the radial channels 790 emanating outwardly from flow channel A', it impacts one or more of the turbine blades 890 shown in FIGS. 17A, 17B, 18A and 18B. (FIG. 17C depicts an alternative embodiment of a turbine that may be used to replace one or more turbines described herein in alternative embodiments.) This causes the turbine 660 to spin in a clockwise direction with respect to the view shown in FIGS. 19A and 19B. As the turbine spins, the flanges 900 periodically overlap the turbine holes 910 defined in the base of the turbine channel 920. The turbine holes 910 permit water flow from the backplate rear to the backplate front. As shown on FIG. 20A, each turbine hole 910 generally permits water passage into a generally u- or v-shaped channel 940.

Thus, as the turbine 660 spins, water is periodically prevented from flowing through one or more turbine holes 910 by each flange 900. Since the flange spins about the turbine channel 920 with the turbine, water flow through the turbine holes is prevented sequentially. This, in turn, prevents water flow into the v-shaped channels 940 formed on the front of the backplate 650. Ultimately, these v-shaped channels feed one or more nozzles 750. Thus, as the turbine 660 spins, water flow to each of the specific nozzles 750 fed by the v-shaped channel associated with each turbine hole pauses, creating a pulsing water flow.

Figure 19A:
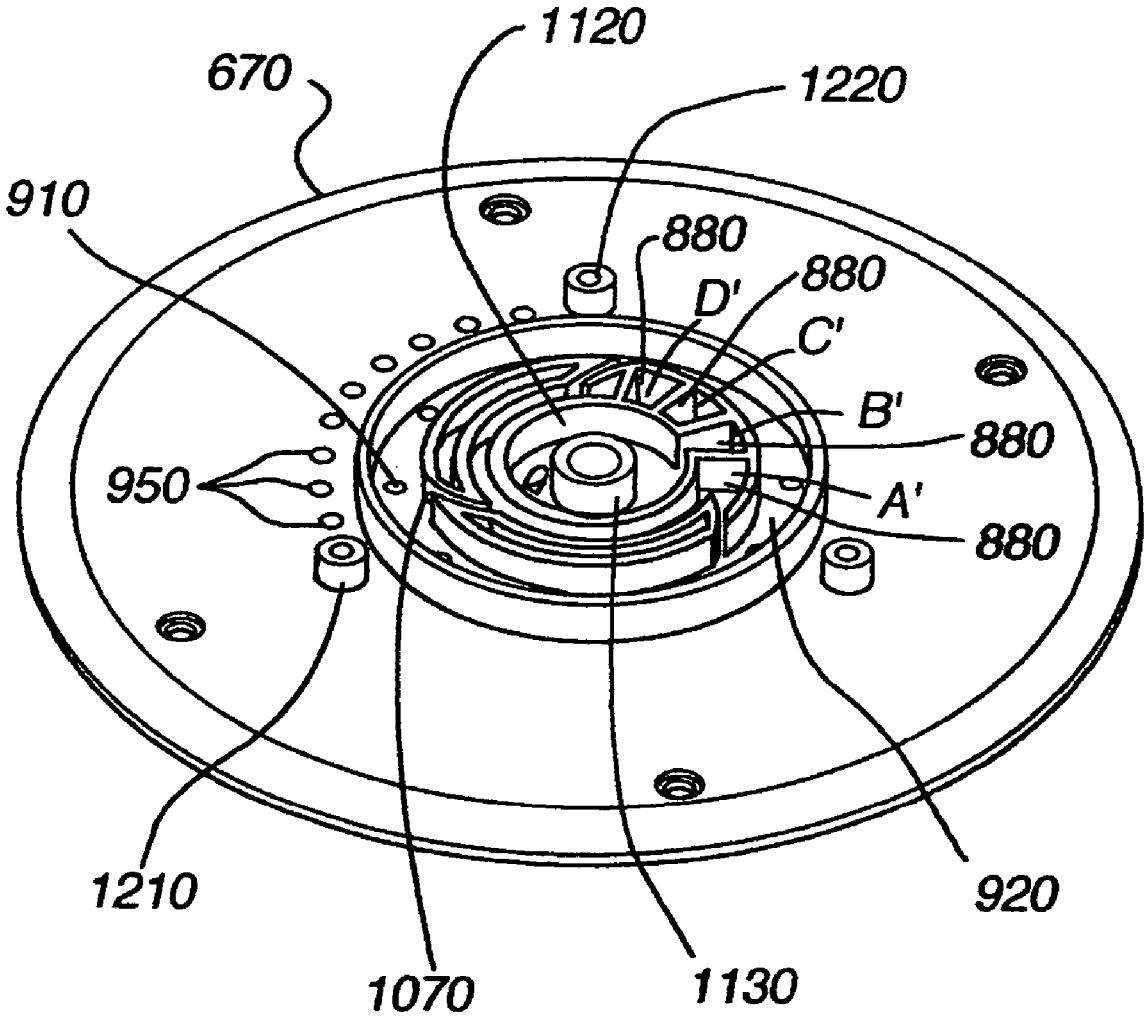
FIG. 19A depicts a perspective view of the rear of a backplate for use in the showerhead of FIG. 6.
Figure 19B:
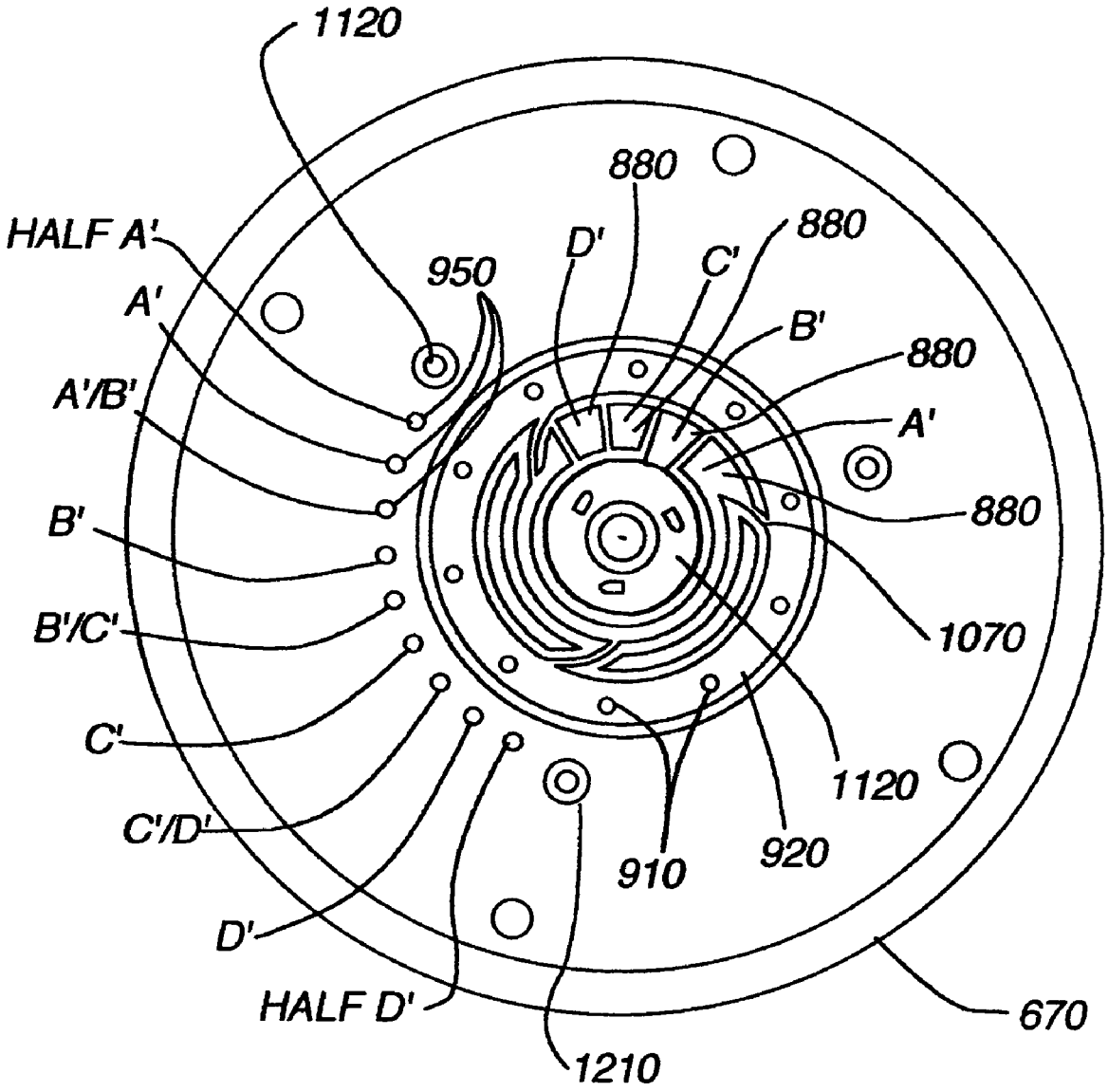
FIG. 19B depicts a plan view of the rear of a backplate for use in the showerhead of FIG. 6.

A series of detent holes 950 may also be seen in FIGS. 19A and 19B. These detent holes are described more fully below with respect to FIG. 25A.

Water entering flow channel B' is directed along a circular flow path 1120 defined in the middle of the backplate 670 rear, shown to best effect in FIGS. 19A and 19B. Formed in the bottom of flow channel B are three nozzles 960, $N_1$, $N_2$, and $N_3$. These nozzles 960 permit water to flow from the backplate rear to the backplate front, shown on FIGS. 20A and 20B. Further, the nozzles 960 impart directional flow to water passing therethrough. In the present embodiment, water flows in a clockwise manner with respect to FIGS. 21A and 21B when exiting the three nozzles, although alternate embodiments may direct water flow in a counterclockwise fashion. Although three nozzles 960 are shown in the present embodiment, alternate embodiments may employ more or fewer nozzles, including employing a single nozzle.

Figure 20A:
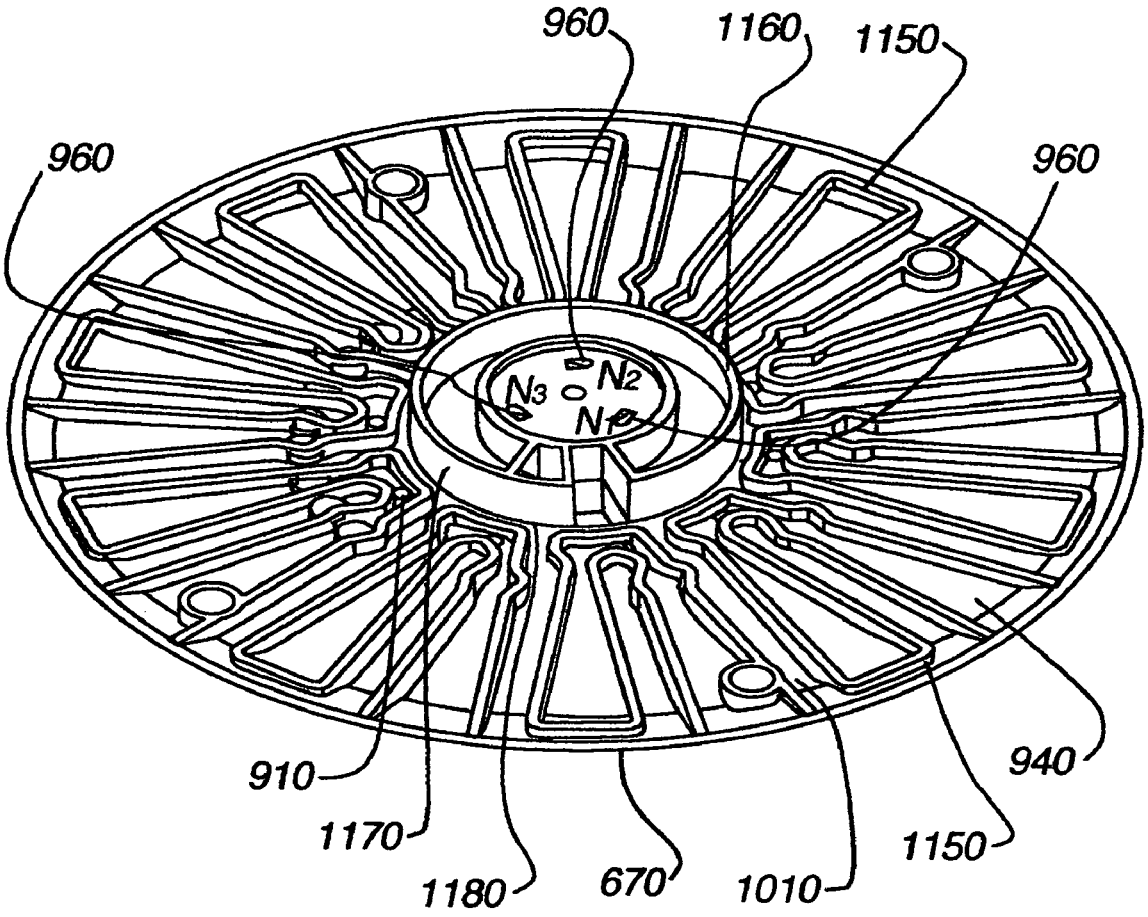
FIG. 20A depicts a perspective view of the front of the backplate of FIG. 19A.
Figure 20B:
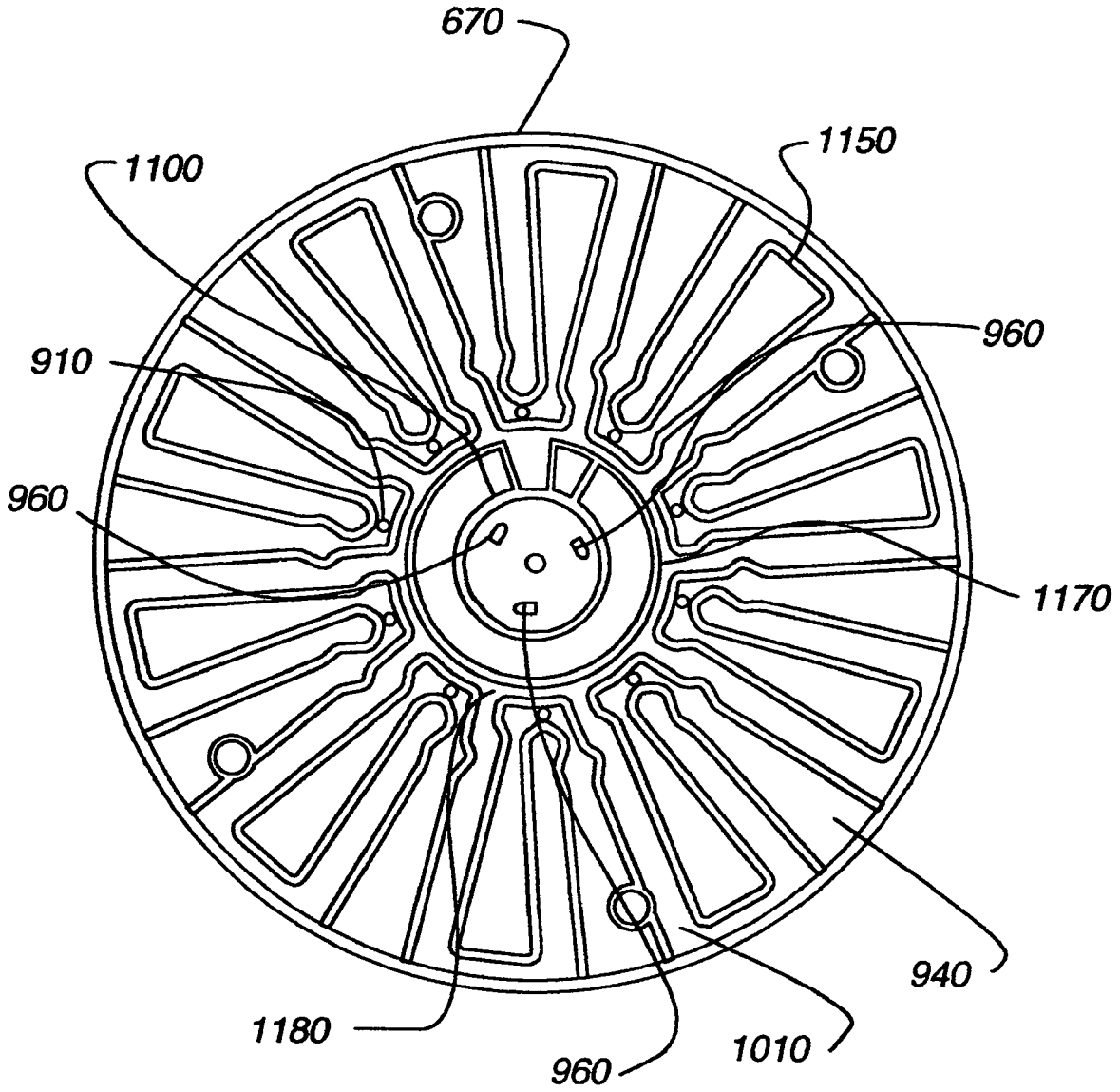
FIG. 20B depicts a plan view of the front of the backplate of FIG. 19A.
Figure 21A:
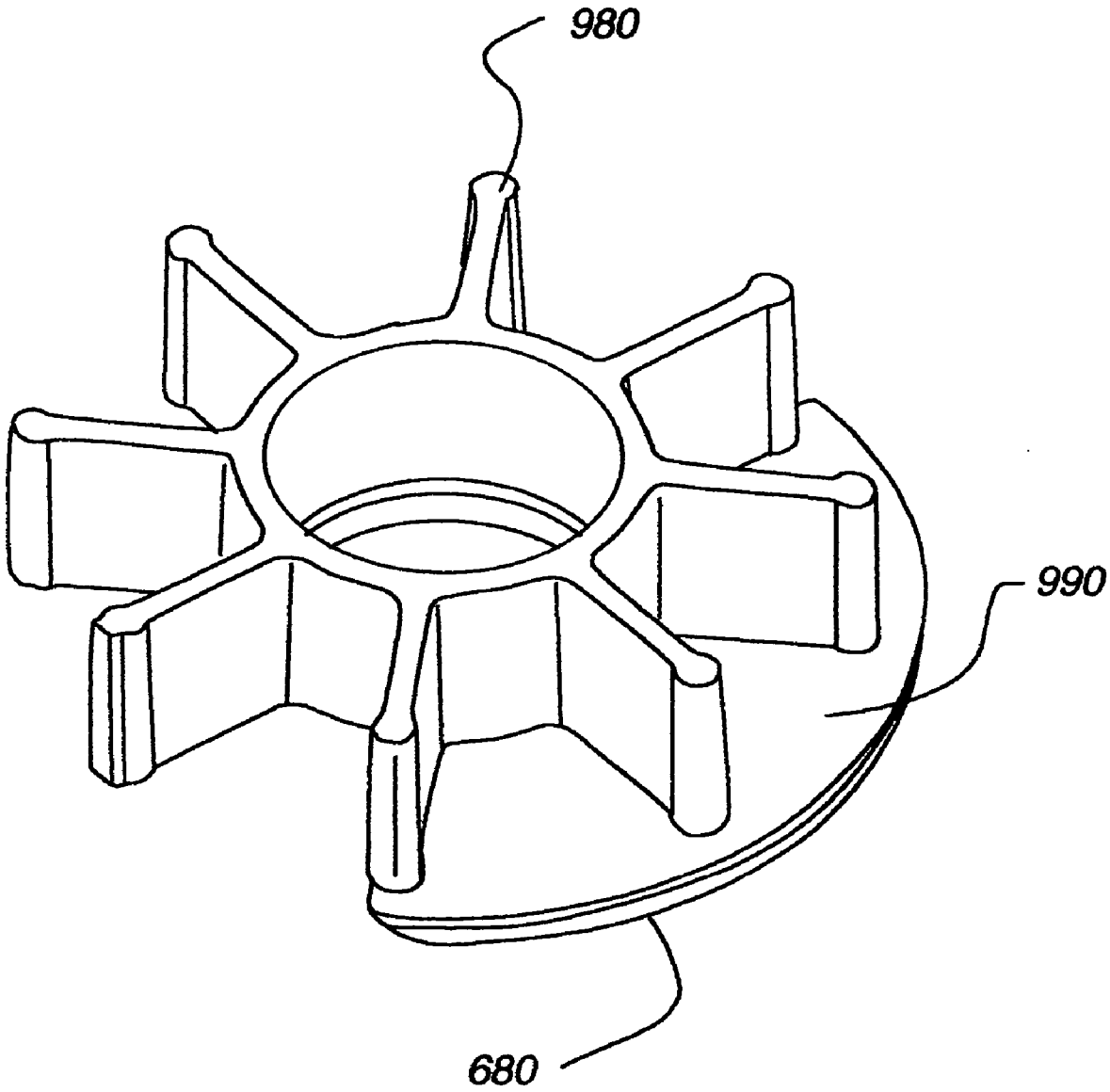
FIG. 21A depicts a perspective view of the rear of a second turbine for use in the showerhead of FIG. 6.
Figure 21B:
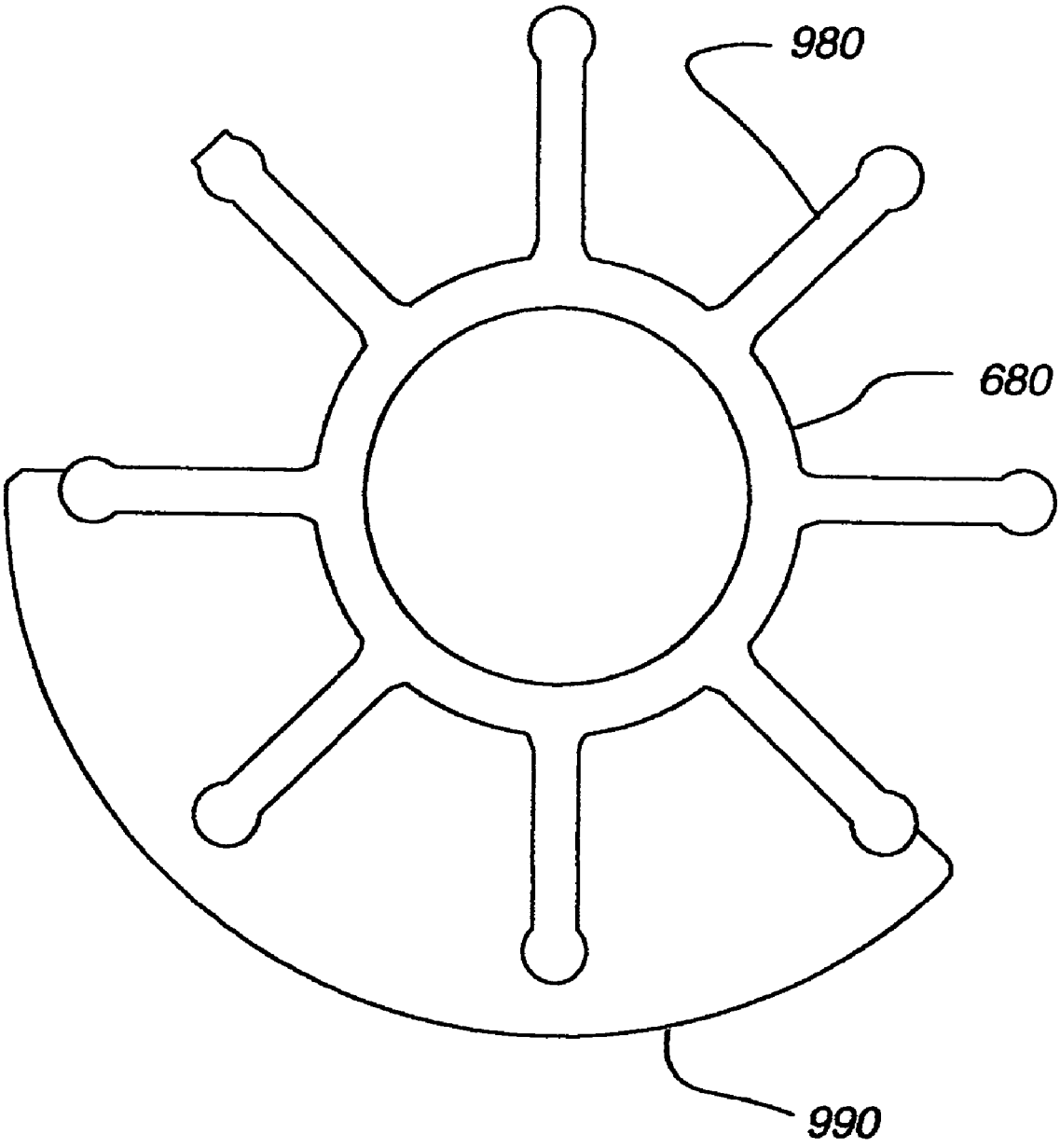
FIG. 21B depicts a plan view of the rear of a second turbine for use in the showerhead of FIG. 6.
Figure 22A:
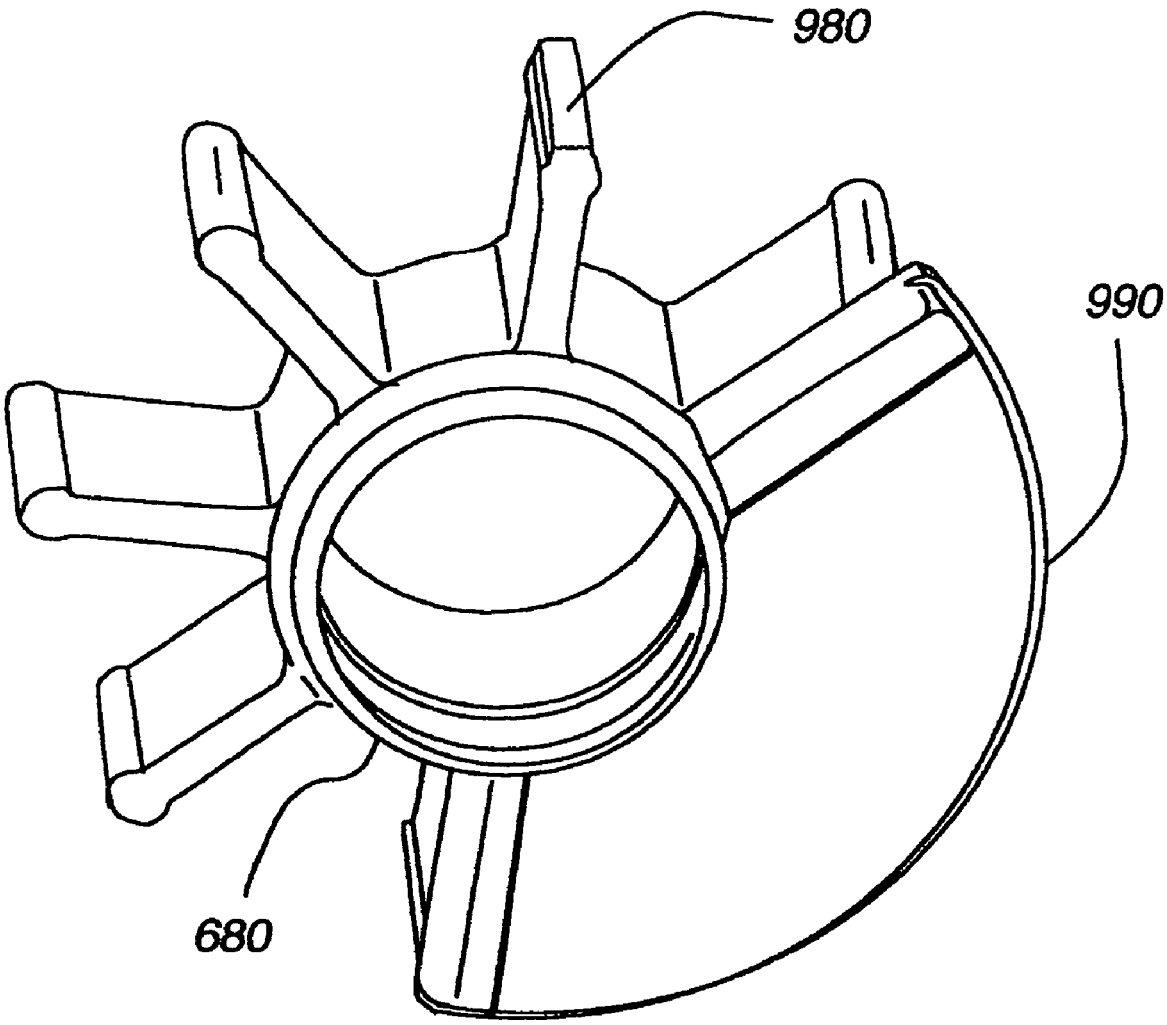
FIG. 22A depicts a perspective view of the front of the second turbine of FIG. 21A.
Figure 22B:
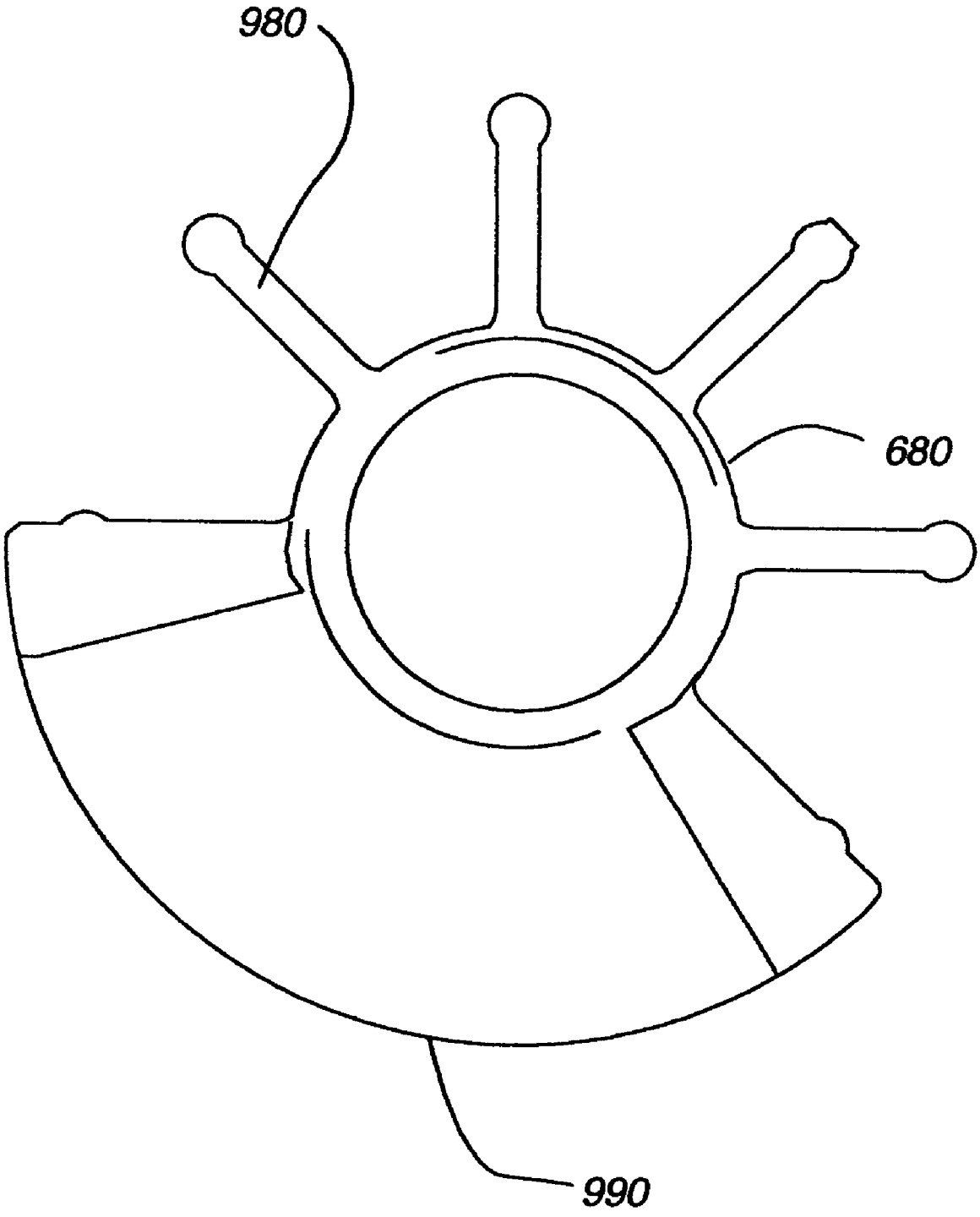
FIG. 22B depicts a plan view of the front of the second turbine of FIG. 21A.
Figure 23A:
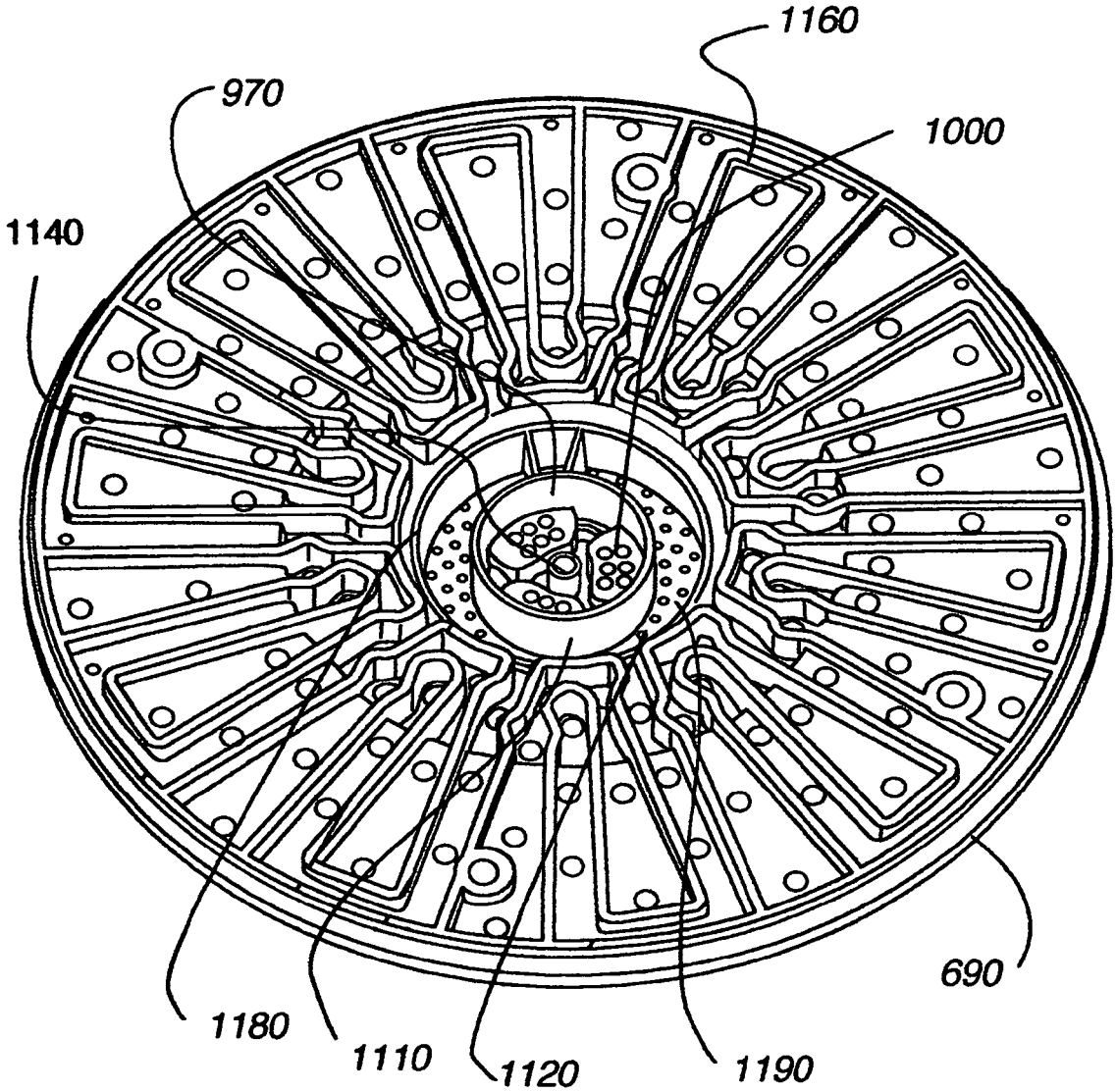
FIG. 23A depicts a perspective view of the rear of a frontplate for use in the showerhead of FIG. 6.
Figure 23B:
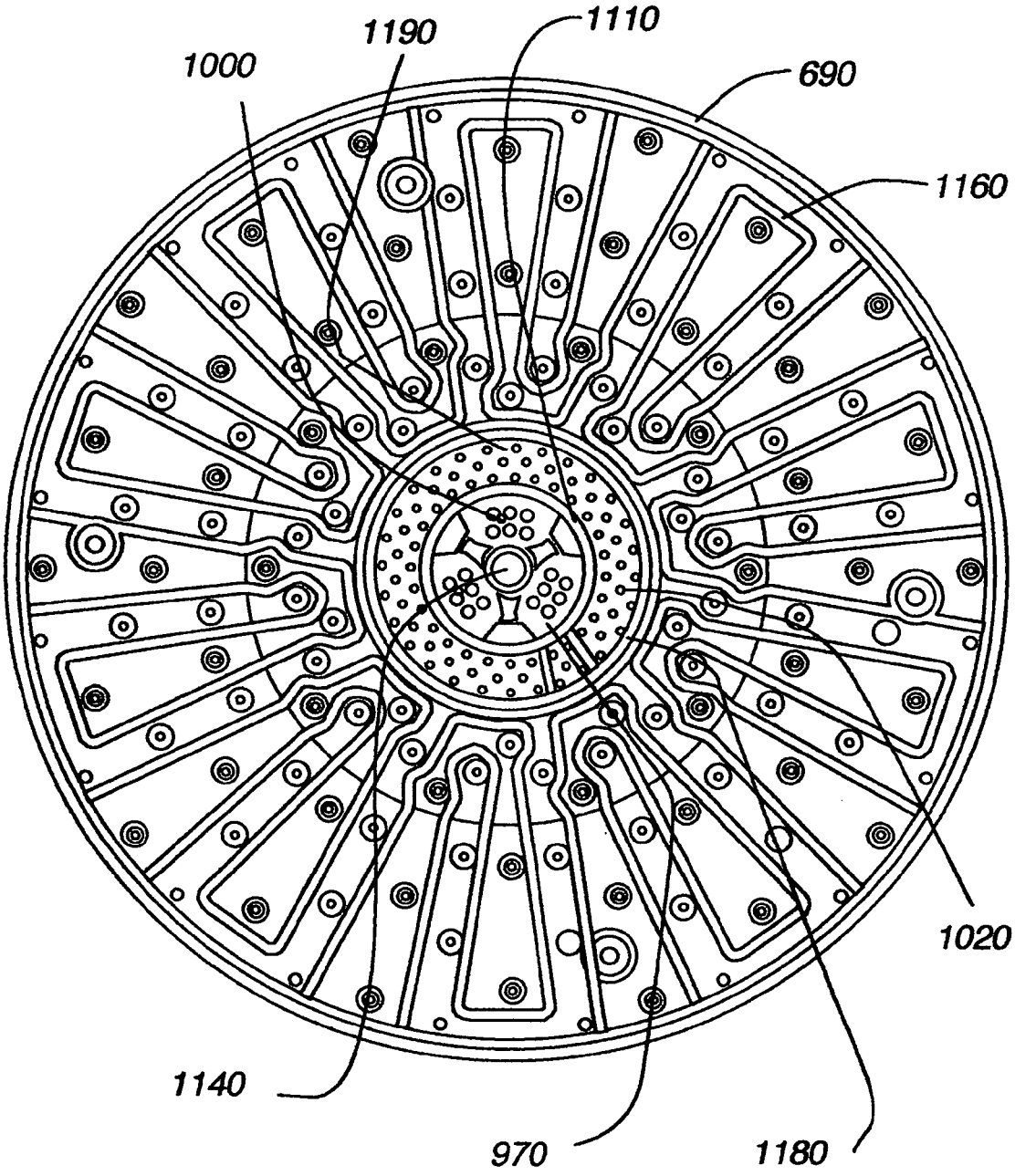
FIG. 23B depicts a plan view of the rear of a frontplate for use in the showerhead of FIG. 6.
Figure 24A:
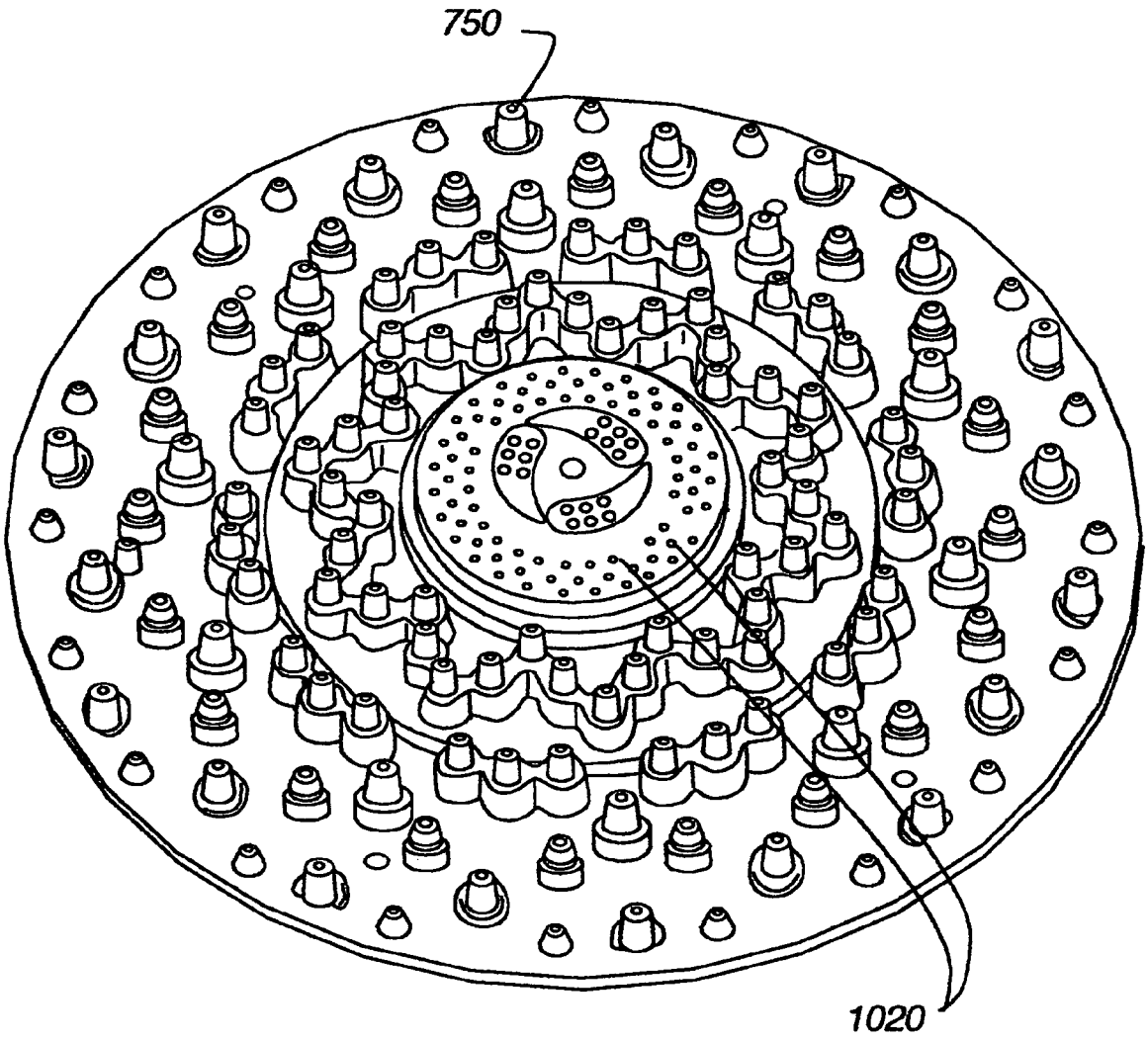
FIG. 24A depicts a perspective view of the front of the frontplate of FIG. 23A.
Figure 24B:
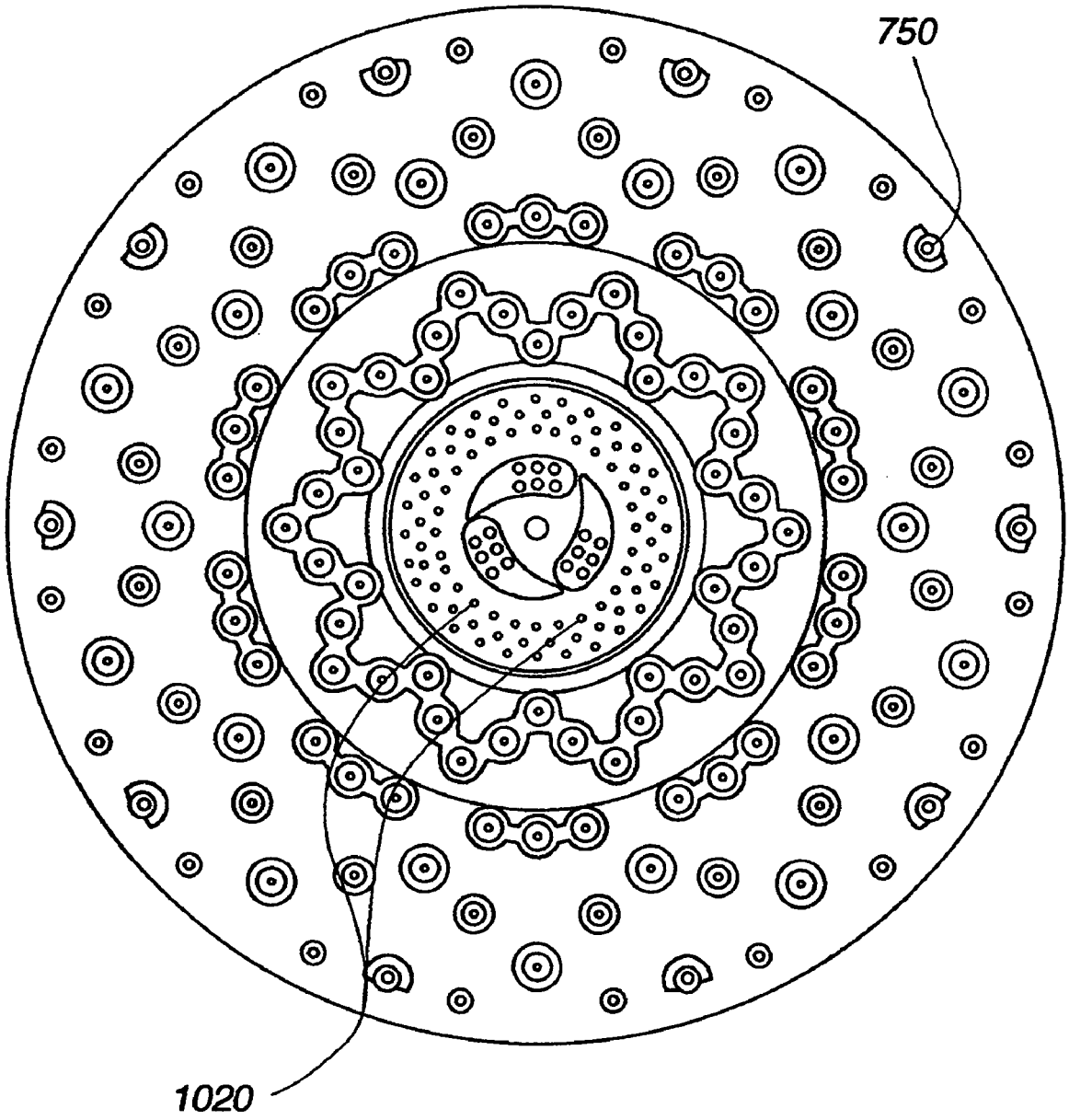
FIG. 24B depicts a plan view of the front of the frontplate of FIG. 23A.

As shown on FIG. 20A, the three backplate nozzles 960 N1, N2, and N3 are encircled by a second turbine rim 1100. When the shower head is assembled, this second turbine rim abuts a similarly configured second turbine wall 1100 formed on the rear of the frontplate 690, as shown in FIG. 23A. The combination of second turbine rim 1100 and second turbine wall 1110 defines a second turbine chamber 970 in which a second turbine 680 sits. This second turbine is shown in FIGS. 21A and 22A.

Water passing through the angled backplate nozzles 960 N1, N2, and N3 impact the blades 980 of this second turbine 680, causing the turbine to spin. The turbine generally spins about a central protrusion 1130 formed on the backplate front, which is received in a central hollow 1140 or female portion formed on the frontplate rear. As shown in greater detail in FIGS. 21A, 21B, 22A and 22B, the second turbine 680 includes a shield 990 radially extending about a portion of the turbine's circumference. In the present embodiment, the second turbine 680 includes a single shield 990. Alternate embodiments may employ a turbine having two or more shields. The turbine is oriented such that the shield rests upon a portion of the frontplate 690, rather than the backplate 670. As shown in FIG. 23A, three inner nozzle groups 1000 are formed within the second turbine chamber 970. The length of the shield 990 is approximately equal to the length of any single inner nozzle group 1000, such that the shield may block all nozzles 750 in an inner nozzle group when properly oriented. Thus, as water exits the backplate nozzles 960 it impacts the second turbine's blades 980, the shield rotates to cover each inner nozzle group in turn. This causes a pulsating spray to be emitted from the inner nozzle groups 1000.

Returning to FIG. 20A, the outlet for flow channel C' (shown on FIGS. 19A and 19B) may be seen. This outlet is also marked with the designation C'. Flow outlet C' streams water to a series of radially extending channels 1010. These radially extending channels each extend outwardly from a central circular channel 1180, along a portion of the outer circumference of the backplate front, and inwardly back towards the central circular channel. Each radially extending channel 1010 shares a side wall 1150 with an adjacent v-shaped channel 940. These flow outlet 1150 sidewalls abut similarly patterned frontplate side walls 1160 formed on the frontplate rear, as shown in FIG. 23A. The combination of flow outlet 1150 and front plate sidewalls 1160 form water-tight channels for directing water flow through both the radially extending and v-shaped channels 1110, 940. Further, since no turbine sits between the inlet and the nozzles 750 defined in the radially extending channels, no pulsating mode is ever activated for water flowing through these nozzles.

Returning to FIGS. 19A and 20A, water passing through flow channel D' on FIG. 19A enters circular outlet channel D' of FIG. 20. Flow channel D' (or outlet channel D') is bounded on the interior by the second turbine rim 1100, and on the exterior by a circular backplate center spray channel wall 1170. When the shower head is assembled, the backplate center spray channel wall abuts a frontplate center spray channel wall 1180, defining a water-tight outlet flow channel D' (also referred to as a center spray channel). As shown on FIG. 23A, a series of center spray nozzles 1020 penetrate the frontplate 690 and are formed within the center spray channel 1190. These center spray nozzles 1020 are also shown on FIG. 24A. It should be noted that, unlike the nozzles formed in the v-shaped 940 or radially extending channels 940, 1010 of the frontplate, neither the center spray nozzles 1020 nor the inner nozzle groups 1000 are received in flexible rubber nozzles 760 formed on the nozzle web 700 of FIGS. 26A and 26B. Rather, the inner nozzle groups and center spray nozzles are formed on a raised interior circular portion of the frontplate front, which passes through an interior space in the nozzle web 700 and face plate 710. Thus, the interior circular portion of the frontplate is relatively flush with the front of the face plate when the shower head is fully assembled.

In operation, water channeled through the center spray nozzles 1020 is emitted as a gentle spray at a generally lower flow rate than water emitted through other nozzle groups. The center spray nozzles 1020 may be replaced by nozzles of different diameters for different flow patterns. In yet other embodiments, the center spray nozzles (or any other groups of nozzles) could include a diffuser situated within or operatively connected to the nozzles to emit a mist from the nozzles.

Figure 25A:
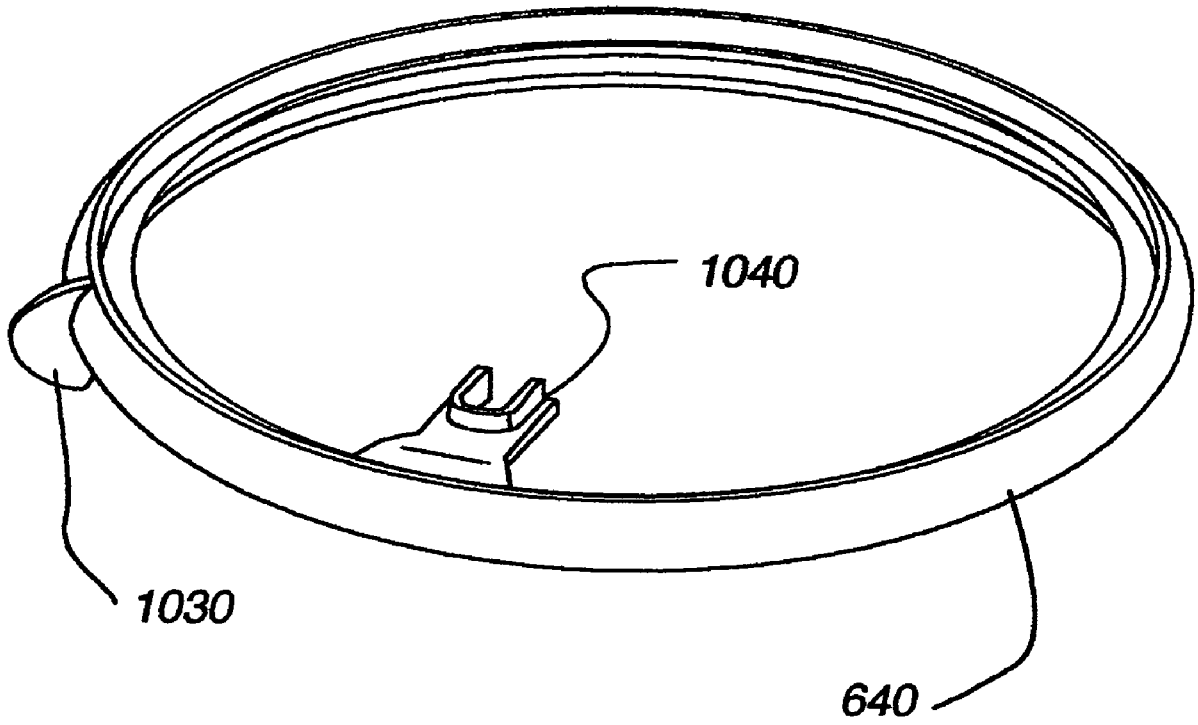
FIG. 25A depicts a perspective view of a mode ring for use in the showerhead of FIG. 6.
Figure 25B:
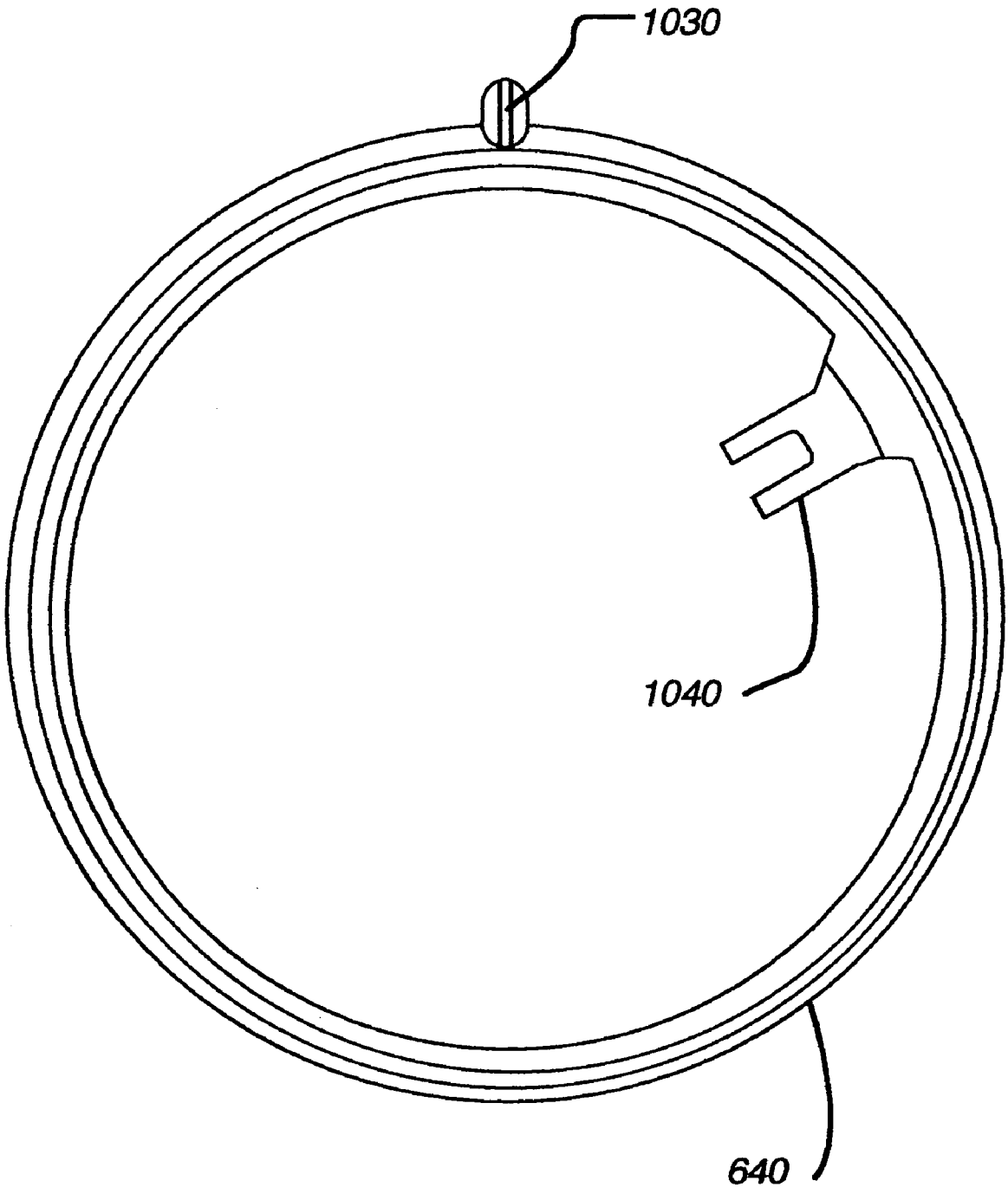
FIG. 25B depicts a plan view of a mode ring for use in the showerhead of FIG. 6.

FIG. 25A depicts a mode ring 640. As shown to best effect in FIGS. 6 and 10, the mode ring 640 encircles the shower head approximately at the joinder of the face plate 710 and base cone 530. A tab 1030 projects outwardly from the mode ring. A user may grasp the tab 1030 and rotate the mode ring 640 about the shower head's longitudinal axis to change the operational mode of the shower head.

Figure 14A:
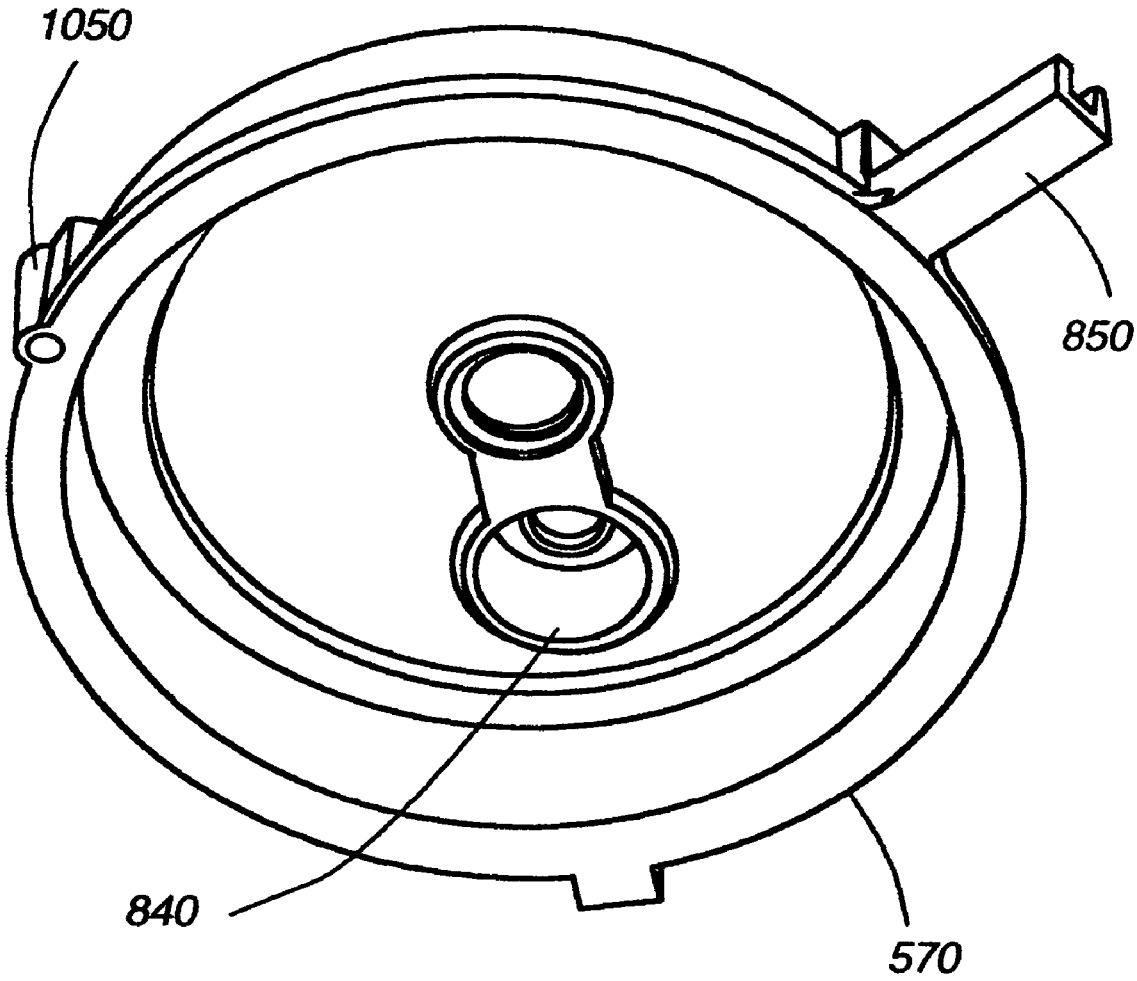
FIG. 14A depicts a perspective view of the front of the housing of FIG. 13A.
Figure 14B:
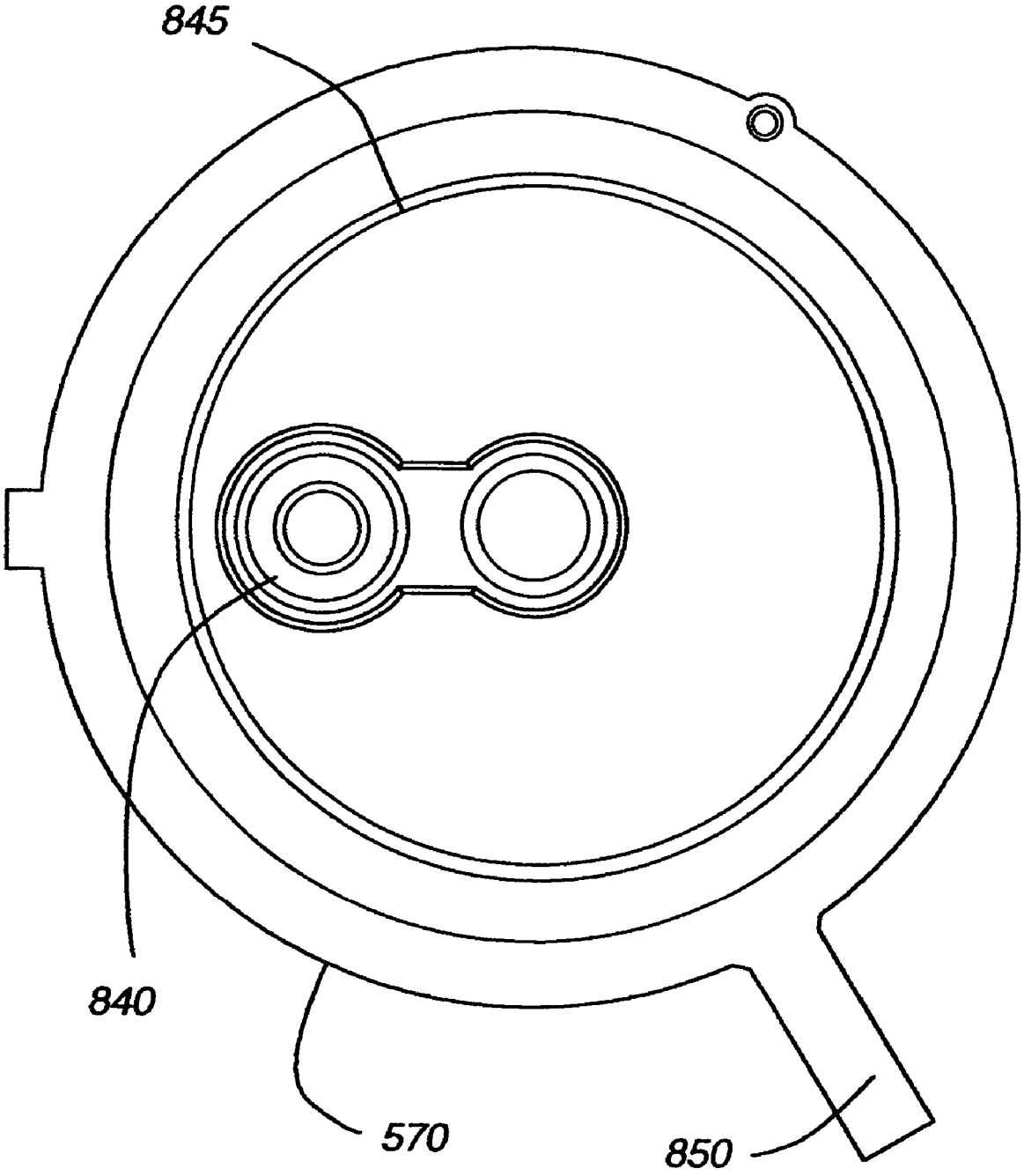
FIG. 14B depicts a plan view of the front of the housing of FIG. 13B.

When the shower head is fully assembled, a u-shaped prong 1040 projecting inwardly from the circumference of the mode ring 640 engages the protrusion 850 extending outwardly from the housing 570. Such engagement is shown to best effect in FIG. 8, while FIGS. 13A and 14A depict the housing protrusion 850. Insofar as the housing is not affixed to any portion or element of the shower head, but instead is held in place by pressure caused by the connection of the pivot ball housing 570 and cap plate 650 (see FIG. 8), the housing may rotate freely about the longitudinal axis of the shower head in conjunction with the mode ring turning. Thus, as the mode ring 640 turns, the housing 570 also turns. This permits rotational realignment of the side passage 830 formed in the housing above any of the flow holes 870 A, B, C, D formed in the backplate cap 650. For example, FIG. 10 depicts the side passage aligned above one of the backplate cap holes. A seal 620 may be placed between the side passage 830 and backplate 670 to prevent water leakage.

Further, a projection 1200 on the front of the housing 570 forms a tunnel-like structure to prevent water from splashing or otherwise dispersing across the rear surface of the backplate 670. This tunnel 840 is shown to best effect in FIGS. 14A and 14B. Generally, the side walls of the tunnel abut the rear of the backplate 670 when the shower head is fully assembled. In this manner, water may be directed through the inlet, into the pivot ball 520, through the pivot ball mount 550, into the housing 570 and along the side passage 830, through one of the flow holes 870 A, B, C, D formed in the backplate cap 650, along the associated flow channel 880 formed in the backplate rear, into one of the v-shaped channels 940, radially extending channels 1010, center spray channel 1190, or center turbine channel 970 formed by the combination of backplate 650 front and frontplate 690 rear, and ultimately out through the desired set of nozzles 1000, 1020. Should the flow hole over which the side channel 830 is positioned ultimately lead to a channel containing either the first or second turbine 660, 680, a pulsating shower spray mode may be activated.

Located circumferentially about the outer edge of the housing is a detent cavity 1050 (shown in FIG. 14A). A spring-loaded detent (not shown) nests within the detent cavity. As the housing 570 rotates with the mode ring 640 (or, in some embodiments, the mode ring moves alone), the detent moves arcuately across the backplate 670 rear between a first 1210 and second post 1220. The first and second posts restrict movement of the detent cavity and thus the housing (and mode ring). As shown in FIGS. 19A and 19B, a series of detent holes 950 is defined on the backplate rear. When the detent is positioned over one of these holes, the spring biases the detent downward, such that it at least partially enters the detent hole. Generally, this creates an audible "click" or other noise so that a user receives aural feedback that the detent has properly seated. Tactile feedback may also be provided, since the mode ring 640 may become slightly more difficult to turn when the detent seats in a detent hole 950. The detent is formed such that only a small amount of force is required to unseat the detent and continue turning the mode ring, however. For example, the lower portion of the detent may have conical sidewalls.

Referring to FIGS. 19A and 19B, it may be noted that nine detent holes 950 are formed on the backplate rear. Every other detent hole corresponds to one of the flow channel 870 A', B', C', D', such that the side passage 830 is located directly above the flow channel to which the detent hole 950 corresponds. Thus, when the detent is seated in the detent hole corresponding to flow channel B', the side passage is located above flow channel B' and water ultimately flows to the nozzles associated with flow channel B'.

Water may also be provided to two adjacent flow channels 870 simultaneously, resulting in water being emitted from multiple nozzle groups 1000, 1020 in a "combination spray." The series of detent holes marked A'/B', B'/C', and C'/D' accept the detent when the side passage 830 is positioned halfway over each of the corresponding flow channels. Thus, for example, water may be channeled to both flow channels having turbines therein simultaneously.

Finally, water may be supplied to either flow channel A' or flow channel D' to create a relatively soft spray from the associated nozzles. For example, positioning the mode ring 640 and housing 570 so that the detent seats within the detent hole 950 marked "half D'" yields partial water flow into flow channel D', and a soft center spray from the associated center spray nozzles.

Figure 26A:
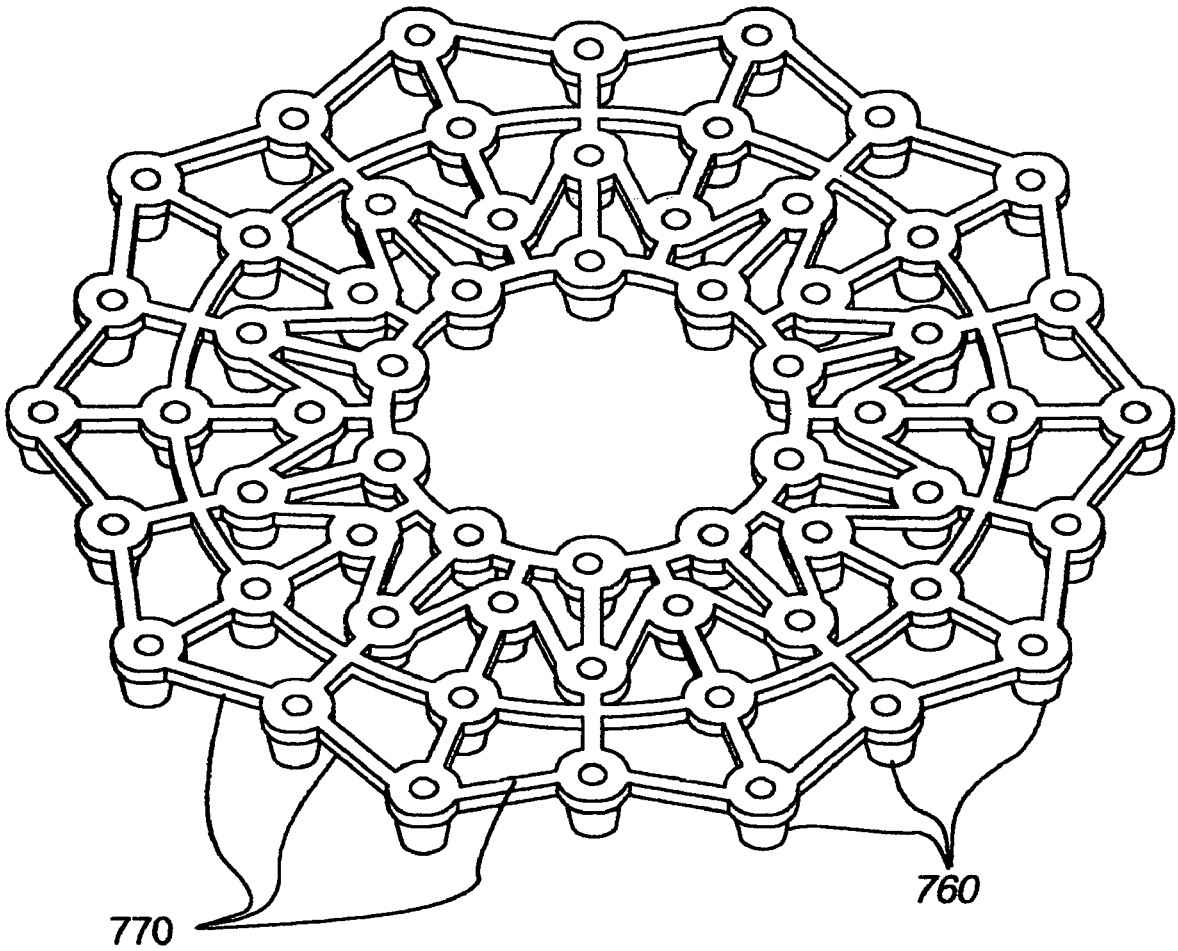
FIG. 26A depicts a perspective view of the rear of a nozzle web for use in the showerhead of FIG. 6.
Figure 26B:
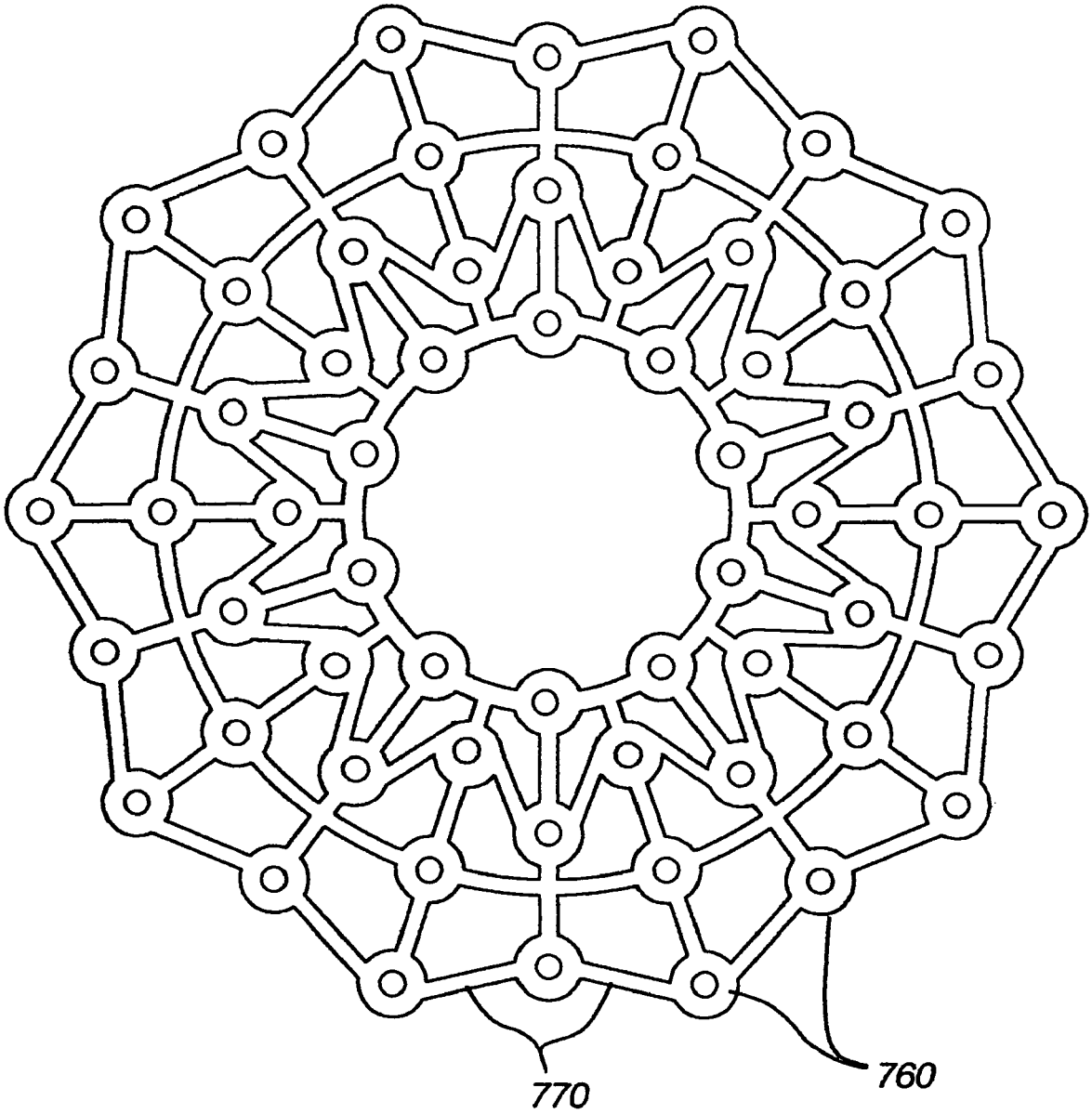
FIG. 26B depicts a plan view of the rear of a nozzle web for use in the showerhead of FIG. 6.
Figure 27A:
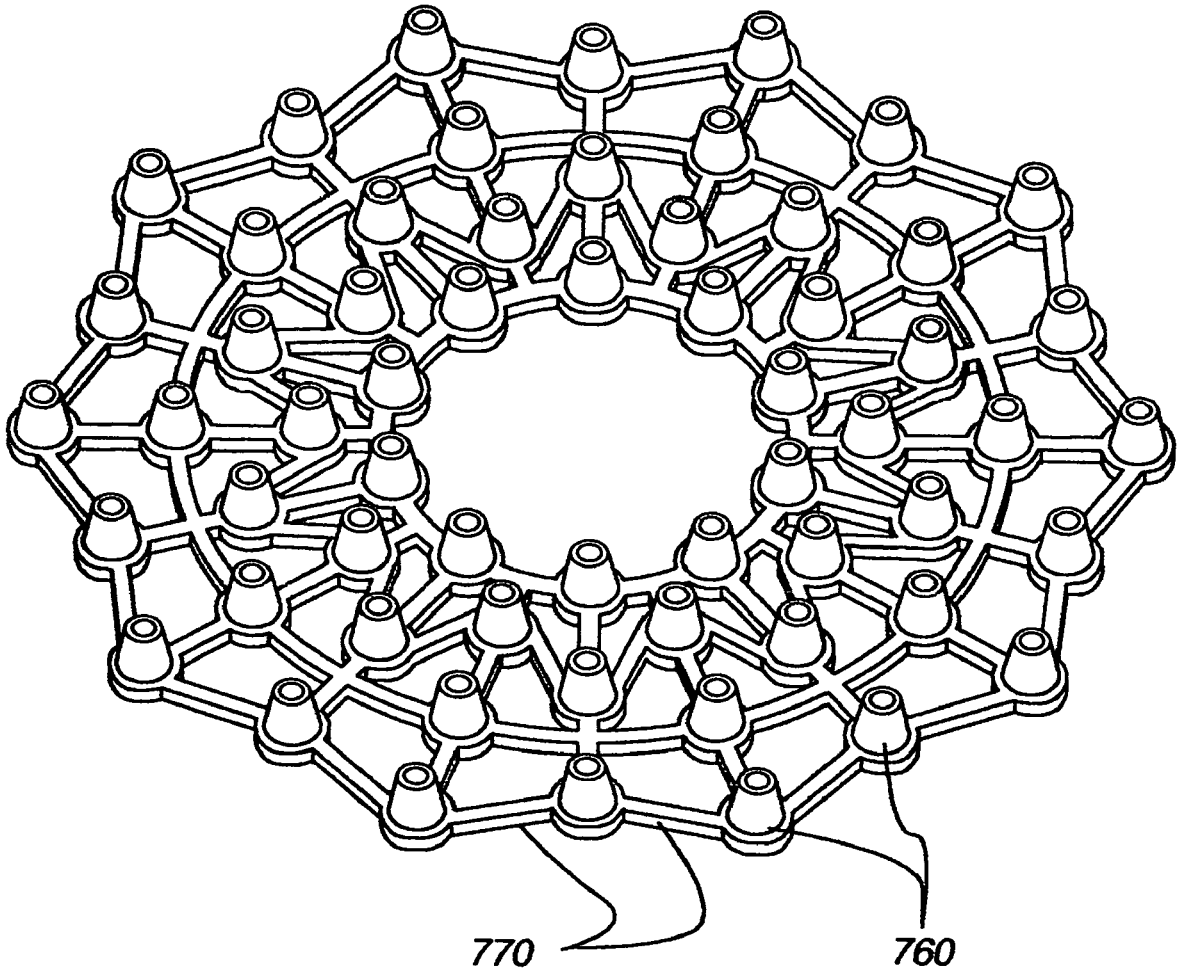
FIG. 27A depicts a perspective view of the front of the nozzle web of FIG. 26A.
Figure 27B:
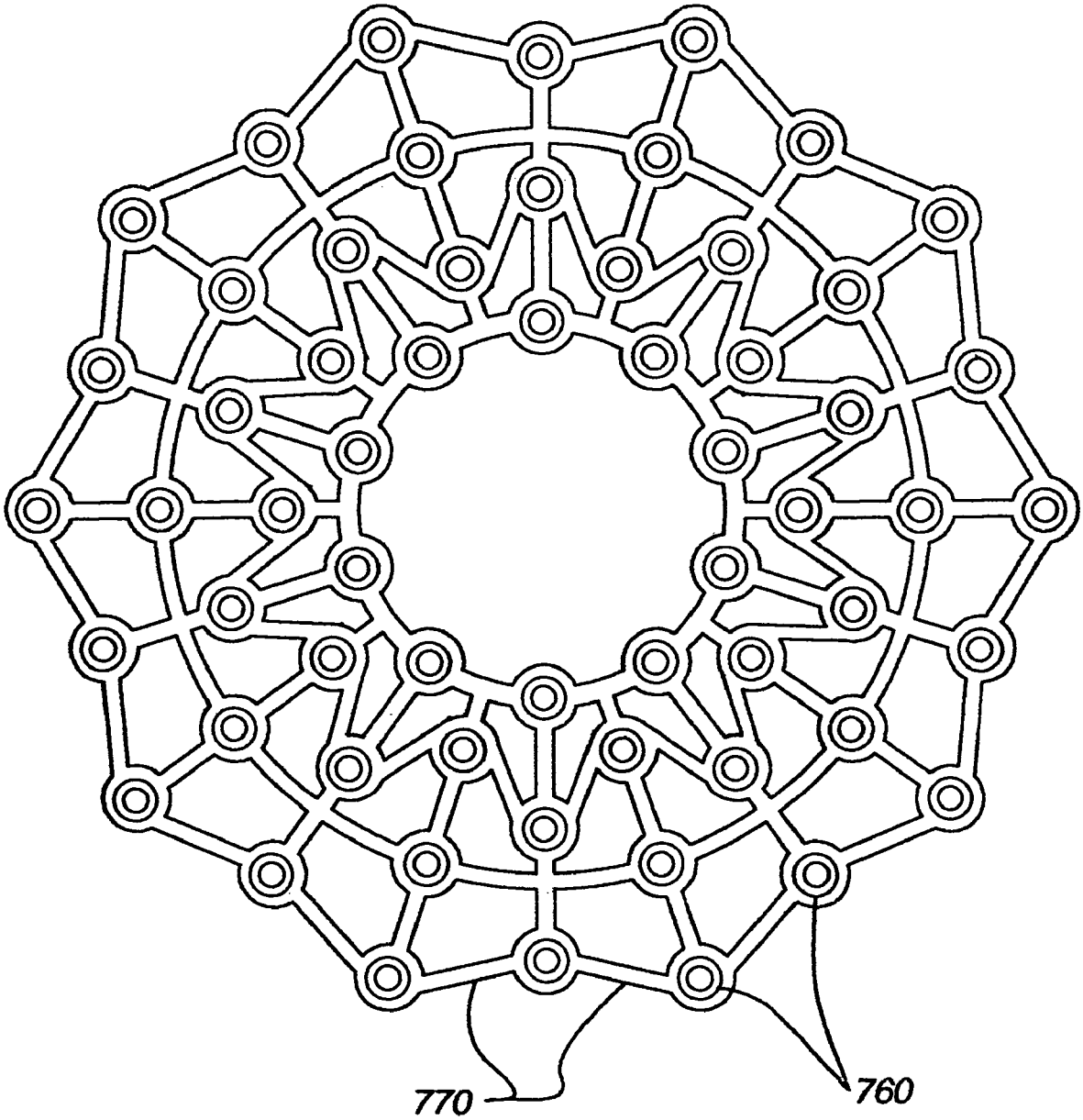
FIG. 27B depicts a plan view of the front of the nozzle web of FIG. 26A.
Figure 28A:
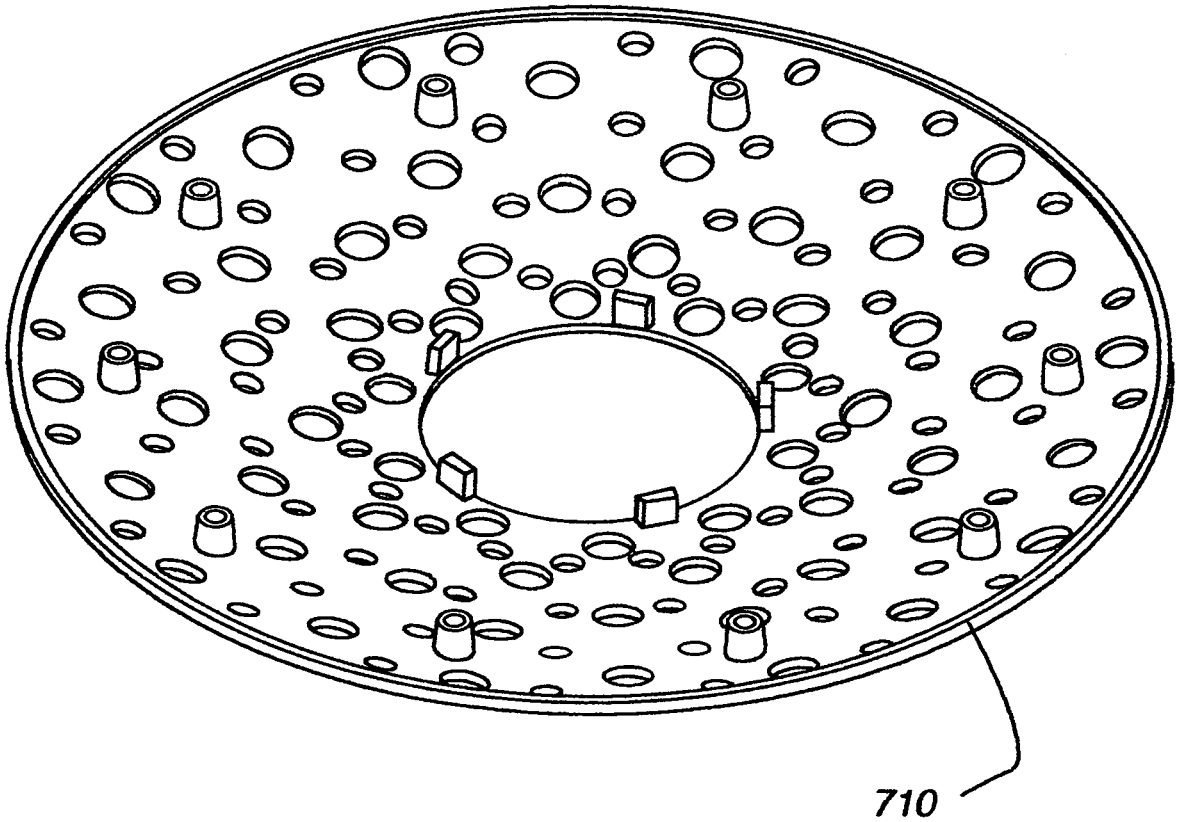
FIG. 28A depicts a perspective view of the rear of a faceplate for use in the showerhead of FIG. 6.
Figure 28B:
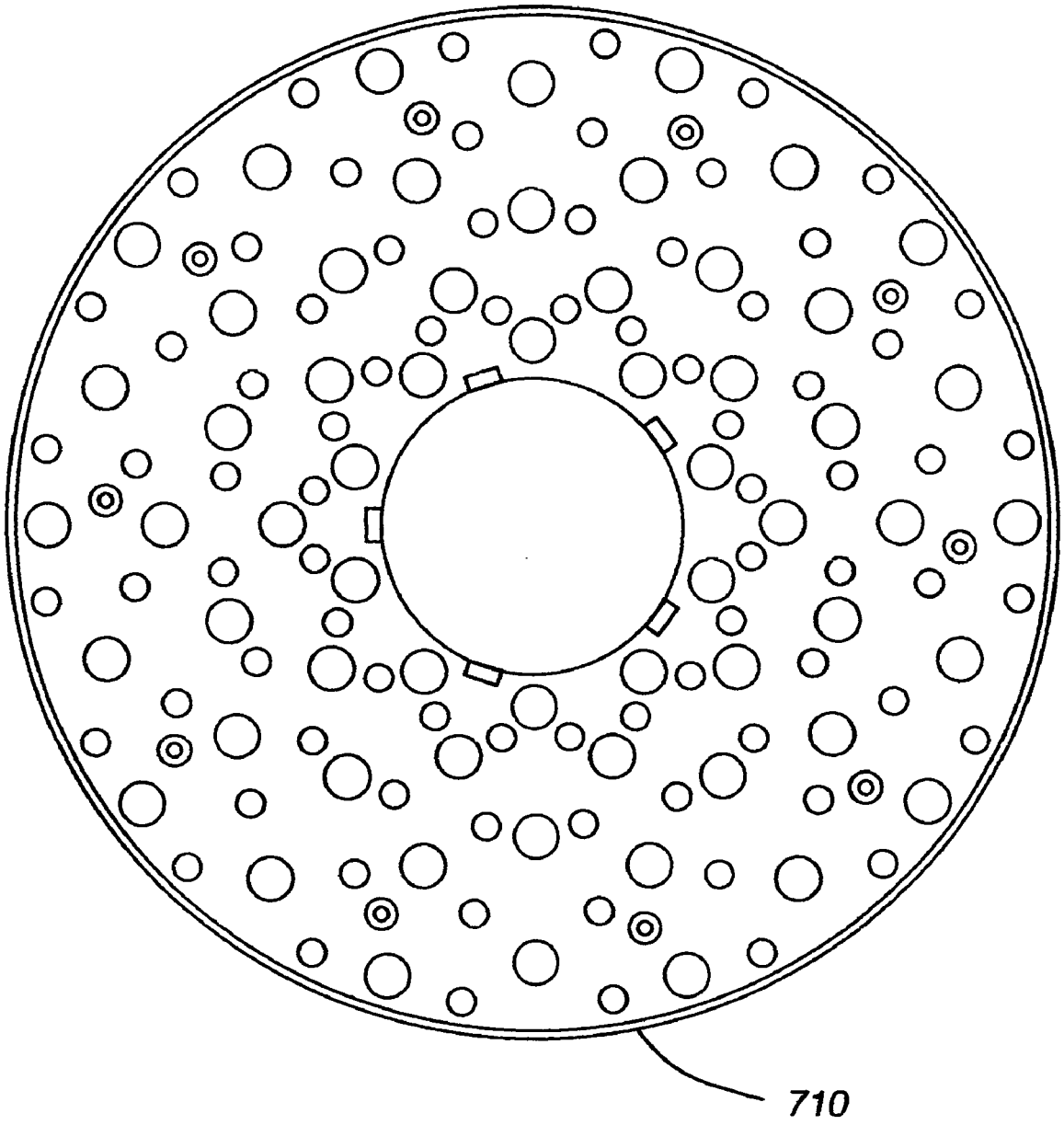
FIG. 28B depicts a perspective view of the rear of a faceplate for use in the showerhead of FIG. 6.
Figure 29A:
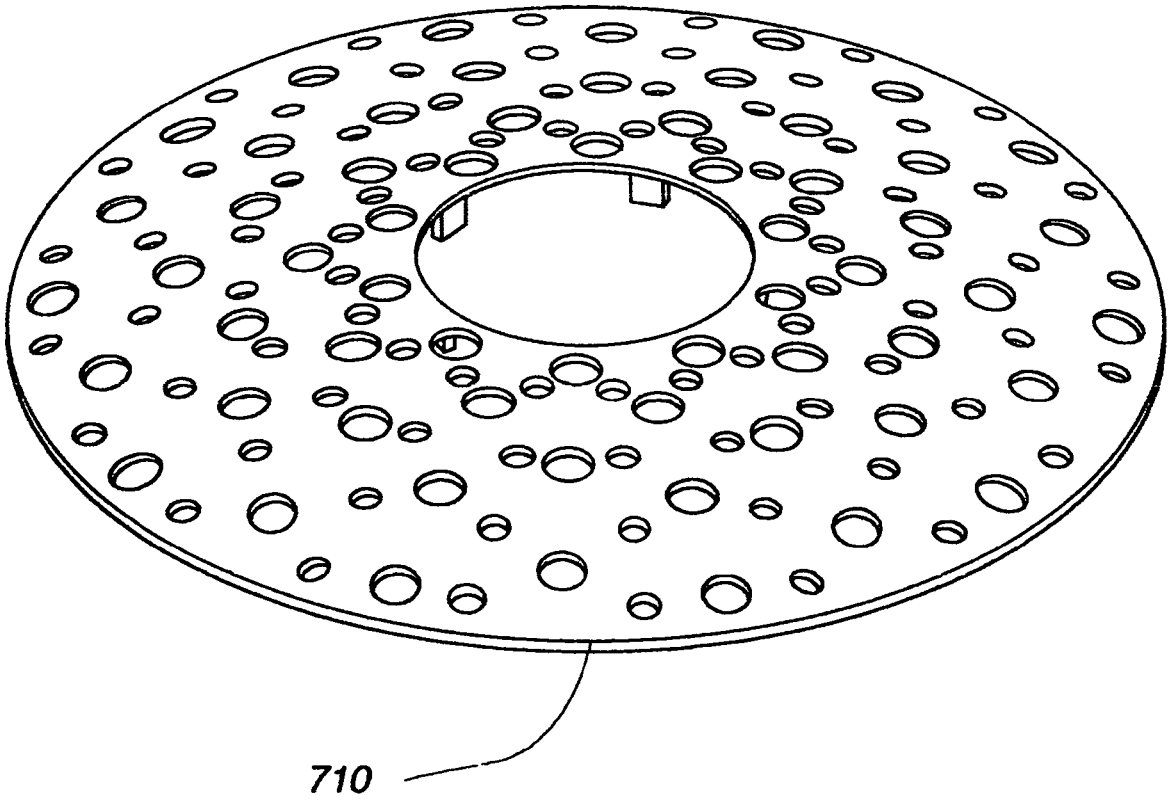
FIG. 29A depicts a perspective view of the front of the faceplate shown in FIG. 28A.
Figure 29B:
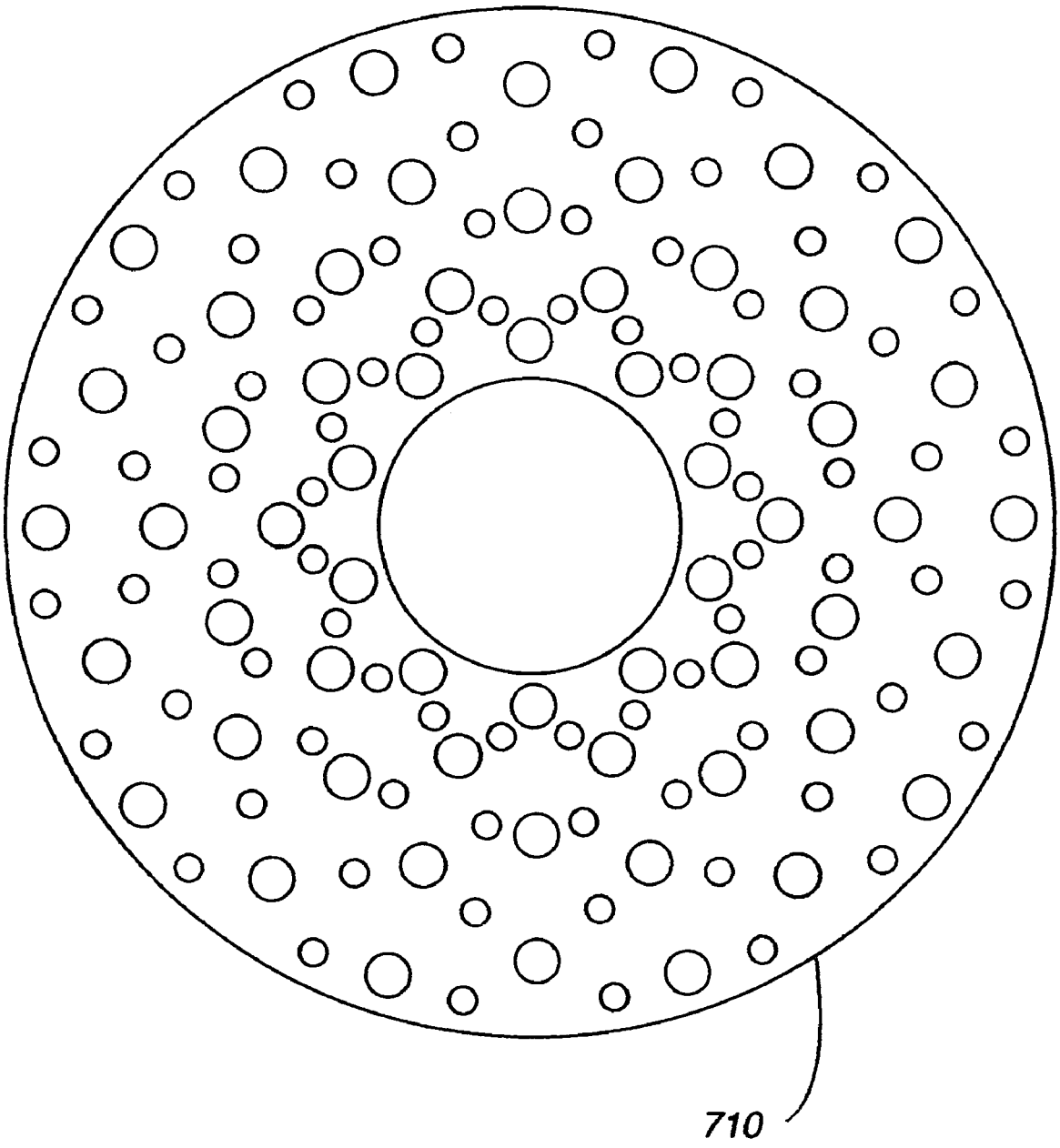
FIG. 29B depicts a perspective view of the front of the faceplate shown in FIG. 28A.
Figure 30:
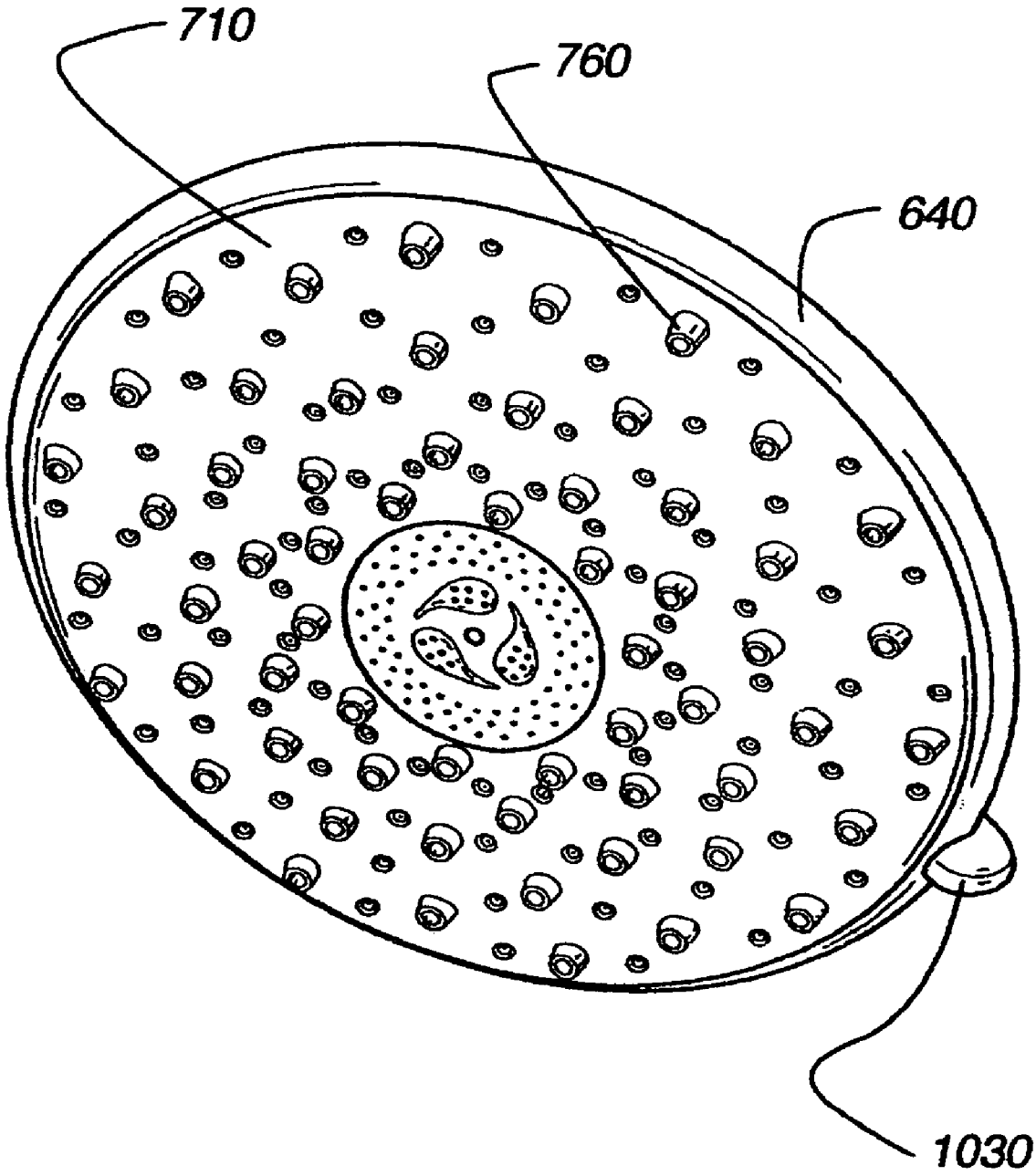
FIG. 30 depicts a perspective view of the second embodiment of the shower head.
Figure 31:
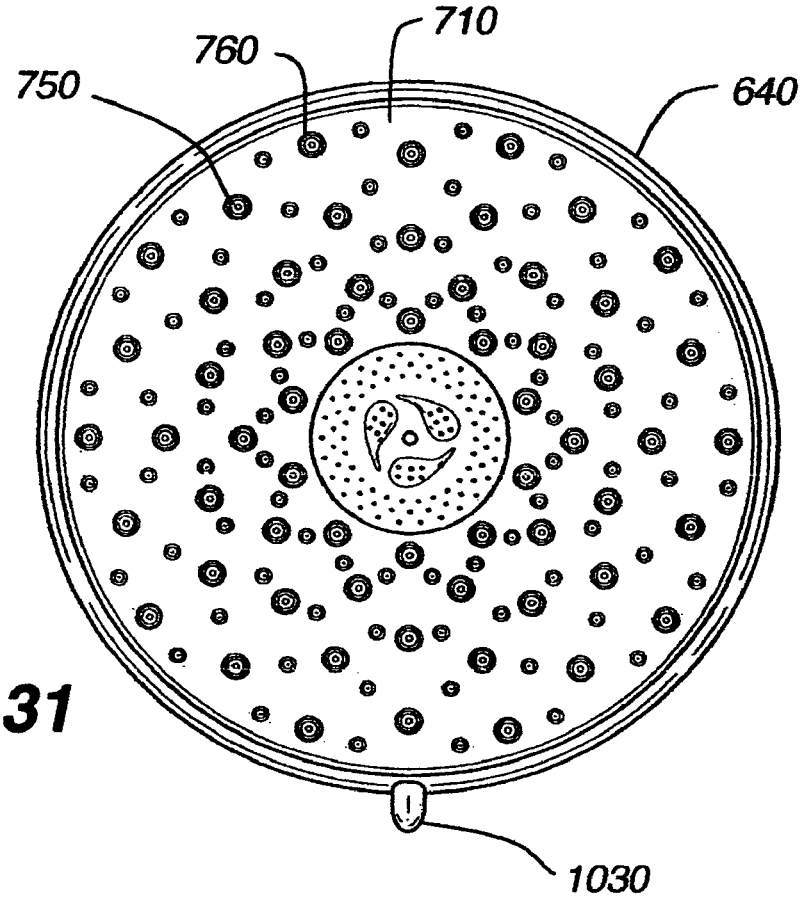
FIG. 31 depicts a front view of the second embodiment of the shower head.
Figure 32:
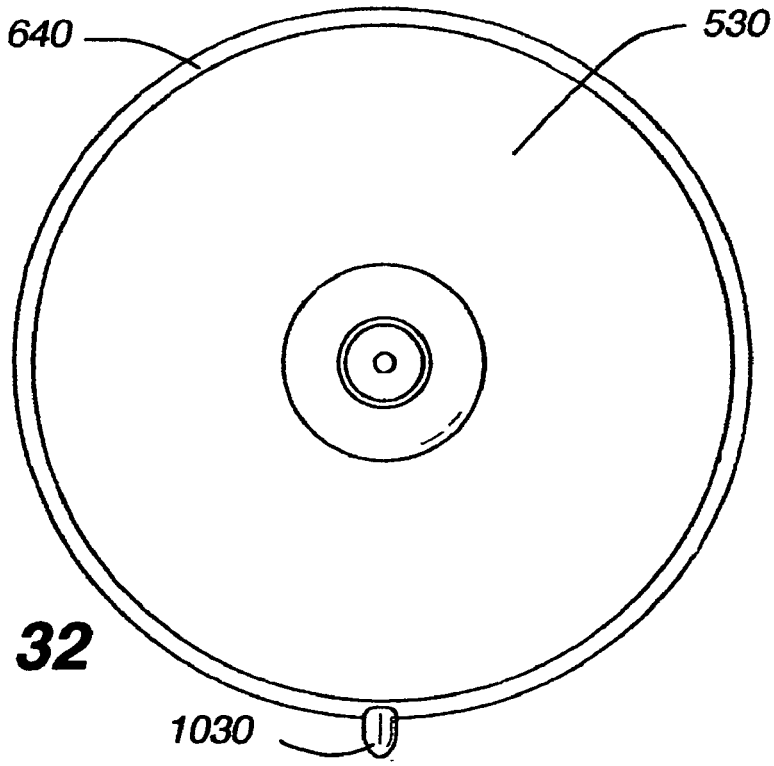
FIG. 32 depicts a rear view of the second embodiment of the shower head.
Figure 33:
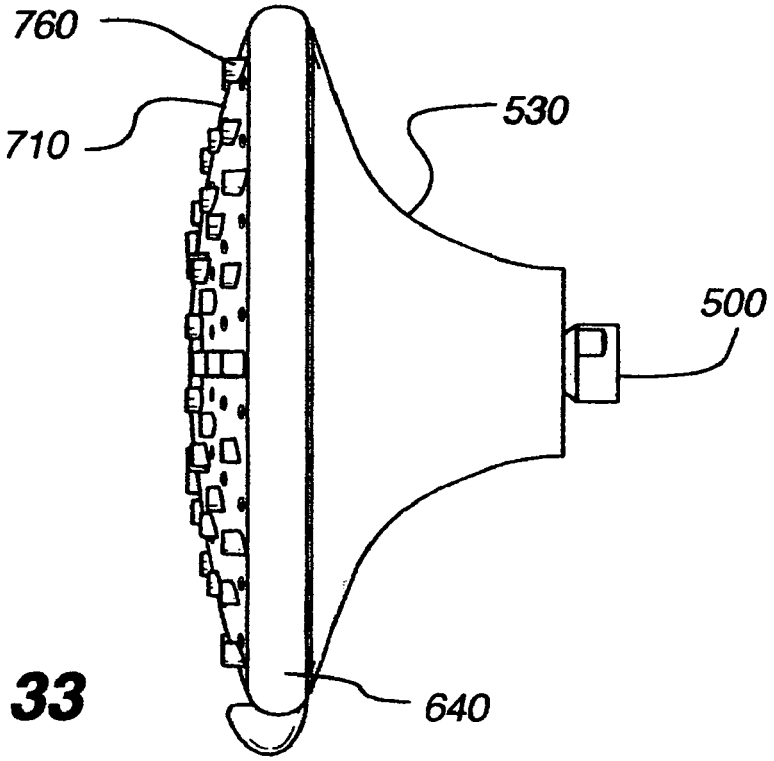
FIG. 33 depicts a right side view of the second embodiment of the shower head.
Figure 34:
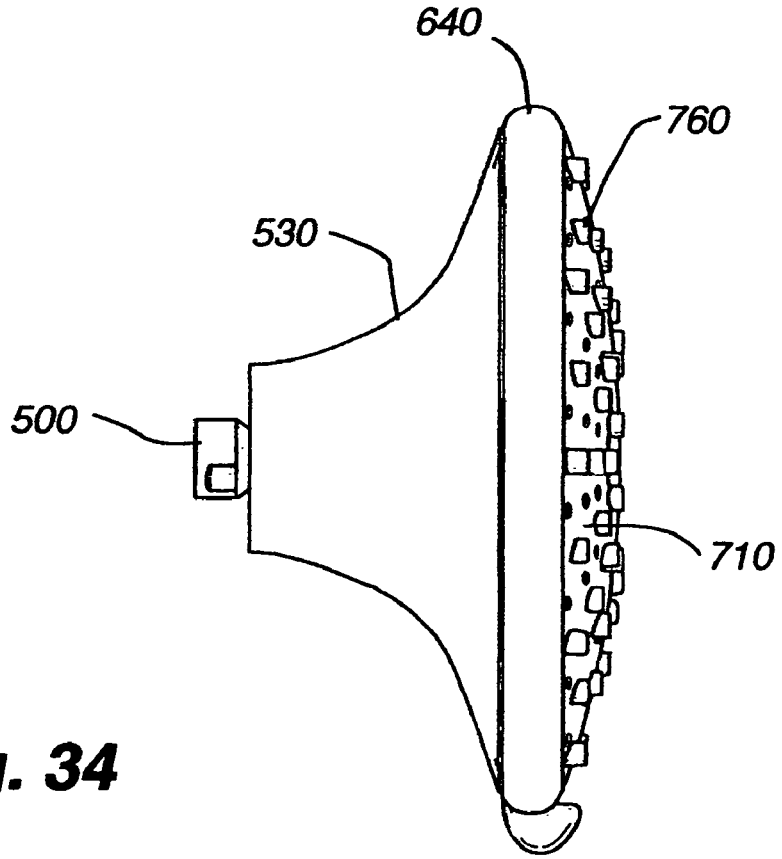
FIG. 34 depicts a left side view of the second embodiment of the shower head.
Figure 35:
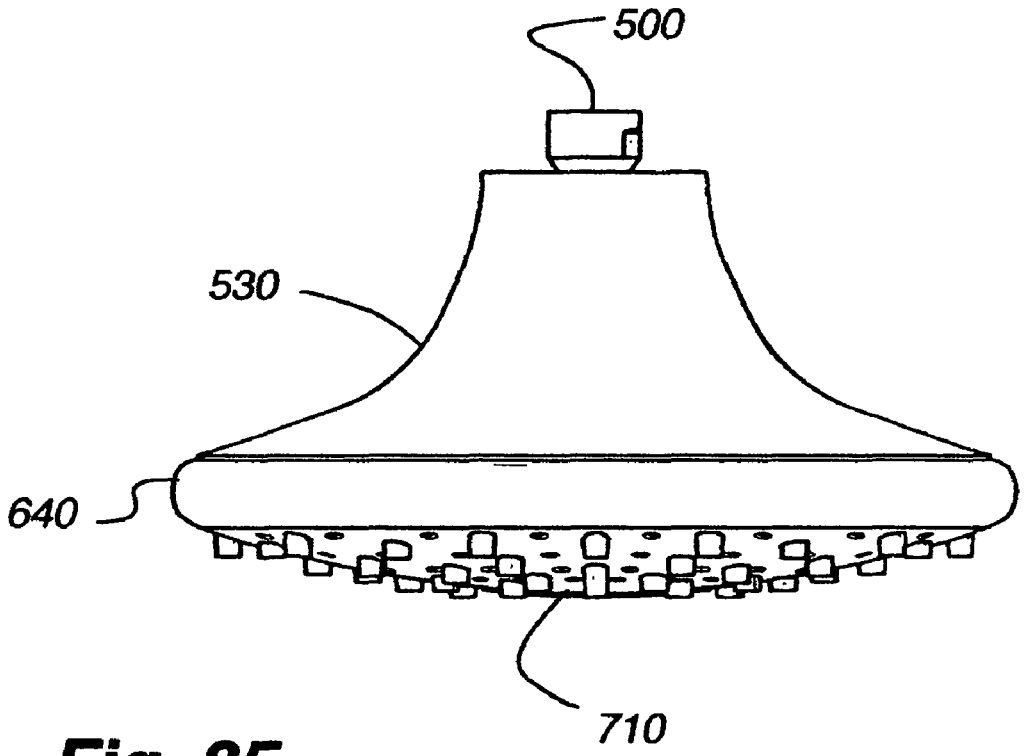
FIG. 35 depicts a top view of the second embodiment of the shower head.
Figure 36:
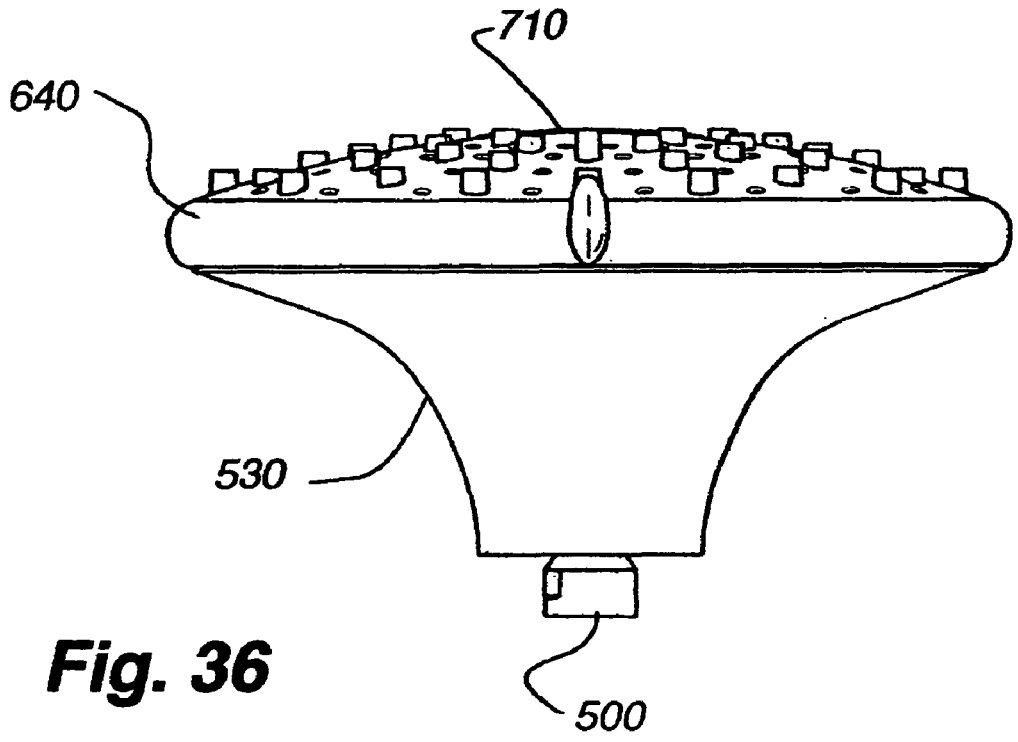
FIG. 36 depicts a bottom view of the second embodiment of the shower head.

FIGS. 26A and 27A depict the rear and front of the nozzle web 700, respectively. FIGS. 26B and 27B are plan views corresponding of the rear and front of the nozzle web 700, respectively. Similarly, FIGS. 28A and 29A depict the rear and front of the face plate 710, respectively, with FIGS. 28B and 29B being rear and front plan views thereof. The nozzle web and face plate have been described with particularity above.

Figure 37A:
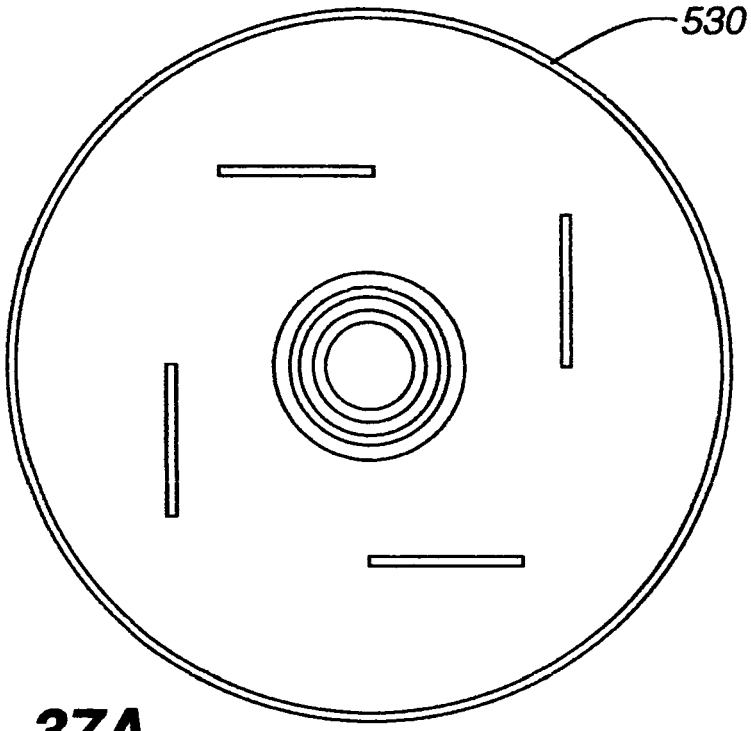
FIG. 37A depicts a plan view of the interior of a base cone.
Figure 37B:
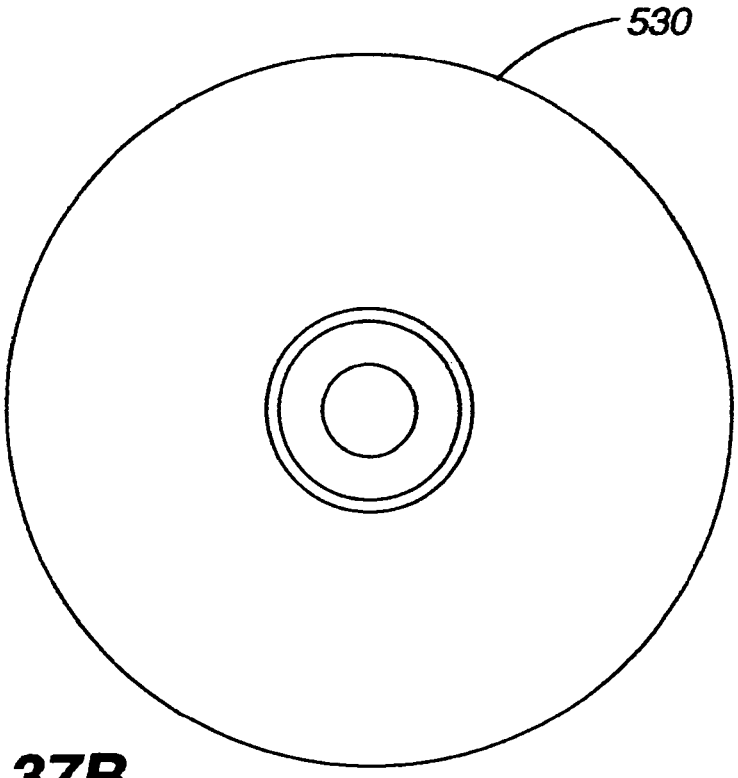
FIG. 37B depicts a plan view of the exterior of the base cone of FIG. 35.

Finally, FIGS. 30-36 depict various views of the exterior of the assembled shower head, while FIGS. 37A and 37B depict an interior and exterior plan view of the base cone 530, respectively. FIGS. 30-36, for example, depict the relationship between the mode ring 640, nozzle sheaths 760 and faceplate 710

Any of the embodiments described herein may also be equipped with a so-called "pause mode." While operating in a pause mode, water is channeled through some form of flow restrictor, such as a properly-sized channel or aperture, to provide minimal water flow to one or more nozzles 750 on the frontplate 690. Water flows through these nozzles at a low flow rate. Typically, water flows along the frontplate in pause mode, although in some embodiments it may be emitted a short distance beyond the frontplate. In yet other embodiments, activating a pause mode may prevent any water flow from exiting the showerhead.

Additionally, and as referenced above, the showerhead may emit water in a manner emulating a gentle rainfall. Rainfall emulation is generally performed by appropriately sizing the nozzle orifices. The nozzle orifices are sized such that the volume of water flowing therethrough is larger when compared to standard showerheads. This, in turn, results in a decrease in water pressure for water emitted from the appropriately-sized nozzles. The lowered water pressure yields a more gentle water spray.

In the present embodiment, two nozzle sets are generally used to create rainfall water sprays. The nozzles fed by flow channel C' and the radially-extending channels 1010 emit a steady rainfall spray, and may be referred to as "rain nozzles." The nozzles fed by flow channel A' and the V-shaped channels 940 emit a pulsed rainfall spray, and may be referred to as "pulsed rain nozzles." In the present embodiment, the rain nozzles have an orifice diameter of approximately 0.037 inches, while the pulsed rain nozzles have an orifice diameter of approximately 0.048 inches. Alternate embodiments may vary the orifice sizes to change the volume and pressure of water flow therethrough, or may vary the orifice sizes of other nozzle groups to emulate rainfall as well.

Although the invention described herein has been disclosed with reference to particular embodiments physical characteristics and modes of operation, alternative embodiments may vary some or all of these elements. For example, certain embodiments may omit one or both turbines, while other embodiments vary the flow channels to which any or all of the flow holes A, B, C, D lead. as yet another example, the lifting device of the first embodiment may be used with one or both turbines of the second embodiment The other embodiments may employ a rationing mechanism or stop to prevent the mode ring and housing from turning beyond a certain point. In still other embodiments, the nozzle web may be omitted. Accordingly, the proper scope of this invention is defined by the following claims.

What is claimed is:

1. An engine for directing a first water flow, comprising:

an inlet;

a first flow channel fluidly connected to the inlet;

a second flow channel fluidly connected to the inlet;

a first pulsating flow turbine providing a first pulse pattern operatively connected to the first flow channel;

a second pulsating flow turbine providing a second pulse pattern positioned concentric with the first pulsating flow turbine and operatively connected to the second flow channel;

a first outlet of the first flow channel leading to a first set of nozzles;

a second outlet of the second flow channel leading to a second set of nozzles separate from the first set of nozzles; and a mode selector positioned between the inlet and the first and second flow channels and operable to alternately direct the first water flow from the inlet exclusively to the first flow channel, exclusively to the second flow channel, and simultaneously to both.

2. The engine of claim 1, wherein the first and second pulsating flow turbines are concentric about an axis of the engine.

3. The engine of claim 2, further comprising:

a flow restrictor operative to restrict the first water flow and therefrom facilitate a second water flow, wherein the second water flow is less than the first water flow.

4. The engine of claim 1, further comprising:

a backplate at least partially defining the first flow channel and the second flow channel;

a first detent hole defined on the backplate;

a second detent hole defined on the backplate;

a detent connected to the mode selector and operative to seat within at least the first and second detent holes; wherein the detent occupies the first detent hole when the mode selector positioned to direct the first water flow to the first flow channel; and the detent occupies the second detent hole when the mode selector is positioned to direct the first water flow to the second flow channel.

5. The engine of claim 1, further comprising:

a third flow channel fluidly connected to the inlet; wherein the mode selector is further operative to direct the first water flow from the inlet to the third flow channel; and the mode selector is further operative to direct the first water flow from the inlet to the second and third channels simultaneously.

6. The engine of claim 5, wherein the mode selector is further operative to direct a portion less than the whole of the first water flow from the inlet to the third flow channel.

7. The engine of claim 1, wherein:

the first pulsating flow turbine is operative to at least momentarily interrupt the first water flow through the first flow channel; and the second pulsating flow turbine is operative to at least momentarily interrupt the first water flow through the second flow channel.

8. The engine of claim 1, wherein:

the first pulsating flow turbine has a first diameter;

the second pulsating flow turbine has a second diameter; and the first and second pulsating flow turbines rotate at varying speeds.

9. The engine of claim 1, further comprising a nozzle web defining a first set of nozzle sheaths; and the first set of nozzles is received in the first set of nozzle sheaths.

10. The engine of claim 9, further comprising:

a housing disposed about the first flow channel, the second flow channel, the first pulsating flow turbine, and the second pulsating flow turbine; wherein the mode selector comprises a mode ring at least partially exterior to the housing.

11. The engine of claim 1, further comprising:

a backplate at least partially defining the first and second flow channels; and a front plate fluidly connected to the backplate, the front plate at least partially further defining the first and second flow channels.

12. The engine of claim 1, wherein the first pulsating flow turbine further comprises:

a first set of two or more blades connected to the first pulsating flow turbine defining at least a first space between the first set of two or more blades; and at least one flange connected to the first pulsating flow turbine at least partially covering the space between the first set of two or more blades;

further wherein the second pulsating flow turbine further comprises:

a second set of two or more blades connected to the second pulsating flow turbine defining at least a second space between the second set of two or more blades; and at least one shield connected to the second pulsating flow turbine at least partially covering the space between the second set of two or more blades.

13. The engine of claim 12, wherein the at least one flange extends to cover less than a quarter of a circumference of the first pulsating flow turbine; and the at least one shield extends to cover at least a third of a circumference of the second pulsating flow turbine.

14. The engine of claim 12, wherein the first pulsating flow turbine further comprises an annular ring;

the first set of two or more blades extends radially inward from the annular ring; and the first flange extends radially inward from the annular ring between the first set of two or more blades.

15. The engine of claim 1, wherein the first pulsating flow turbine and the second pulsating flow turbine are located in the same plane.

16. The engine of claim 1, wherein the first pulsating flow turbine is positioned above the second pulsating flow turbine relative to the inlet.

17. The engine of claim 1, wherein an external diameter of the second pulsating flow turbine is less than an internal diameter of the first pulsating flow turbine.

18. The engine of claim 1, wherein the first pulsating flow turbine creates a first pulsed flow pattern in the first flow channel and the second pulsating flow turbine creates a second pulsed flow pattern in the second flow channel.

19. A method for manufacturing a showerhead, comprising:

providing an inlet;

providing a first flow channel fluidly connected to the inlet;

providing a second flow channel fluidly connected to the inlet;

placing a first pulsating flow turbine within the first flow channel;

placing a second pulsating flow turbine concentric with the first pulsating flow turbine within the second flow channel, wherein an external diameter of the second pulsating flow turbine is less than an internal diameter of the first pulsating flow turbine;

defining a first outlet of the first flow channel leading to a first set of nozzles; and defining a second outlet of the second flow channel leading to a second set of nozzles separate from the first set of nozzles.

20. The method for manufacturing a showerhead of claim 19, further comprising:

connecting a first set of two or more blades to the first pulsating flow turbine;

defining at least a first space between the first set of two or more blades;

connecting at least one flange to the first pulsating flow turbine at least partially covering the space between the first set of two or more blades;

connecting a second set of two or more blades to the second pulsating flow turbine;

defining at least a second space between the second set of two or more blades; and connecting at least one shield to the second pulsating flow turbine at least partially covering the space between the second set of two or more blades.

21. The method for manufacturing a showerhead of claim 19 further comprising locating the first pulsating flow turbine and the second pulsating flow turbine in the same plane.

22. The method for manufacturing a showerhead of claim 19 further comprising positioning the first pulsating flow turbine above the second pulsating flow turbine relative to the inlet.

* * * * *